US010239067B2

(12) United States Patent
Glezerman et al.

(10) Patent No.: US 10,239,067 B2
(45) Date of Patent: Mar. 26, 2019

(54) MULTIPLE ORIENTATION ROTATABLE SPRINKLER

(71) Applicant: NAANDANJAIN IRRIGATION LTD., Kibbutz Naan (IL)

(72) Inventors: Oleg Glezerman, Maalot (IL); Hassan Khateb, Golan Heights (IL); Lior Eliahu Mareli, Rehovot (IL)

(73) Assignee: NAANDANJAIN IRRIGATION LTD., Kibbutz Naan (IL)

( * ) Notice: Subject to any disclaimer, the term of this patent is extended or adjusted under 35 U.S.C. 154(b) by 0 days.

(21) Appl. No.: 16/036,414

(22) Filed: Jul. 16, 2018

(65) Prior Publication Data

US 2019/0022674 A1 Jan. 24, 2019

Related U.S. Application Data

(63) Continuation of application No. 15/453,321, filed on Mar. 8, 2017.

(51) Int. Cl.

| | |
|---|---|
| ***B05B 3/00*** | (2006.01) |
| ***B05B 3/04*** | (2006.01) |
| ***B05B 1/34*** | (2006.01) |

(52) U.S. Cl.

CPC ..... *B05B 3/0409* (2013.01); *B05B 1/34* (2013.01)

(58) Field of Classification Search

CPC ..... Y10S 239/01; Y10S 239/15; B05B 1/32; B05B 1/34; B05B 3/04; B05B 3/0409;

(Continued)

(56) References Cited

U.S. PATENT DOCUMENTS

| | | | |
|---|---|---|---|
| 461,415 | A | 10/1891 | Bonnette |
| 533,367 | A | 1/1895 | McBoyle |

(Continued)

FOREIGN PATENT DOCUMENTS

| | | |
|---|---|---|
| AU | 539957 | 10/1984 |
| AU | 643546 | 2/1992 |

(Continued)

OTHER PUBLICATIONS

An Office Action dated Apr. 20, 2005, which issued during the prosecution of U.S. Appl. No. 10/476,082.

(Continued)

*Primary Examiner* — Viet Le

(74) *Attorney, Agent, or Firm* — Sughrue Mion, PLLC

(57) ABSTRACT

A rotatable sprinkler including a water outlet nozzle providing a pressurized axial stream of water along a nozzle axis, and a rotatable water deflector assembly, downstream of the water outlet nozzle and receiving the pressurized axial stream of water therefrom, the rotatable water deflector assembly being rotated during sprinkler operation by the pressurized axial stream of water about a rotatable water path deflector assembly axis, the rotatable water deflector assembly including a first rotatable water path deflector portion and a second rotatable water path deflector portion, which is user rotatable relative to the first rotatable water path deflector portion about a second rotatable water path deflector axis, thereby enabling user selection of at least one water distribution parameter.

20 Claims, 54 Drawing Sheets

(58) Field of Classification Search
CPC ... B05B 3/0463; B05B 3/0486; B05B 15/065; B05B 15/10
USPC ..... 239/231, 232, 233
See application file for complete search history.

(56) References Cited

U.S. PATENT DOCUMENTS

| | | | | |
|---|---|---|---|---|
| 581,252 | A | | 4/1897 | Quayle |
| 1,577,225 | A | | 3/1926 | Granger |
| 1,590,910 | A | | 6/1926 | William |
| 1,593,918 | A | | 7/1926 | Stanton |
| 1,631,874 | A | | 6/1927 | Lasher et al. |
| 1,637,413 | A | | 8/1927 | Elder |
| 2,025,267 | A | | 12/1935 | Buelna |
| 2,220,275 | A | | 11/1940 | Preston |
| 2,323,701 | A | | 7/1943 | Barksdale |
| 2,345,030 | A | | 3/1944 | Buckner |
| 2,421,551 | A | | 6/1947 | Dunham |
| 2,464,958 | A | | 3/1949 | John |
| 2,475,537 | A | | 7/1949 | Ashworth |
| 2,557,206 | A | | 6/1951 | Spender |
| 2,565,926 | A | | 8/1951 | Manning |
| 2,582,158 | A | | 1/1952 | Porter |
| 2,585,782 | A | | 2/1952 | Johnson |
| 2,610,089 | A | | 9/1952 | Unger |
| 2,625,411 | A | | 1/1953 | Unger |
| 2,654,635 | A | | 10/1953 | Lazzarini |
| 2,694,600 | A | | 11/1954 | Richey |
| 2,716,574 | A | | 8/1955 | Chase |
| 2,726,119 | A | | 12/1955 | Egly et al. |
| 2,780,488 | A | | 2/1957 | Kennedy |
| 2,785,013 | A | | 3/1957 | Stearns |
| 2,816,798 | A | | 12/1957 | Royer |
| 2,835,529 | A | | 5/1958 | Egly et al. |
| 2,853,342 | A | | 9/1958 | Kachergis |
| 2,877,053 | A | | 3/1959 | Kennard |
| 2,895,681 | A | | 7/1959 | Kachergis |
| 2,901,183 | A | | 8/1959 | Kohl |
| 2,904,261 | A | | 9/1959 | Johnson |
| 2,928,608 | A | | 3/1960 | Royer |
| 2,929,597 | A | | 3/1960 | Ruggieri et al. |
| 2,962,220 | A | | 11/1960 | Woods |
| 2,979,271 | A | | 4/1961 | Boyden |
| 2,989,248 | A | | 6/1961 | Norland |
| 2,993,649 | A | | 7/1961 | Holz |
| 3,006,558 | A | | 10/1961 | Jacobs |
| 3,017,123 | A | | 1/1962 | Rinkewich et al. |
| 3,019,992 | A | | 2/1962 | Zecchinato |
| 3,022,012 | A | | 2/1962 | Sharp et al. |
| 3,033,467 | A | | 5/1962 | Hofer |
| 3,033,469 | A | | 5/1962 | Green |
| 3,038,666 | A | | 6/1962 | Dudley et al. |
| 3,080,123 | A | | 3/1963 | Erns |
| 3,082,958 | A | | 3/1963 | Thomas |
| 3,091,399 | A | | 5/1963 | Kennedy |
| 3,117,724 | A | | 1/1964 | Ray |
| 3,131,867 | A | | 5/1964 | Miller et al. |
| RE25,942 | E | | 12/1965 | Reynolds |
| 3,282,508 | A | | 11/1966 | Roberts |
| 3,309,025 | A | | 3/1967 | Malcolm |
| 3,312,400 | A | | 4/1967 | Clearman |
| 3,391,868 | A | | 7/1968 | Cooney |
| 3,434,665 | A | | 3/1969 | Royer |
| 3,448,660 | A | | 6/1969 | Malcolm |
| 3,464,628 | A | | 9/1969 | Chow |
| 3,468,485 | A | | 9/1969 | Sully |
| 3,523,647 | A | | 8/1970 | Radecki |
| 3,532,273 | A | | 10/1970 | Siddall et al. |
| 3,559,887 | A | | 2/1971 | Meyer |
| 3,567,126 | A | * | 3/1971 | Martini ..... B05B 15/70 239/206 |
| 3,580,508 | A | | 5/1971 | Marandi et al. |
| 3,581,994 | A | | 6/1971 | Heiberger |
| 3,583,638 | A | | 6/1971 | Eby et al. |
| 3,606,163 | A | | 9/1971 | Lewis |
| 3,625,429 | A | | 12/1971 | Turrell |
| 3,627,205 | A | | 12/1971 | Healy |
| 3,654,817 | A | | 4/1972 | Kane |
| 3,655,249 | A | | 4/1972 | Abel |
| 3,709,435 | A | | 1/1973 | Sheets |
| 3,726,479 | A | | 4/1973 | Leissner et al. |
| 3,727,842 | A | | 4/1973 | Ertsgaard et al. |
| 3,746,259 | A | | 7/1973 | Apri |
| 3,765,608 | A | | 10/1973 | Lockwood |
| 3,782,638 | A | | 1/1974 | Bumpstead |
| 3,785,565 | A | | 1/1974 | Perry et al. |
| 3,791,585 | A | | 2/1974 | Warren |
| 3,837,576 | A | | 9/1974 | Rosenkranz |
| 3,841,563 | A | | 10/1974 | Lockwood |
| 3,856,207 | A | | 12/1974 | Rees |
| 3,874,588 | A | | 4/1975 | Flynn |
| 3,884,416 | A | | 5/1975 | King |
| 3,917,174 | A | | 11/1975 | Hildebrandt et al. |
| 3,918,642 | A | | 11/1975 | Best |
| 3,918,643 | A | | 11/1975 | Malcolm |
| 3,921,911 | A | | 11/1975 | Sheets |
| 3,921,912 | A | | 11/1975 | Hayes |
| 3,930,617 | A | | 1/1976 | Dunmire |
| 3,930,618 | A | | 1/1976 | Lockwood |
| 3,952,953 | A | | 4/1976 | Eby |
| 3,955,762 | A | | 5/1976 | Cassimatis et al. |
| 3,955,764 | A | | 5/1976 | Phaup |
| 3,957,205 | A | | 5/1976 | Costa |
| 3,958,760 | A | | 5/1976 | Rosenberg |
| 3,968,934 | A | | 7/1976 | Healy |
| 3,977,610 | A | | 8/1976 | Royer |
| 3,981,452 | A | | 9/1976 | Eckstein |
| 3,986,671 | A | | 10/1976 | Nugent |
| 4,000,853 | A | | 1/1977 | Drori |
| 4,009,832 | A | | 3/1977 | Tiedt |
| 4,026,471 | A | | 5/1977 | Hunter |
| 4,033,510 | A | | 7/1977 | Jennison et al. |
| 4,055,304 | A | | 10/1977 | Munson |
| 4,091,996 | A | | 5/1978 | Nelson |
| 4,113,181 | A | | 9/1978 | Sheets |
| 4,123,006 | A | | 10/1978 | Yukishita |
| 4,145,003 | A | | 3/1979 | Harrison et al. |
| 4,161,286 | A | | 7/1979 | Beamer et al. |
| 4,164,324 | A | | 8/1979 | Bruninga |
| 4,166,580 | A | | 9/1979 | Meckel |
| 4,177,944 | A | | 12/1979 | Wichman |
| 4,182,494 | A | | 1/1980 | Wichman et al. |
| 4,198,000 | A | | 4/1980 | Hunter |
| 4,201,344 | A | | 5/1980 | Lichte |
| 4,205,788 | A | | 6/1980 | Bruninga |
| 4,220,283 | A | | 9/1980 | Citron |
| 4,225,084 | A | | 9/1980 | Bals |
| 4,234,125 | A | | 11/1980 | Lieding |
| 4,234,126 | A | | 11/1980 | Morgan |
| 4,253,608 | A | | 3/1981 | Hunter |
| 4,256,262 | A | | 3/1981 | Rosenberg |
| 4,261,515 | A | | 4/1981 | Rosenberg et al. |
| 4,277,029 | A | | 7/1981 | Rabitsch |
| 4,316,579 | A | | 2/1982 | Ray et al. |
| 4,330,087 | A | | 5/1982 | Wood et al. |
| 4,331,294 | A | | 5/1982 | Gilad |
| 4,335,852 | A | | 6/1982 | Chow |
| 4,351,477 | A | | 9/1982 | Choi |
| 4,376,513 | A | | 3/1983 | Hagar |
| 4,379,976 | A | | 4/1983 | Pitchford et al. |
| 4,392,753 | A | | 7/1983 | Abel |
| 4,398,666 | A | | 8/1983 | Hunter |
| 4,402,460 | A | | 9/1983 | Shavit et al. |
| 4,407,455 | A | | 10/1983 | Sargent |
| 4,417,691 | A | | 11/1983 | Lockwood |
| 4,423,838 | A | | 1/1984 | Dinur |
| 4,453,673 | A | | 6/1984 | Icenbice |
| 4,457,470 | A | | 7/1984 | Hauger et al. |
| 4,487,368 | A | | 12/1984 | Clearman |
| 4,497,441 | A | | 2/1985 | Chow |
| 4,498,626 | A | | 2/1985 | Pitchford |
| 4,512,519 | A | | 4/1985 | Uzrad |
| 4,514,291 | A | | 4/1985 | McGarry et al. |
| 4,537,356 | A | | 8/1985 | Lawson |

(56) References Cited

U.S. PATENT DOCUMENTS 4,540,125 A 9/1985 Gorney et al.
4,560,108 A 12/1985 Rubinstein
4,565,323 A 1/1986 Berkan
4,580,724 A 4/1986 Brown et al.
4,583,689 A 4/1986 Rosenberg
4,615,531 A 10/1986 Green
4,624,412 A 11/1986 Hunter
4,625,913 A 12/1986 Christen
4,625,914 A 12/1986 Sexton et al.
4,627,549 A 12/1986 Dudding
4,632,312 A 12/1986 Premo et al.
4,637,548 A 1/1987 Ray et al.
4,637,549 A 1/1987 Schwartzman
4,660,766 A 4/1987 Nelson et al.
4,669,663 A 6/1987 Meyer
4,681,260 A 7/1987 Cochran
4,702,280 A 10/1987 Zakai et al.
4,722,670 A 2/1988 Zweifel
4,739,934 A * 4/1988 Gewelber ..... A62C 37/10 239/444
4,754,925 A 7/1988 Rubinstein
4,760,959 A 8/1988 Gorney
4,763,838 A 8/1988 Holcomb
4,773,595 A 9/1988 Livne
4,776,517 A 10/1988 Heren
4,783,005 A 11/1988 Rosenberg
4,784,325 A 11/1988 Walker et al.
4,796,804 A 1/1989 Weiss
4,796,810 A 1/1989 Zakai
4,817,869 A 4/1989 Rubinstein
4,824,020 A 4/1989 Harward
4,834,290 A 5/1989 Bailey
4,836,449 A 6/1989 Hunter
4,836,450 A 6/1989 Hunter
4,858,829 A 8/1989 Drechsel
4,884,749 A 12/1989 Ruprechter
4,892,252 A 1/1990 Bruninga
4,907,742 A 3/1990 Whitehead et al.
4,919,332 A 4/1990 Bailey
4,925,098 A 5/1990 Di Paola
4,927,082 A 5/1990 Greenberg et al.
4,944,456 A 7/1990 Zakai
4,966,328 A 10/1990 Neeman
4,971,256 A 11/1990 Malcolm
4,972,993 A 11/1990 Van Leeuwen
4,978,070 A 12/1990 Chow
4,984,740 A 1/1991 Hodge
5,031,833 A 7/1991 Alkalay et al.
5,031,835 A * 7/1991 Rojas ..... B05B 3/0481 239/230
5,048,757 A 9/1991 Van Leeuwen
5,052,620 A 10/1991 Rinkewich
5,058,806 A * 10/1991 Rupar ..... B05B 3/005 239/205
5,083,709 A * 1/1992 Iwanowski ..... B05B 1/14 239/551
RE33,823 E * 2/1992 Nelson ..... B05B 3/0486 239/222.17
5,115,977 A 5/1992 Alkalay et al.
5,172,864 A 12/1992 Spencer
5,192,024 A 3/1993 Blee
5,209,404 A 5/1993 Jun
5,236,126 A 8/1993 Sawade et al.
5,238,188 A 8/1993 Lerner et al.
5,240,182 A * 8/1993 Lemme ..... B05B 15/70 239/205
5,253,807 A * 10/1993 Newbegin ..... A01G 25/023 239/11
5,267,689 A 12/1993 Forer
5,322,223 A * 6/1994 Hadar ..... B05B 1/32 239/457
5,370,311 A 12/1994 Chen
5,372,307 A * 12/1994 Sesser ..... B05B 3/005 239/210
5,544,814 A * 8/1996 Spenser ..... B05B 3/0486 239/222.11
5,597,119 A 1/1997 Gorney et al.
5,641,122 A 6/1997 Alkalai et al.
5,642,861 A * 7/1997 Ogi ..... B05B 1/14 239/568
5,647,541 A 7/1997 Nelson
5,671,886 A 9/1997 Sesser
D388,502 S * 12/1997 Kah, III ..... D23/214
5,738,446 A 4/1998 Ghosh et al.
5,762,269 A 6/1998 Sweet
5,765,945 A 6/1998 Palmer
5,769,544 A 6/1998 Suzuki et al.
5,826,797 A * 10/1998 Kah, III ..... B05B 1/1645 239/344
5,836,516 A 11/1998 Van Epps et al.
5,950,927 A 9/1999 Elliot et al.
5,971,297 A * 10/1999 Sesser ..... B05B 3/005 239/214
6,000,634 A 12/1999 Mehoudar
6,016,972 A 1/2000 Kantor et al.
6,019,295 A * 2/2000 McKenzie ..... B05B 1/1645 239/451
6,085,995 A * 7/2000 Kah, Jr. ..... B05B 1/1645 239/237
6,145,758 A * 11/2000 Ogi ..... B05B 1/262 239/457
6,158,675 A * 12/2000 Ogi ..... B05B 1/046 239/396
6,186,413 B1 2/2001 Lawson
6,237,862 B1 * 5/2001 Kah, III ..... B05B 1/1645 239/391
6,260,770 B1 7/2001 Epstein et al.
6,264,117 B1 * 7/2001 Roman ..... B05B 1/262 239/203
6,322,027 B1 11/2001 Hsu
6,340,059 B1 1/2002 Bethea
6,435,427 B1 * 8/2002 Conroy ..... B05B 1/1654 239/392
6,439,476 B1 8/2002 Boggs
6,457,656 B1 10/2002 Scott
6,698,629 B2 3/2004 Taylor-McCune
6,834,816 B2 * 12/2004 Kah, Jr. ..... B05B 1/262 239/451
7,014,125 B2 * 3/2006 Lerner ..... B05B 3/021 239/222.11
7,044,403 B2 * 5/2006 Kah, III ..... B05B 1/1645 239/391
7,111,796 B2 9/2006 Olson
7,255,291 B1 * 8/2007 Lo ..... B05B 1/267 239/231
7,287,710 B1 10/2007 Nelson et al.
7,458,527 B2 * 12/2008 Lutzki ..... B05B 3/005 239/230
7,562,833 B2 7/2009 Perkins et al.
7,614,705 B2 * 11/2009 Southern ..... B05B 1/202 299/12
7,703,706 B2 * 4/2010 Walker ..... B05B 1/14 239/501
7,841,545 B2 11/2010 Wang
8,083,158 B2 12/2011 Katzman et al.
8,177,148 B1 * 5/2012 Renquist ..... B05B 1/14 239/587.1
8,366,024 B2 * 2/2013 Leber ..... B05B 3/04 239/381
8,533,874 B1 * 9/2013 Goettl ..... E04H 4/169 134/167 R
8,672,236 B2 3/2014 Gal et al.
8,820,664 B2 * 9/2014 Sawalski ..... B67D 7/00 239/548
8,899,497 B2 12/2014 Gorny
8,910,888 B2 * 12/2014 Sesser ..... B05B 1/1663 239/395
8,998,109 B2 4/2015 Katzman et al.
9,010,660 B2 * 4/2015 Sesser ..... A01G 25/16 239/106
9,079,202 B2 * 7/2015 Walker ..... B05B 3/0486

(56) References Cited

U.S. PATENT DOCUMENTS

| | | | | |
|---|---|---|---|---|
| 9,205,435 | B1 * | 12/2015 | Clark | A01G 25/00 |
| 9,266,124 | B2 * | 2/2016 | Humpal | B05B 1/14 |
| 9,387,494 | B2 * | 7/2016 | Sesser | B05B 1/1636 |
| 9,427,751 | B2 * | 8/2016 | Kim | B05B 1/267 |
| 9,504,209 | B2 * | 11/2016 | Kim | A01G 25/00 |
| 9,534,619 | B2 * | 1/2017 | Sesser | B05B 1/326 |
| 9,623,425 | B2 * | 4/2017 | Luettgen | B05B 1/1636 |
| 9,682,386 | B2 | 6/2017 | Mareli et al. | |
| 9,700,904 | B2 * | 7/2017 | Kim | B05B 3/005 |
| 9,775,306 | B2 * | 10/2017 | Lo | A01G 25/00 |
| 9,776,195 | B2 * | 10/2017 | Russell | B05B 1/08 |
| 2002/0153432 | A1 | 10/2002 | McKenzie et al. | |
| 2003/0129043 | A1 | 7/2003 | Clare et al. | |
| 2004/0164177 | A1 | 8/2004 | Lerner | |
| 2004/0232701 | A1 | 11/2004 | DeFrank | |
| 2006/0065759 | A1 | 3/2006 | Olson | |
| 2006/0091232 | A1 | 5/2006 | Grant | |
| 2007/0009535 | A1 | 1/2007 | Sikic et al. | |
| 2007/0095935 | A1 | 5/2007 | Katzman et al. | |
| 2007/0246560 | A1 | 10/2007 | Townsend | |
| 2008/0017732 | A1 | 1/2008 | Perkins et al. | |
| 2008/0277498 | A1 | 11/2008 | Townsend | |
| 2009/0188991 | A1 * | 7/2009 | Russell | B05B 15/70 239/203 |
| 2010/0065656 | A1 | 3/2010 | Grant | |
| 2011/0114755 | A1 | 5/2011 | Katzman et al. | |
| 2011/0132997 | A1 | 6/2011 | Gal et al. | |
| 2012/0153096 | A1 | 6/2012 | Shaol et al. | |
| 2012/0318888 | A1 | 12/2012 | Gandin | |
| 2012/0318889 | A1 | 12/2012 | Gorny | |
| 2016/0016184 | A1 | 1/2016 | Mareli et al. | |
| 2018/0257093 | A1 | 9/2018 | Glezerman et al. | |

FOREIGN PATENT DOCUMENTS

| | | |
|---|---|---|
| CH | 260244 | 3/1949 |
| CN | 2584883 | 11/2003 |
| CN | 201586580 | 9/2010 |
| DE | 3528121 | 2/1987 |
| EP | 0092503 | 10/1983 |
| EP | 0470812 | 2/1992 |
| GB | 642632 | 9/1950 |
| GB | 846181 | 8/1960 |
| GB | 1389971 | 4/1975 |
| GB | 2508865 | 9/1976 |
| GB | 1463276 | 2/1977 |
| GB | 1479409 | 7/1977 |
| GB | 1489001 | 10/1977 |
| GB | 1509564 | 5/1978 |
| GB | 2006050 | 5/1979 |
| GB | 2043417 | 10/1980 |
| GB | 1578242 | 11/1980 |
| GB | 2051533 | 1/1981 |
| GB | 2138705 | 10/1984 |
| GB | 2150862 | 7/1985 |
| IL | 2772 | 9/1944 |
| IL | 3346 | 2/1946 |
| IL | 7148 | 1/1953 |
| IL | 20118 | 6/1966 |
| IL | 43357 | 8/1975 |
| IL | 59536 | 9/1982 |
| IL | 80102 | 2/1994 |
| IL | 63341 | 9/1996 |
| IL | 104660 | 9/1999 |
| WO | 95/31288 | 11/1995 |
| WO | 02/085529 | 10/2002 |
| WO | 2004/012869 | 2/2004 |
| WO | 2005/011359 | 2/2005 |
| WO | 2007/109298 | 9/2007 |
| WO | 2010/001392 | 1/2010 |
| WO | 2010/013243 | 2/2010 |
| WO | 2010/016053 | 2/2010 |
| WO | 2012/176185 | 12/2012 |
| WO | 2012/176186 | 12/2012 |
| WO | 2016/132365 | 8/2016 |

OTHER PUBLICATIONS

An Office Action dated May 10, 2013, which issued during the prosecution of U.S. Appl. No. 12/836,328.
An Office Action dated Nov. 21, 2013, which issued during the prosecution of U.S. Appl. No. 12/836,328.
An Office Action dated Apr. 10, 2014, which issued during the prosecution of U.S. Appl. No. 13/476,434.
Notice of Allowance dated Oct. 21, 2005, which issued during the prosecution of U.S. Appl. No. 10/476,082.
Notice of Allowance dated Feb. 27, 2017, which issued during the prosecution of U.S. Appl. No. 14/334,887.
An Office Action dated Mar. 11, 2016, which issued during the prosecution of U.S. Appl. No. 14/334,887.
An Office Action dated Oct. 5, 2015, which issued during the prosecution of U.S. Appl. No. 14/334,887.
An Office Action dated Sep. 28, 2016, which issued during the prosecution of U.S. Appl. No. 14/334,887.
European Search Report dated Dec. 15, 2015, which issued during the prosecution of Applicant's European App. No. 15173813.5.
An Office Action dated Jun. 24, 2010, which issued during the prosecution of U.S. Appl. No. 11/589,869.
Notice of Allowance dated Dec. 5, 2014, which issued during the prosecution of U.S. Appl. No. 13/001,832.
An Office Action dated Nov. 30, 2009, which issued during the prosecution of U.S. Appl. No. 11/589,869.
An Office Action dated Apr. 11, 2014, which issued during the prosecution of U.S. Appl. No. 13/476,624.
An Office Action dated Aug. 3, 2009, which issued during the prosecution of U.S. Appl. No. 11/589,869.
An Office Action dated Jun. 3, 2014, which issued during the prosecution of U.S. Appl. No. 13/001,832.
Notice of Allowance dated Aug. 25, 2011, which issued during the prosecution of U.S. Appl. No. 11/589,869.
Notice of Allowance dated Sep. 26, 2014, which issued during the prosecution of U.S. Appl. No. 13/476,624.
U.S. Appl. No. 61/498,715, filed Jun. 20, 2011.
An Office Action dated Jun. 30, 2016, which issued during the prosecution of Australian Patent Application No. 2012274924.
Notice of Allowance dated Feb. 8, 2017, which issued during the prosecution of Australian Patent Application No. 2012274924.
An Office Action dated Sep. 8, 2016, which issued during the prosecution of Australian Patent Application No. 2012274924.
An International Search Report and a Written Opinion both dated Sep. 5, 2012, which issued during the prosecution of Applicant's PCT/IL2012/000199.
An International Search Report and a Written Opinion both dated Aug. 31, 2012, which issued during the prosecution of Applicant's PCT/IL2012/000198.
An International Search Report dated Aug. 22, 2002, which issued during the prosecution of Applicant's PCT/IL02/00320.
An International Search Report dated Dec. 5, 2003, which issued during the proesecution of Applicant's PTC/IL03/00648.
U.S. Appl. No. 61/129,471, filed Jun. 30, 2008.
U.S. Appl. No. 61/193,803, filed Dec. 24, 2008.
An International Search Report and a Written Opinion both dated Nov. 26, 2009, which issued during the prosecution of Applicant's PCT/IL2009/000653.
Supplementary European Search Report dated Mar. 15, 2006, which issued during the prosecution of Applicant's European App No. 02764095.2.
European Search Report dated Mar. 2, 2015, which issued during the prosecution of Applicant's European App No. 12803418.
European Search Report dated Feb. 12, 2015, which issued during the prosecution of Applicant's European App No. 12802914.7.
A Written Opinion dated Dec. 28, 2009, which issued during the prosecution of Applicant's PCT/IL2009/000733.
U.S. Appl. No. 61/129,972, filed Aug. 4, 2008.

(56) References Cited

OTHER PUBLICATIONS

An International Search Report dated Dec. 28, 2009, which issued during the prosecution of Applicant's PCT/IL2009/000733.
269"Models AR3/AR3-LA Impact Sprinklers," Irritrol Systems, 4.11, one (1) page.
An International Preliminary Report on Patentability dated Dec. 23, 2013, which issued during the prosecution of Applicant's PCT/IL2012/000199.
An International Preliminary Report on Patentability dated Dec. 23, 2013, which issued during the prosecution of Applicant's PCT/IL2012/000198.
An Office Action dated Jul. 31, 2015, which issued during the prosecution of Chinese Patent Application No. 201280030684.9.
An International Preliminary Examination Report dated Feb. 24, 2003, which issued during the prosecution of Applicant's PCT/IL02/00320.
An International Search Report and a Written Opinion both dated Jun. 7, 2016, which issued during the prosecution of Applicant's PCT/IL2016/050193.
Notice of Allowance dated Sep. 14, 2018, which issued during the prosecution of U.S. Appl. No. 15/453,321.
An Office Action dated Oct. 4, 2016, which issued during the prosecution of Indian Patent Application No. 2789/MUMNP/2010.
An Office Action dated Mar. 1, 2018, which issued during the prosecution of U.S. Appl. No. 15/453,321.

* cited by examiner

MULTIPLE ORIENTATION ROTATABLE SPRINKLER

REFERENCE TO RELATED APPLICATIONS

The present application is a continuation application of U.S. patent application Ser. No. 15/453,321, filed Mar. 8, 2017, entitled MULTIPLE ORIENTATION ROTATABLE SPRINKLER, the disclosure of which is hereby incorporated by reference.

FIELD OF THE INVENTION

The present invention relates to sprinklers.

BACKGROUND OF THE INVENTION

Various types of sprinklers are known in the art.

SUMMARY OF THE INVENTION

The present invention seeks to provide an improved sprinkler. There is thus provided in accordance with a preferred embodiment of the present invention a rotatable sprinkler including a water outlet nozzle providing a pressurized axial stream of water along a nozzle axis, and a rotatable water deflector assembly, downstream of the water outlet nozzle and receiving the pressurized axial stream of water therefrom, the rotatable water deflector assembly being rotated during sprinkler operation by the pressurized axial stream of water about a rotatable water path deflector assembly axis, the rotatable water deflector assembly including a first rotatable water path deflector portion and a second rotatable water path deflector portion, which is user rotatable relative to the first rotatable water path deflector portion about a second rotatable water path deflector axis, thereby enabling user selection of at least one water distribution parameter.

In accordance with a preferred embodiment of the present invention the rotatable water path deflector assembly axis and the second rotatable water path deflector axis are coaxial. Alternatively, the nozzle axis, the rotatable water path deflector assembly axis and the second rotatable water path deflector axis are all coaxial.

Preferably, the rotatable sprinkler also includes a base portion, which includes a water inlet connector, and a nozzle defining portion which defines the water outlet nozzle. Additionally, the rotatable sprinkler also includes a flow control membrane arranged upstream of the nozzle defining portion. Additionally or alternatively, the rotatable sprinkler also includes a body portion, which retains the nozzle defining portion, and a top portion, mounted onto the body portion, at least one of the nozzle defining portion and the top portion defining a low friction and low wear rotational mounting for the rotatable water deflector assembly, which receives the pressurized axial stream of water from the nozzle-defining portion.

In accordance with a preferred embodiment of the present invention the first rotatable water path deflector portion includes a bottom, generally cylindrical portion, an upper axle-defining portion and a generally planar portion arranged between the generally cylindrical portion and the axle-defining portion.

In accordance with a preferred embodiment of the present invention the bottom, generally cylindrical portion defines a first water pathway having mutually spaced planar side surfaces and a first water path deflector surface, which includes an initial generally vertical planar surface portion, which extends vertically to a curved surface portion, the curved surface portion extending vertically and radially outwardly to an upwardly and radially outwardly planar surface portion and a generally circular cylindrical portion extending from a location vertically spaced from the planar surface portion to a surface of the generally planar portion. Additionally or alternatively, the planar portion is formed with a plurality of radially-extending protrusions and a pointer.

Preferably, the radially-extending protrusions are each formed on a top surface thereof with a pair of engagement protrusions for user-changeable, selectable azimuth engagement of the second rotatable water path deflector portions. Additionally, the engagement protrusions limit the counter-clockwise travel of the second rotatable water path deflector portions relative to the first rotatable water path deflector portion at each of a plurality of user selectable azimuthal relative orientations thereof.

In accordance with a preferred embodiment of the present invention the second rotatable water path deflector portion includes a generally planar portion, defining a generally flat top surface and a generally flat bottom surface, and a plurality of depending portions, extending downwardly from the generally flat bottom surface, the generally planar portion being formed with a central aperture, centered about the second rotatable water path deflector axis. Additionally, the second rotatable water path deflector portion also includes a plurality of retaining protrusions, extending upwardly from the generally flat top surface and being operative for rotatably displaceable engagement with the first rotatable water path deflector portion.

Preferably, the generally planar portion includes a radially outwardly extending portion having a downwardly depending portion, which defines a curved inner surface, which defines a secondary azimuthal water deflection and reaction surface. Additionally, the secondary azimuthal water deflection and reaction surface is slightly curved and is arranged to be tangent to an imaginary circle about the second rotatable water path deflector axis only along a small portion of the extent of the secondary azimuthal water deflection and reaction surface.

In accordance with a preferred embodiment of the present invention the second rotatable water path deflector portion defines a plurality of user-selectable pressurized water flow pathways.

Preferably, the second rotatable water path deflector portion includes a generally planar portion and the plurality of user-selectable pressurized water flow pathways include at least two of a first user-selectable pressurized water flow pathway defined by a first reaction surface and at least one additional pathway surface, wherein the first reaction surface defines an angle $\alpha 1$ in an X-Y plane, parallel to the generally planar portion, with respect to an X axis thereof, such that pressurized water engages a curved inner surface, which defines a downstream azimuthal water deflection and reaction surface and defines an angle $\alpha 1'$ in the X-Y plane with respect to a line parallel to a Y axis of the X-Y plane, a second user-selectable pressurized water flow pathway defined by a second reaction surface and at least one additional pathway surface, wherein the second reaction surface defines an angle $\alpha 2$ in the X-Y plane, different from the angle $\alpha 1$, with respect to the Y axis, a third user-selectable pressurized water flow pathway defined by a third reaction surface and at least one additional pathway surface, wherein the third reaction surface defines an angle $\alpha 3$ in the X-Y plane, different from the angle $\alpha 1$ and the angle $\alpha 2$, with respect to the X axis and a fourth user-selectable pressurized water flow pathway defined by a fourth reaction surface and at least one additional pathway surface, wherein the fourth reaction surface defines an angle $\alpha 4$, different from the angle $\alpha 1$, the angle $\alpha 2$ and the angle $\alpha 3$, with respect to the Y axis.

Preferably, at least one of the first, second, third and fourth user-selectable pressurized water flow pathways also defines an elevation limiting surface. Additionally, at least one of the first, second, third and fourth user-selectable pressurized water flow pathways also defines an elevation limiting surface in which the first user-selectable pressurized water flow pathway is also defined by a first planar elevation limiting surface, which defines an angle $\beta 1$, in an X-Z plane, perpendicular to the X-Y plane, with respect to a plane parallel to a Y-Z plane, perpendicular to the X-Y plane and to the X-Z plane, and a downstream azimuthal water deflection and reaction surface, which defines an angle $\beta 1'$ with respect to a plane parallel to the Y-Z plane in a plane parallel to the X-Z plane, the second user-selectable pressurized water flow pathway is also defined by a second planar elevation limiting surface, which defines an angle $\beta 2$, different from the angle $\beta 1$, with respect to a plane parallel to the X-Y plane in a plane parallel to the Y-Z plane, the third user-selectable pressurized water flow pathway is also defined by a third planar elevation limiting surface, which defines an angle $\beta 3$, different from the angle $\beta 2$ and the angle $\beta 1$, with respect to a plane parallel to the X-Y plane in a plane parallel to the X-Z plane and the fourth user-selectable pressurized water flow pathway is also defined by a fourth planar elevation limiting surface, which defines an angle $\beta 4$, different from the angle $\beta 3$, the angle $\beta 2$ and the angle $\beta 1$, with respect to a plane parallel to the X-Y plane in a plane parallel to the Y-Z plane.

In accordance with a preferred embodiment of the present invention the second rotatable water path deflector portion includes a generally planar portion defining an X-Y plane parallel thereto and an X-Z plane and a Y-Z plane perpendicular thereto and the sprinkler has at least two of first, second, third and fourth operative orientations in which in the first operative orientation a pointer is directed to a first azimuthal location on the second rotatable water path deflector portion, indicated by a first indicium, and a pressurized water stream extends upwardly and radially outwardly into engagement with a first reaction surface, which defines an angle $\alpha 1$ in the X-Y plane, with respect to an X axis thereof, a first planar elevation limiting surface, which defines an angle $\beta 1$ in a plane parallel to the X-Z plane, with respect to a plane parallel to the X-Y plane and a curved downstream azimuthal water deflection and reaction surface, which defines a water stream exit angle $\alpha 1'$, different from the angle $\alpha 1$, in the X-Y plane, with respect to a line parallel to a Y axis, and a water stream exit angle $\beta 1'$ in a plane parallel to the X-Z plane, with respect to a plane parallel to the Y-Z plane, in the second operative orientation a pointer is directed to a second azimuthal location on the second rotatable water path deflector portion, indicated by a second indicium, and a pressurized water stream extends upwardly and radially outwardly into engagement with a second reaction surface, which defines an angle $\alpha 2$, different from the angle $\alpha 1$, in the X-Y plane, with respect to the Y axis and a second planar elevation limiting surface, which defines an angle $\beta 2$, different from the angle $\beta 1$, in a plane parallel to the Y-Z plane, with respect to a plane parallel to the X-Y plane, in the third operative orientation a pointer is directed to a third azimuthal location on the second rotatable water path deflector portion, indicated by a third indicium, and a pressurized water stream extends upwardly and radially outwardly into engagement with a third reaction surface, which defines an angle $\alpha 3$, different from the angle $\alpha 1$ and the angle $\alpha 2$, in the X-Y plane, with respect to the X axis and a third planar elevation limiting surface, which defines an angle $\beta 3$, different from the angle $\beta 1$ and the angle $\beta 2$, in a plane parallel to the X-Z plane, with respect to a plane parallel to the X-Y plane and in the fourth operative orientation a pointer is directed to an azimuthal location on the second rotatable water path deflector portion indicated by a fourth indicium and a pressurized water stream extends upwardly and radially outwardly into engagement with a fourth reaction surface, which defines an angle $\alpha 4$, different from the angle $\alpha 1$, the angle $\alpha 2$ and the angle $\alpha 3$, in the X-Y plane, with respect to the Y axis and a fourth planar elevation limiting surface, which defines an angle $\beta 4$, different from the angle $\beta 1$, the angle $\beta 2$ and the angle $\beta 3$, in a plane parallel to the Y-Z plane, with respect to a plane parallel to the X-Y plane.

BRIEF DESCRIPTION OF THE DRAWINGS

The present invention will be understood more fully from the following detailed description, taken in conjunction with the drawings in which.

DETAILED DESCRIPTION OF PREFERRED EMBODIMENTS

Figure 1A:
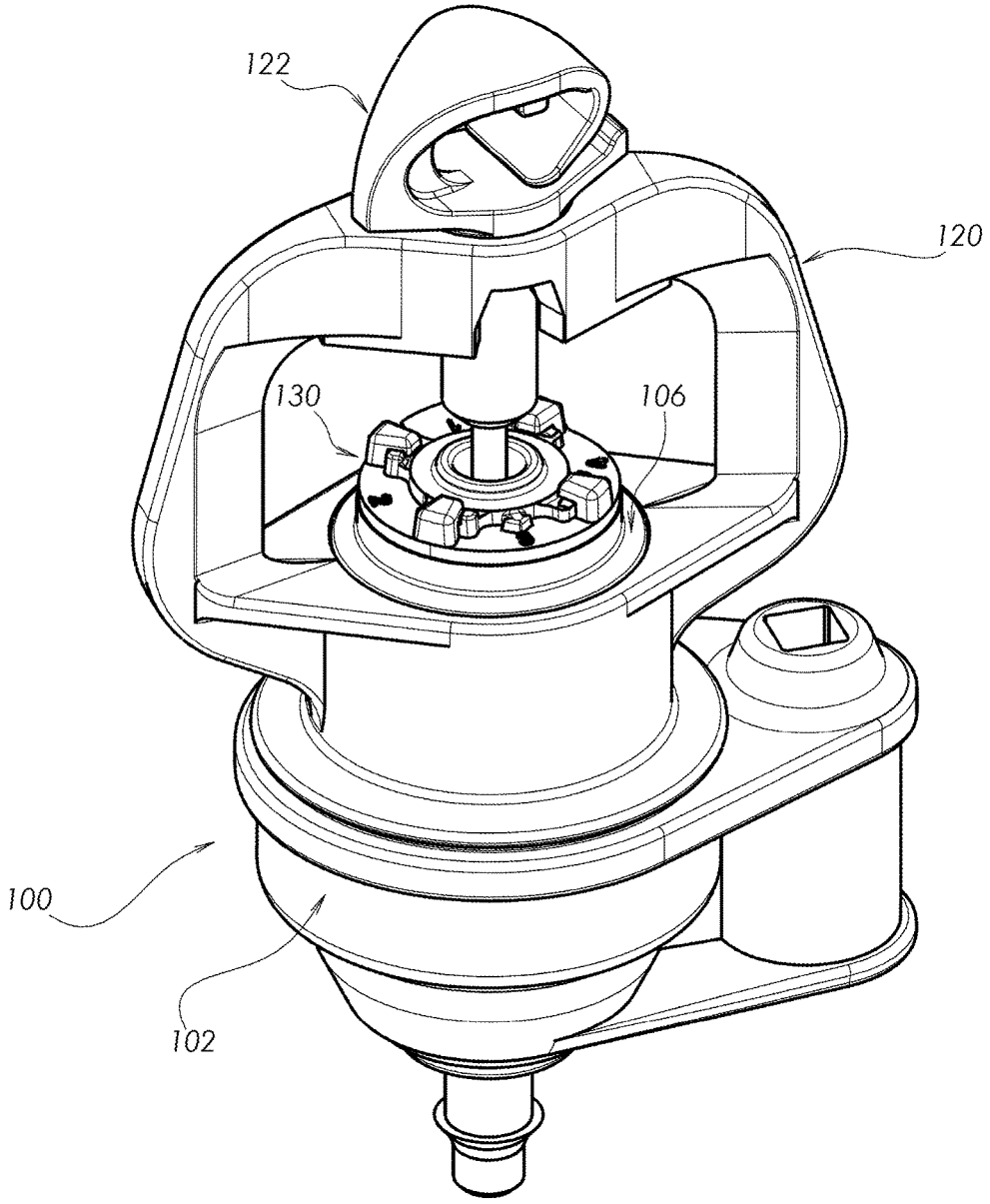
FIGS. 1A and 1B are, respectively, simplified pictorial assembled and exploded view illustrations of a sprinkler constructed and operative in accordance with a preferred embodiment of the present invention in an unpressurized operative orientation.
Figure 1B:
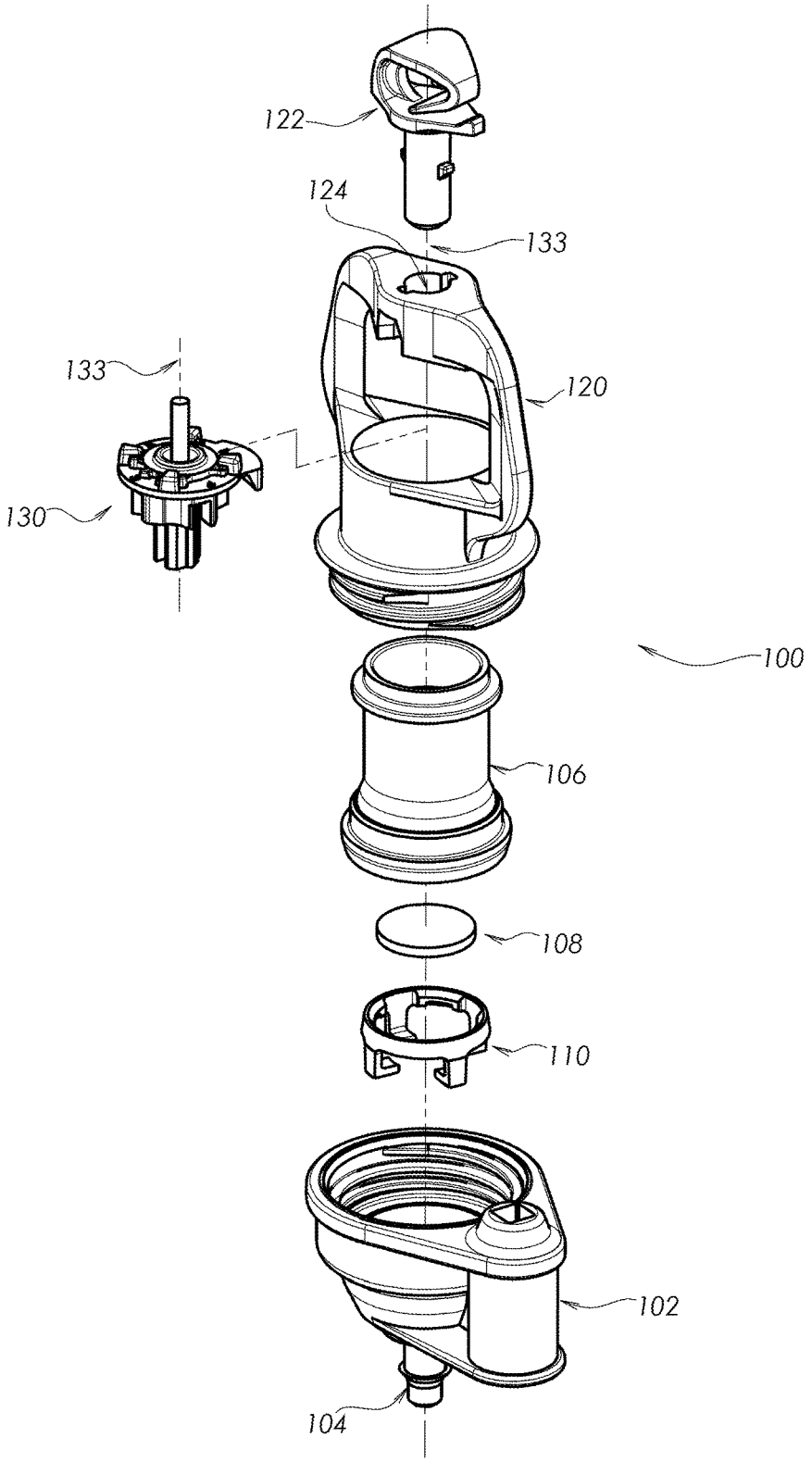

Reference is now made to FIGS. 1A and 1B, which are, respectively, simplified pictorial assembled and exploded view illustrations of a sprinkler constructed and operative in accordance with a preferred embodiment of the present invention in an unpressurized operative orientation. As seen in FIGS. 1A & 1B, there is provided a sprinkler 100 including a base portion 102, formed with a water inlet connector 104, and a nozzle defining portion 106, supported on base portion 102. Optionally, disposed interiorly of base portion 102 and below nozzle-defining portion 106 is a flow control membrane 108 and a membrane-retaining ring 110.

A body portion 120 is threadably attached to base portion 102 and retains nozzle defining portion 106, as well as optional flow control membrane 108 and membrane-supporting ring 110, within base portion 102. A top portion 122 is preferably bayonet mounted onto a top central aperture 124 of body portion 120. Preferably, nozzle-defining portion 106 and top portion 122 define respective bottom and top low friction and low wear rotational mounting for a rotatable water deflector assembly 130, which receives a pressurized axial stream of water from nozzle-defining portion 106. Alternatively, the low friction and low wear rotational mounting for rotatable water deflector assembly 130 is provided by one, but not both, of nozzle-defining portion 106 and top portion 122. All of the above-described elements with the exception of rotatable water deflector assembly 130, are known and commercially available in an existing sprinkler, Sprinkler Model No. 2002, commercially available from NaanDanJain Irrigation Ltd. of Kibbutz Naan, Israel.

It is appreciated that terms such as "top", "bottom", "upper" and "lower" refer to relative locations in the sense of FIGS. 1A and 1B and do not necessarily refer to relative locations on a sprinkler in use.

Rotatable water deflector assembly 130 is preferably arranged for rotation about an axis 133, which is preferably selected to be vertical and in the orientation shown in FIGS. 1A-3B. It is appreciated that the entire sprinkler may be operated up-side down with respect to the orientation shown in FIGS. 1A-3B, preferably with a differently designed deflector assembly 130 and a deflector assembly 130 retaining spring (not shown) for retaining the rotatable water deflector assembly 130 in its orientation as shown in FIGS. 2A and 2B even when the sprinkler is not receiving a pressurized flow of water.

Figure 2A:
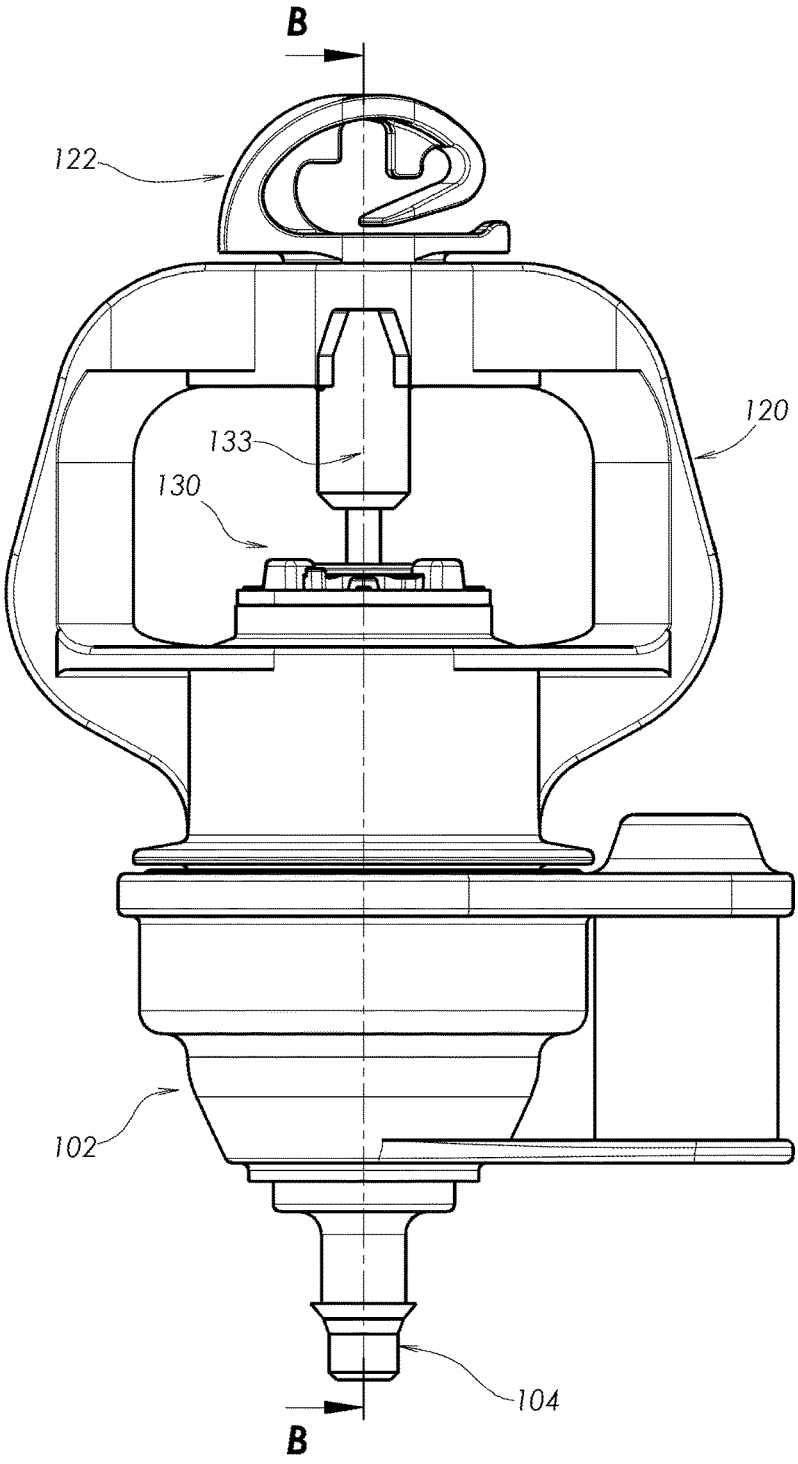
FIGS. 2A and 2B are, respectively, a simplified side view illustration and a simplified sectional illustration, taken along lines B-B in FIG. 2A, of the sprinkler of FIGS. 1A & 1B in an unpressurized operative orientation.
Figure 2B:
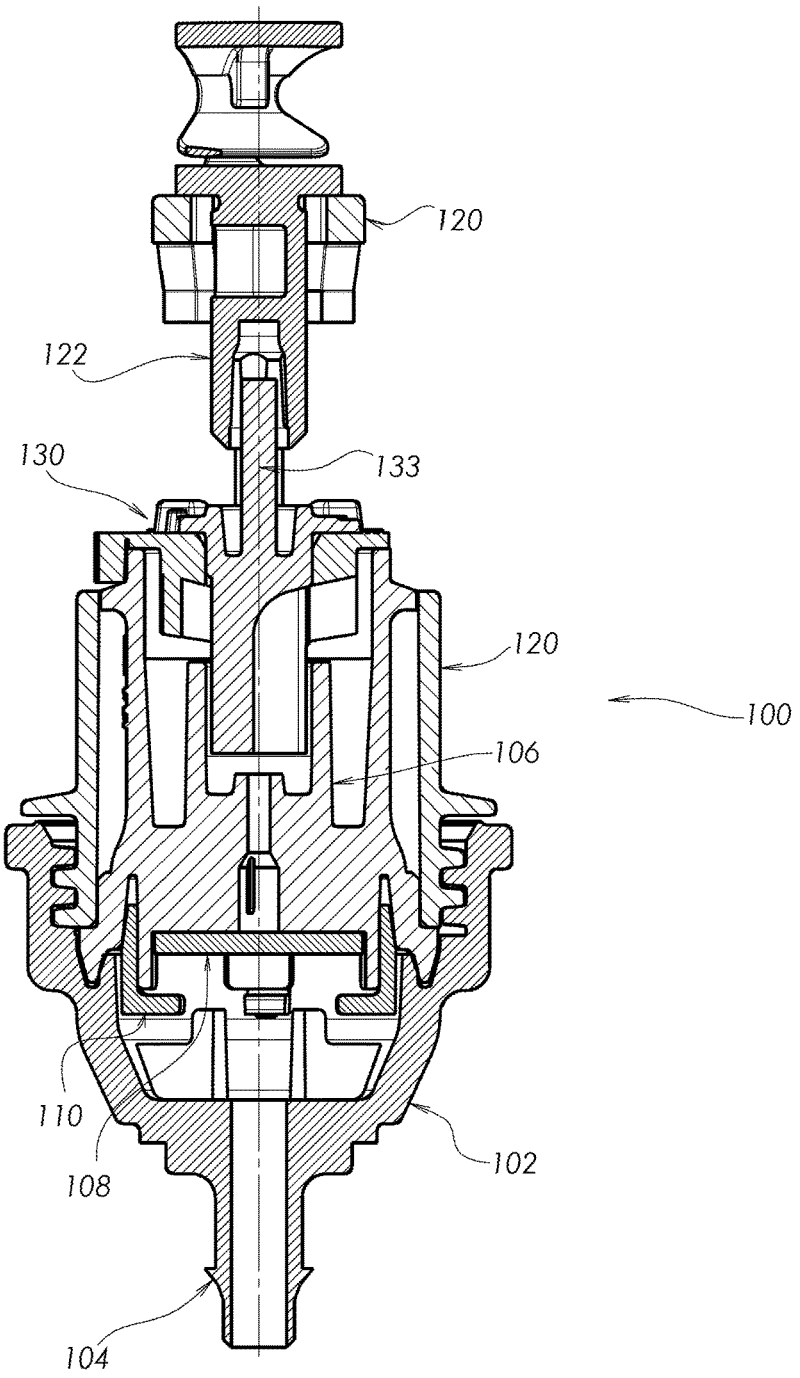

Reference is now made to FIGS. 2A and 2B, which are, respectively, a simplified side view illustration and a simplified sectional illustration, taken along lines B-B in FIG. 2A, of the sprinkler of FIGS. 1A & 1B in an unpressurized operative orientation. It is seen that the rotatable water deflector assembly 130 is in a relatively lowered orientation relative to body portion 120 and nozzle-defining portion 106.

Figure 3A:
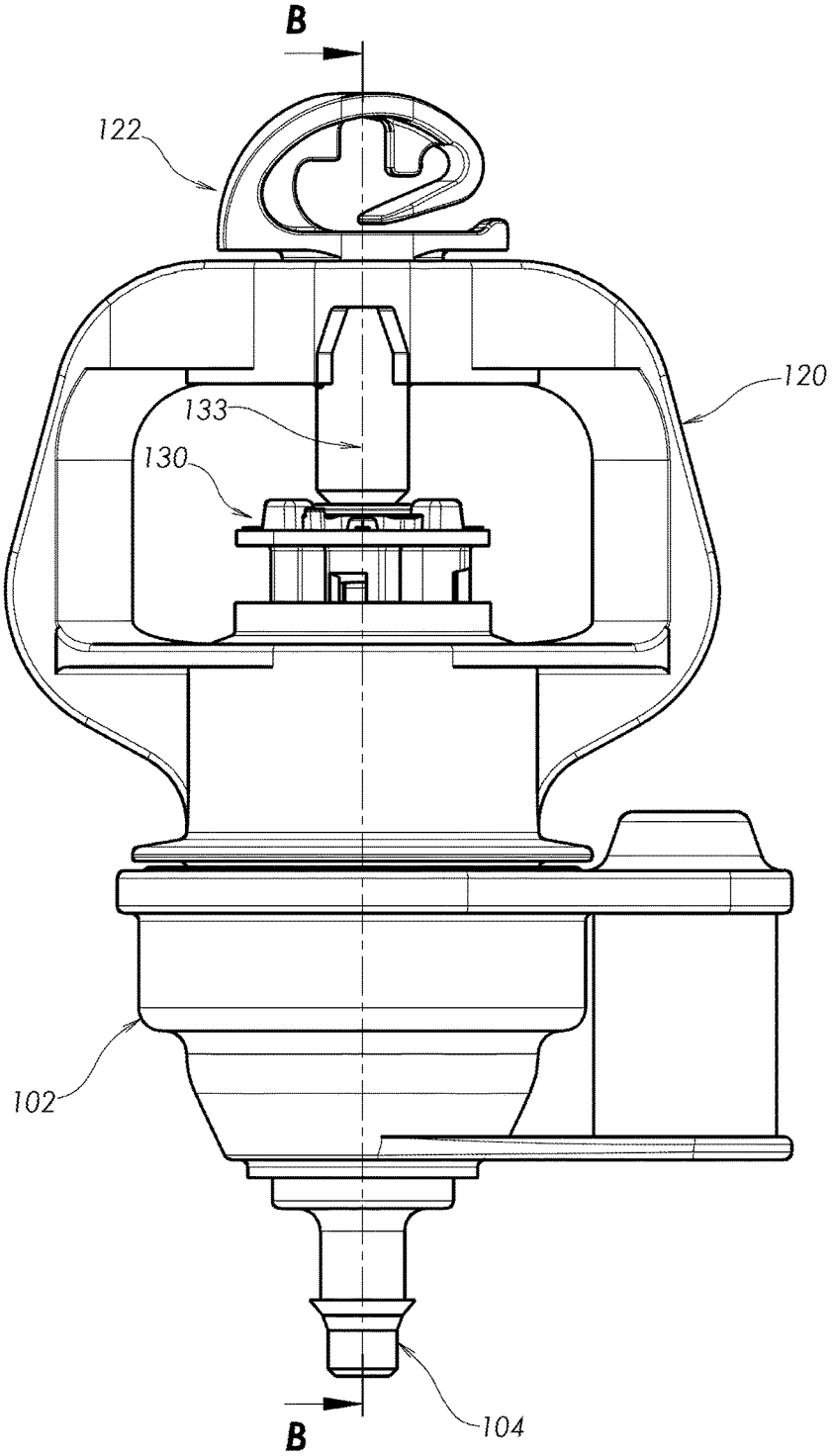
FIGS. 3A and 3B are, respectively, a simplified side view illustration and a simplified sectional illustration, taken along lines B-B in FIG. 3A, of the sprinkler of FIGS. 1A-2B in a pressurized operative orientation.
Figure 3B:
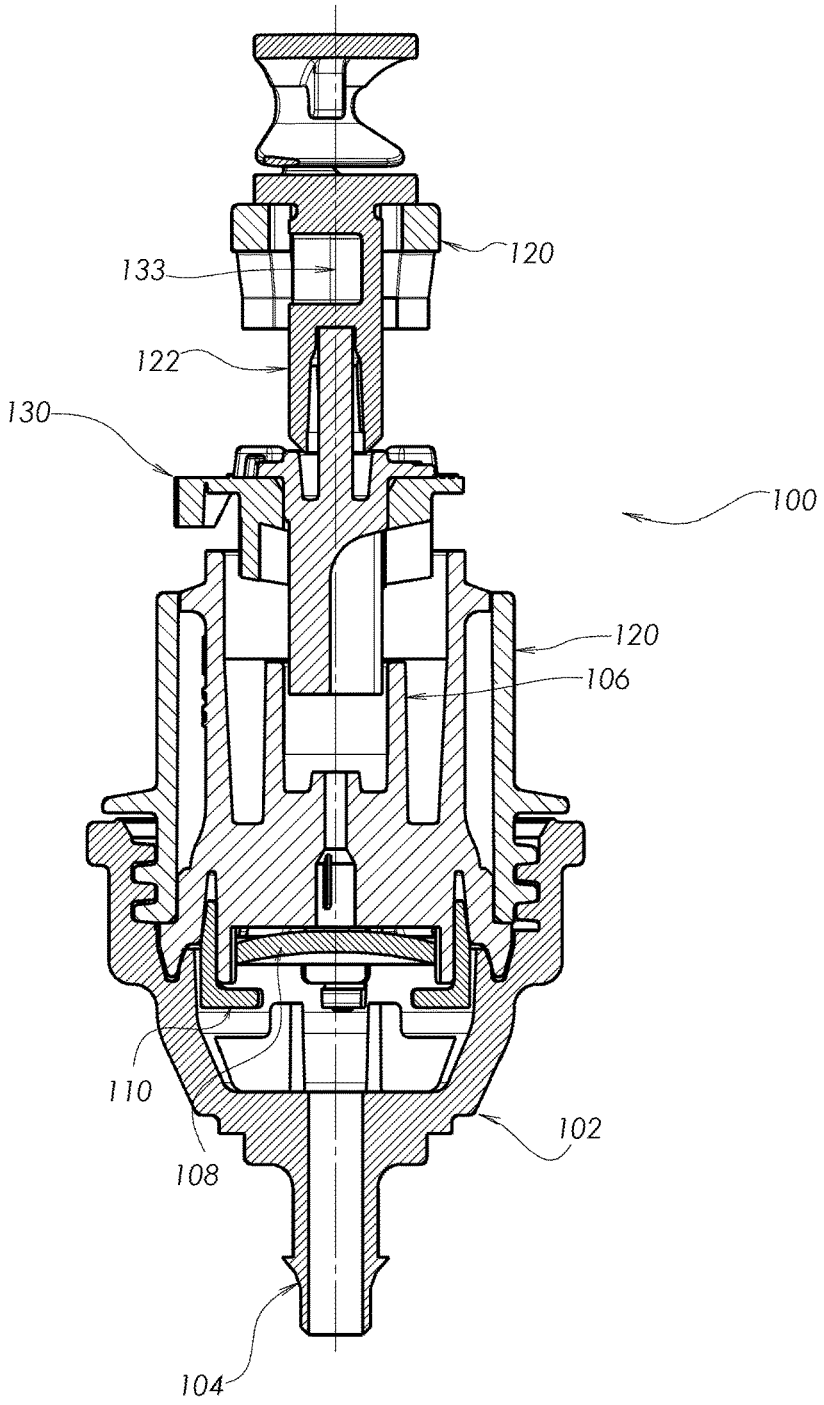

Reference is now made to FIGS. 3A and 3B, which are, respectively, a simplified side view illustration and a simplified sectional illustration, taken along lines B-B in FIG. 3A of the sprinkler of FIGS. 1A-2B in a pressurized operative orientation. It is seen that the rotatable water deflector assembly 130 is in a relatively raised orientation relative to body portion 120 and nozzle-defining portion 106.

Figure 4A:
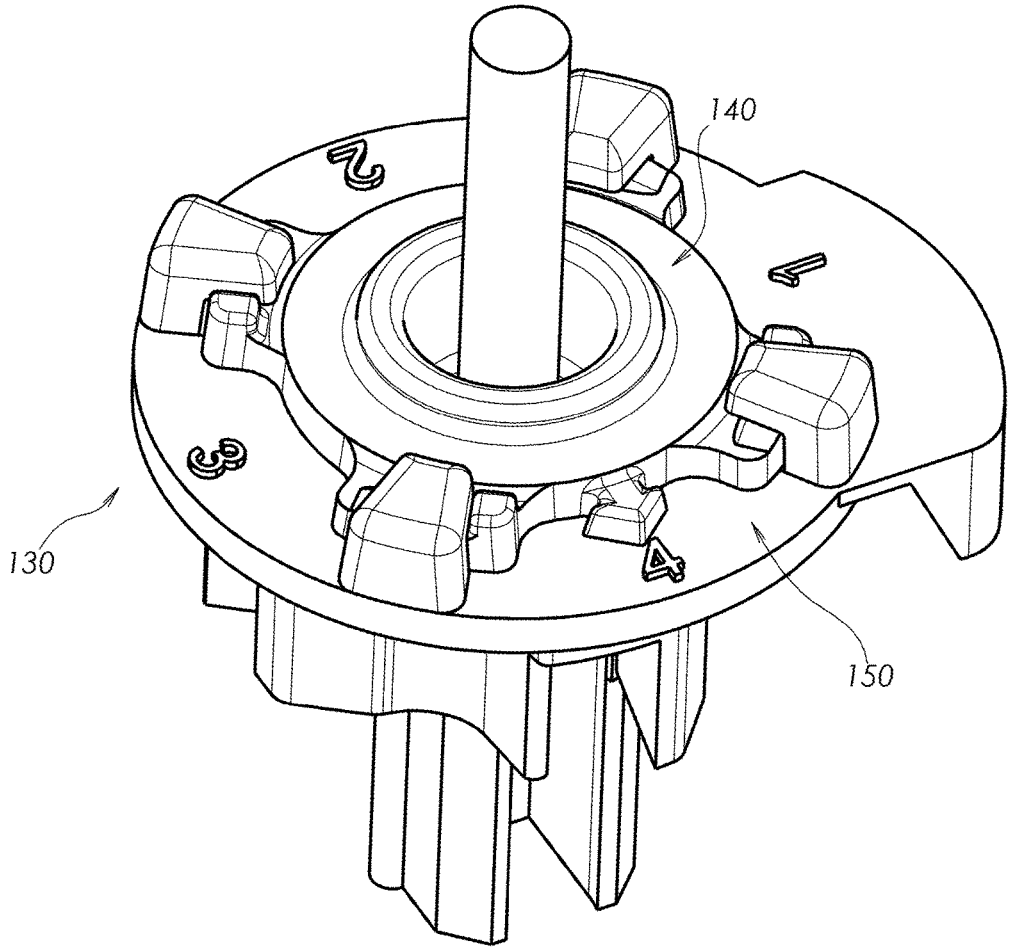
FIGS. 4A, 4B and 4C are, respectively, simplified top-down and bottom-up pictorial assembled view illustrations and an exploded view illustration of a rotatable deflector assembly forming part of the sprinkler of FIGS. 1A-3B.
Figure 4B:
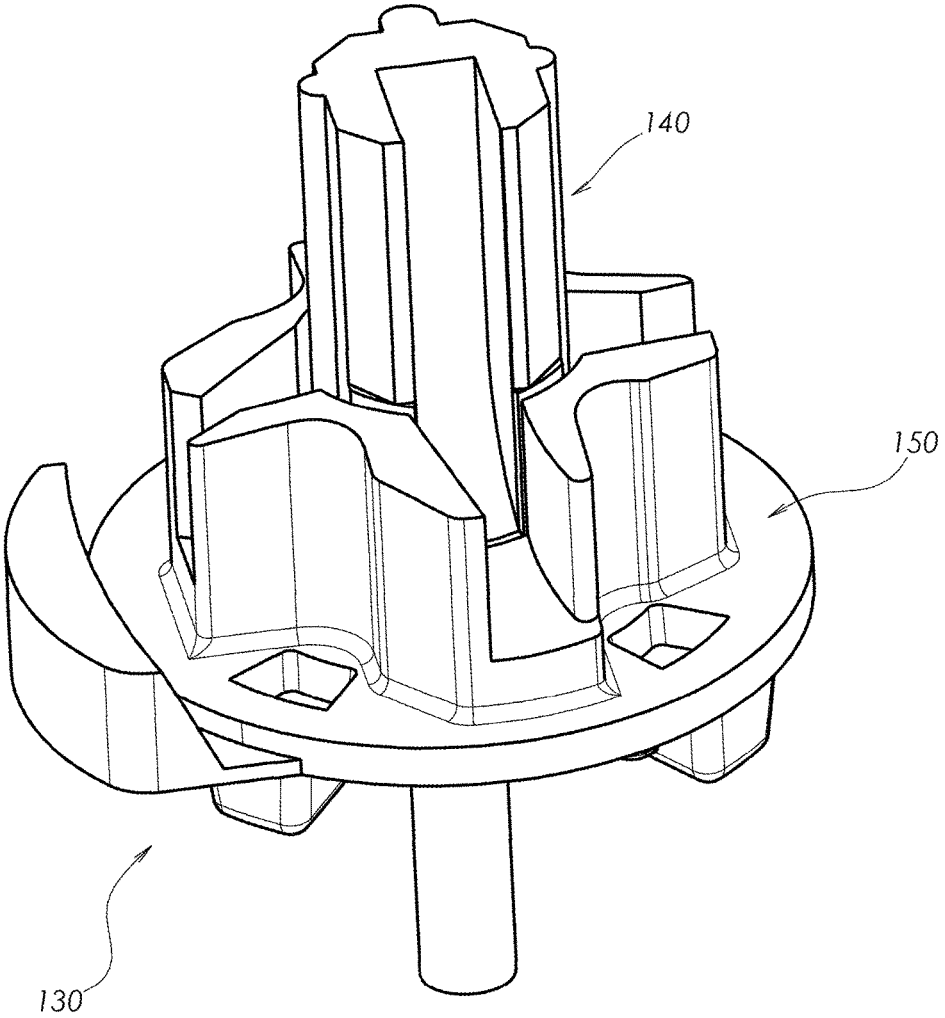
Figure 4C:
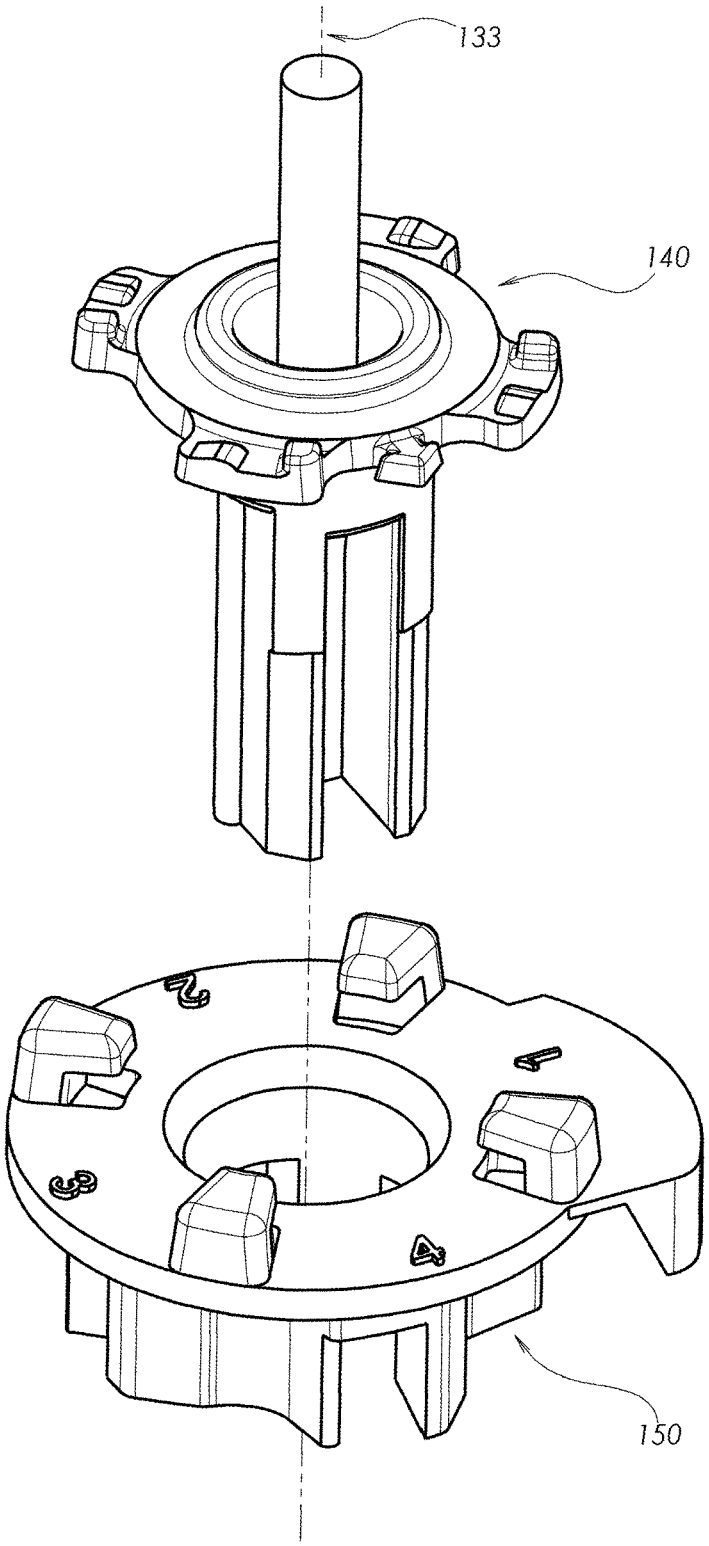

Reference is now made to FIGS. 4A, 4B and 4C, which are, respectively, simplified top-down and bottom-up pictorial assembled view illustrations and an exploded view illustration of rotatable deflector assembly 130, forming part of the sprinkler of FIGS. 1A-3B. As seen in FIGS. 4A-4C, it is a particular feature of the present invention that the rotatable deflector assembly 130 includes a first rotatable water path deflector portion 140, which is rotatable about axis 133, and a second rotatable water path deflector portion 150, which is also rotatable about axis 133 together with first rotatable water path deflector portion 140 and is also user rotatable about axis 133, relative to first rotatable water path deflector portion 140, thereby enabling user selection of at least one water distribution parameter.

Figure 5A:
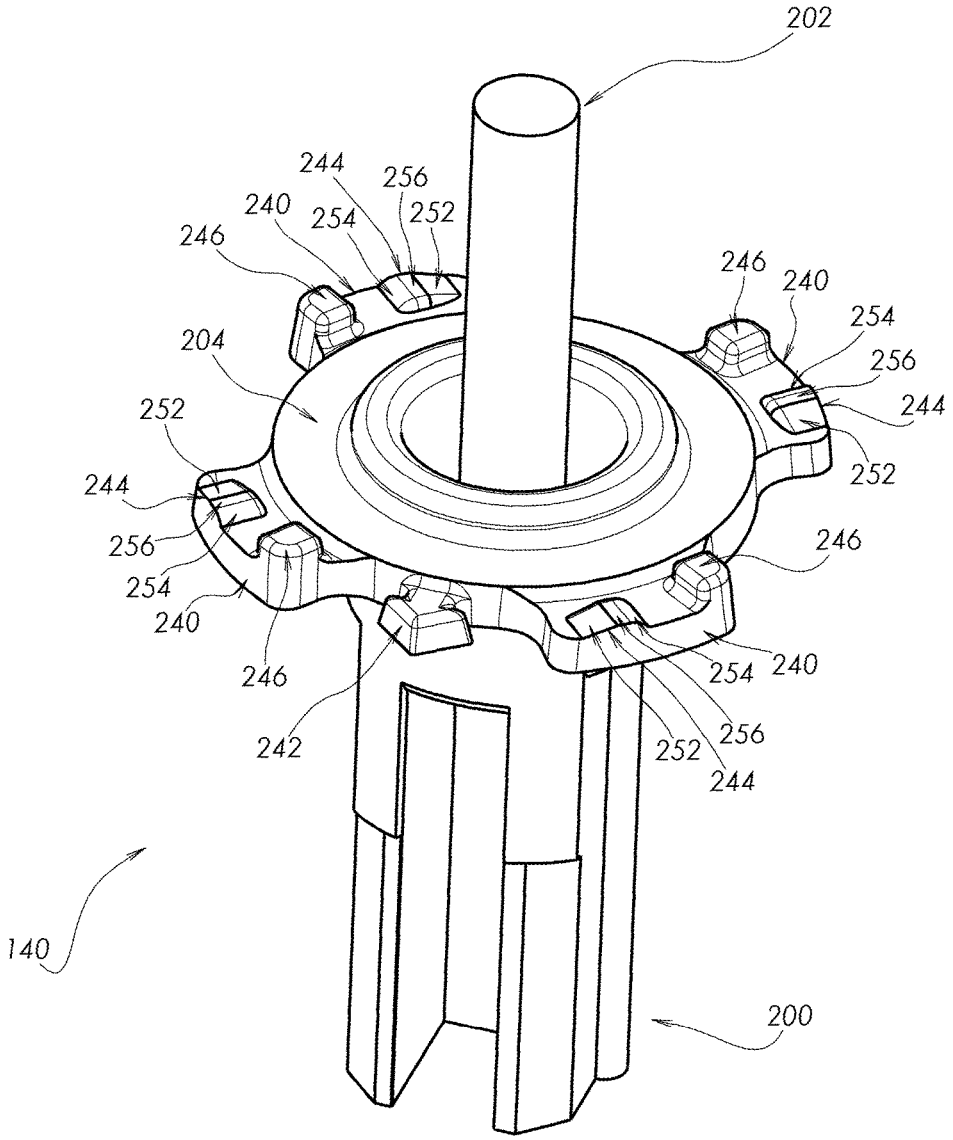
FIGS. 5A, 5B, 5C, 5D, 5E, 5F, 5G and 5H are, respectively, simplified pictorial, top plan view, bottom plan view, a sectional illustration taken along lines D-D in FIG. 5B, a sectional illustration taken along lines E-E in FIG. 5B and first, second and third side plan view illustrations of a first rotatable water deflector portion of the rotatable deflector assembly of FIGS. 4A-4C, FIGS. 5F, 5G and 5H being taken along respective arrows F, G and H in FIG. 5B.
Figure 5B:
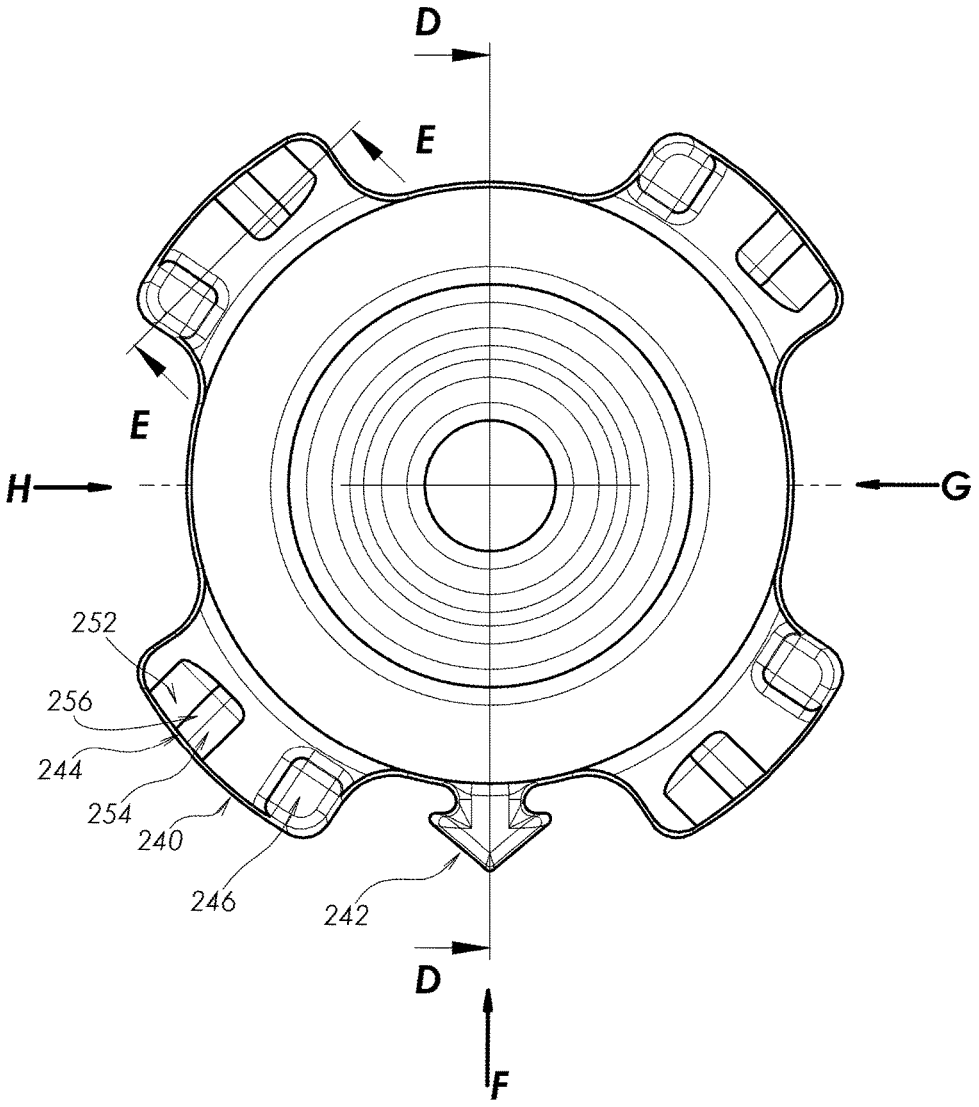
Figure 5C:
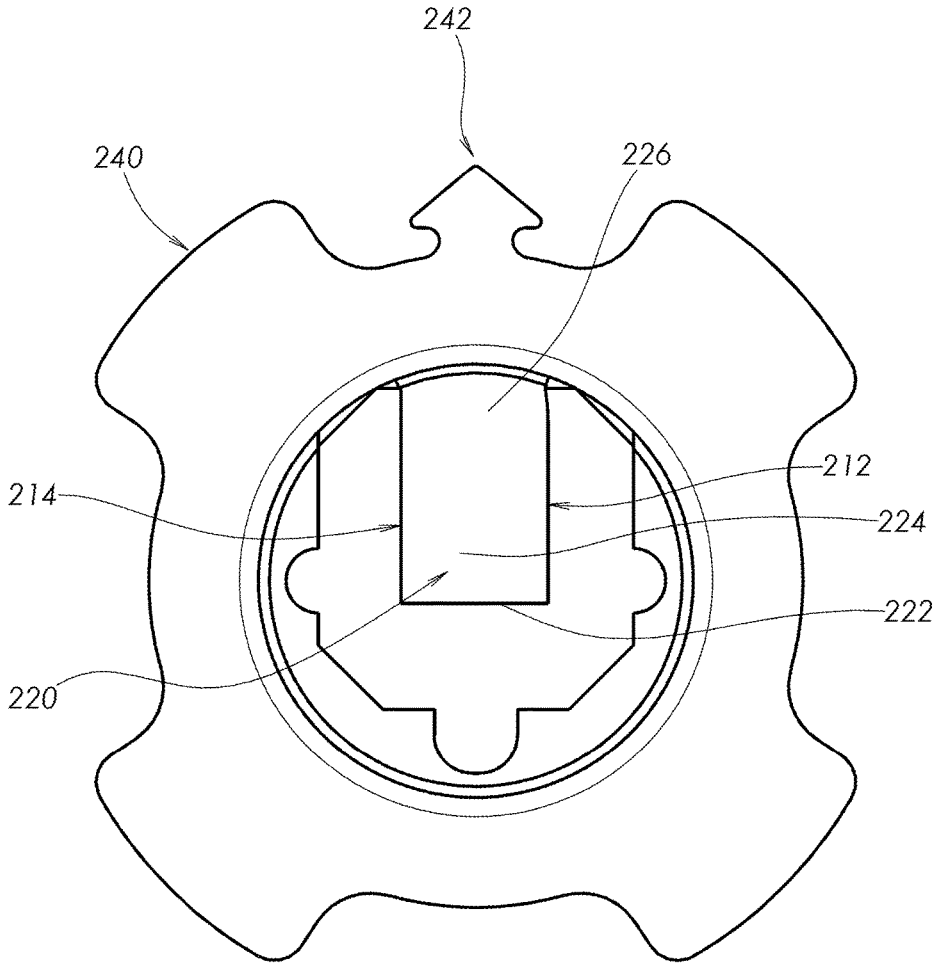
Figure 5D:
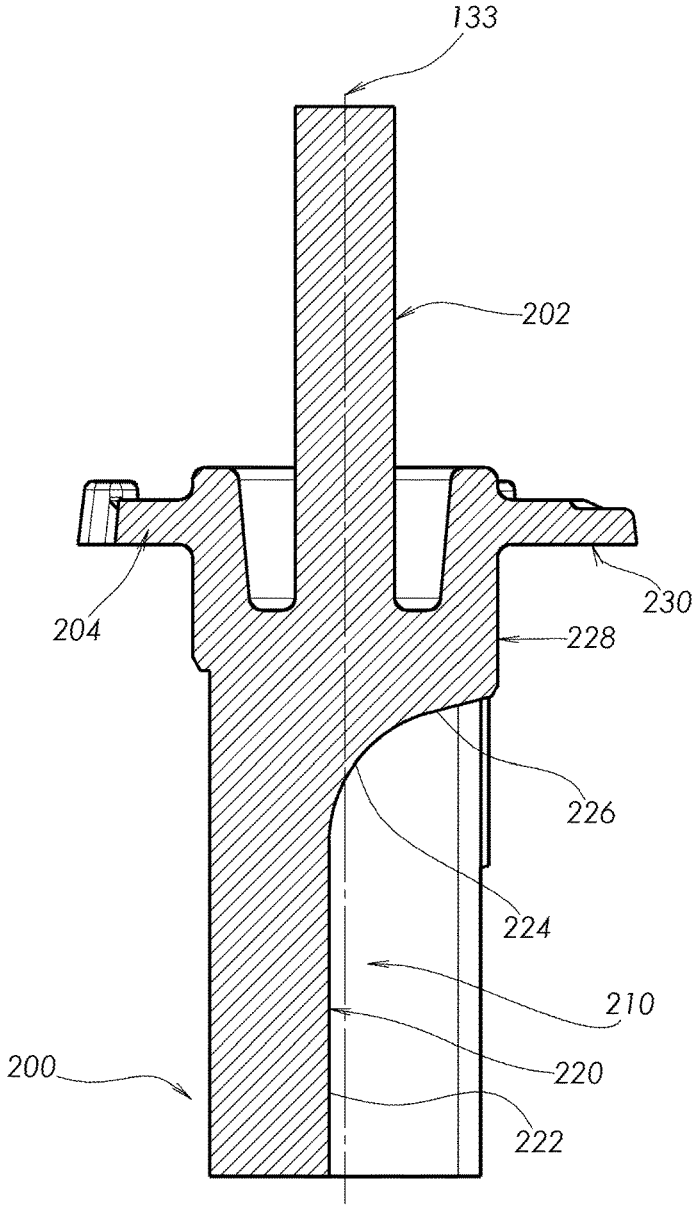
Figure 5E:
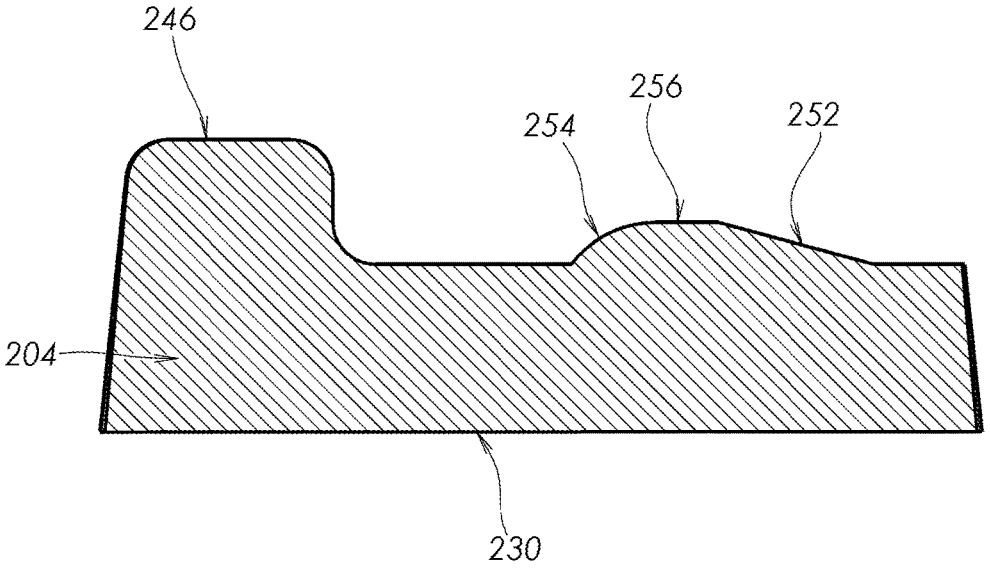
Figure 5F:
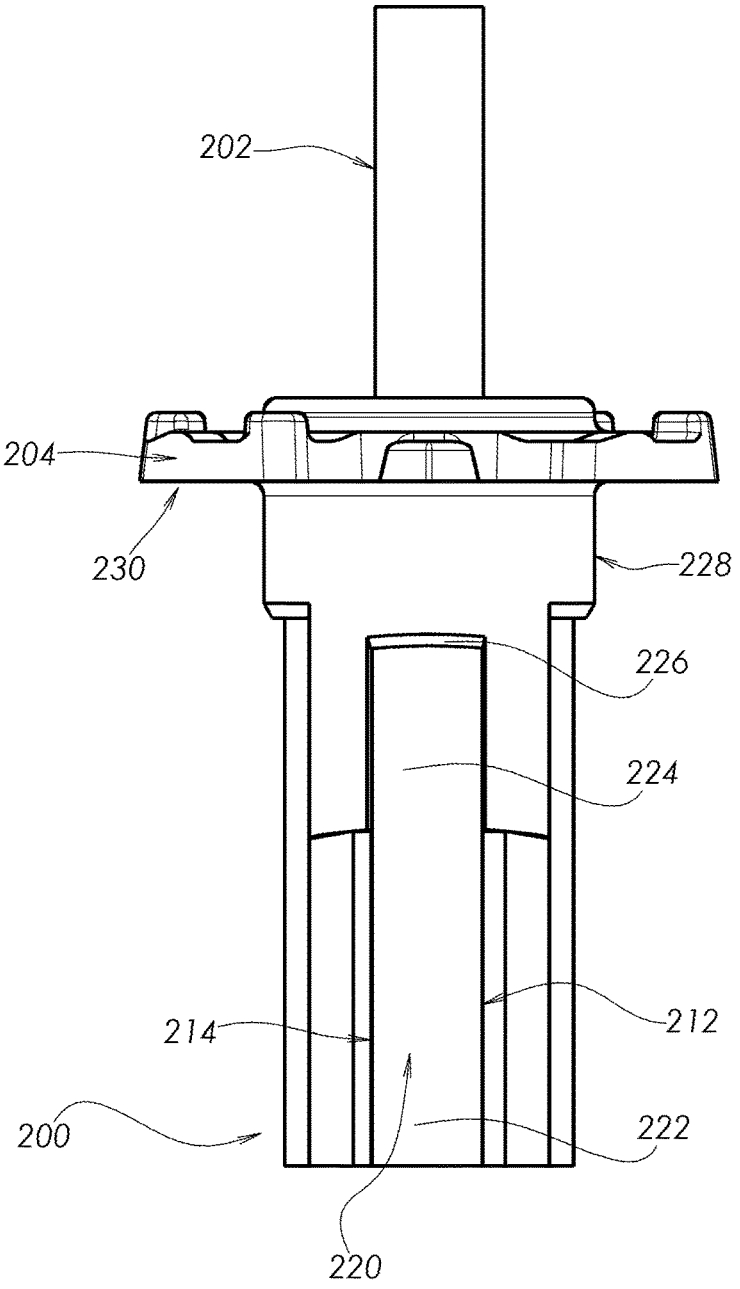
Figure 5G:
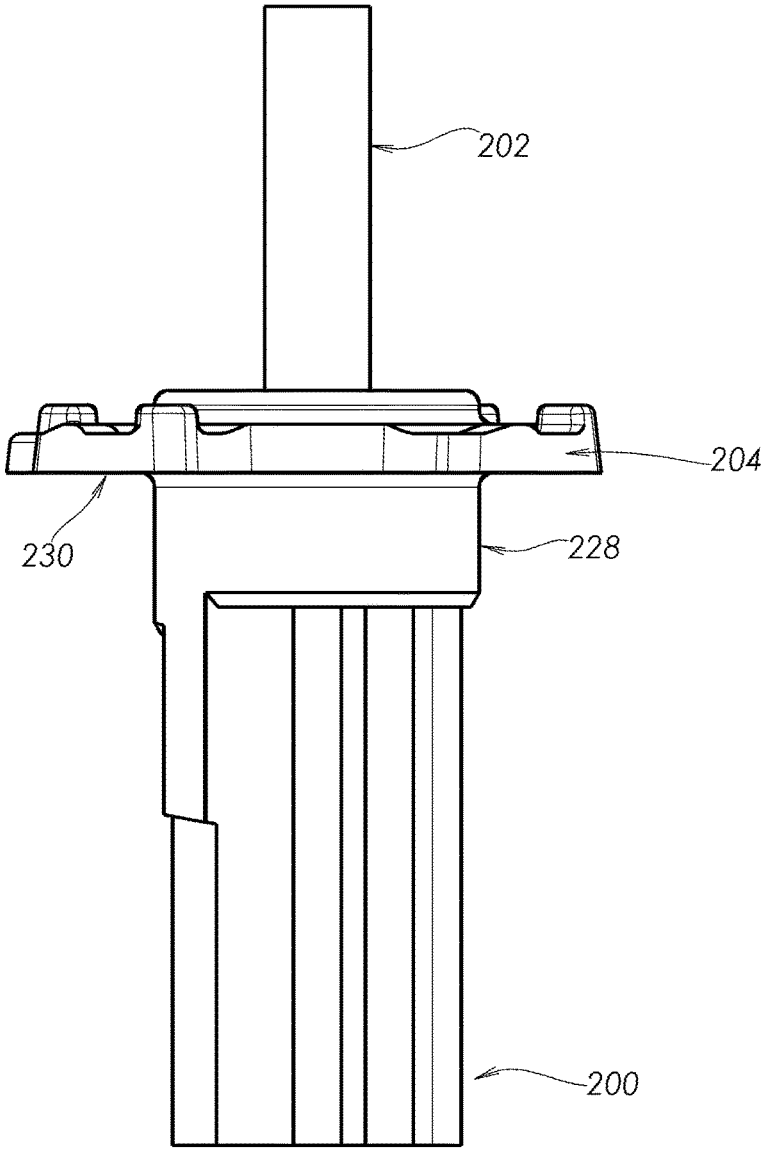
Figure 5H:
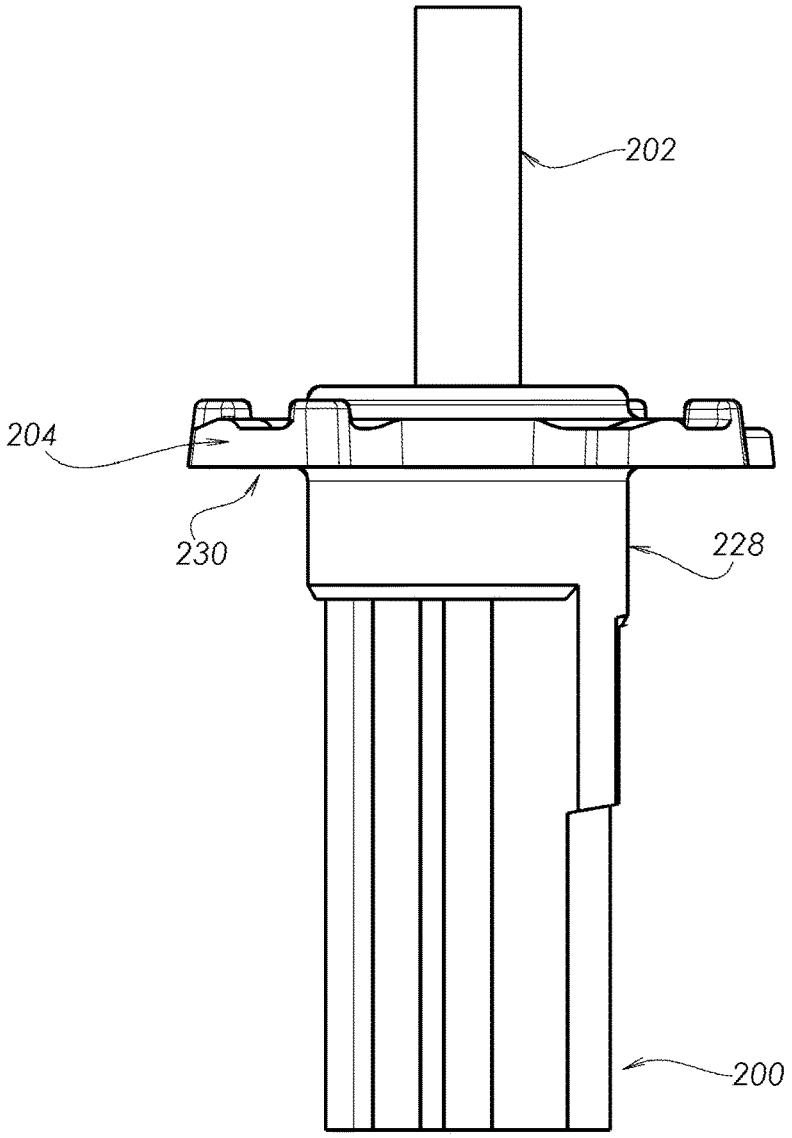

Reference is now made to FIGS. 5A, 5B, 5C, 5D, 5E, 5F, 5G and 5H, which are, respectively, simplified pictorial, top plan view, bottom plan view, a sectional illustration taken along lines D-D in FIG. 5B, a sectional illustration taken along lines E-E in FIG. 5B and first, second and third side plan view illustrations of first rotatable water path deflector portion 140 of the rotatable deflector assembly 130 of FIGS. 4A-4C, FIGS. 5F, 5G and 5H being taken along respective arrows E, F and G in FIG. 5B.

As seen in FIGS. 5A-5H, the first rotatable water path deflector portion 140 is preferably integrally formed by injection molding of low friction, low wear plastic and includes a bottom, generally cylindrical portion 200, an upper axle-defining portion 202 and a generally planar portion 204 arranged between the generally cylindrical portion 200 and the axle-defining portion 202.

The bottom, generally cylindrical portion 200 preferably defines a first water pathway 210 having mutually spaced planar side surfaces 212 and 214 and a first water path deflector surface 220, which preferably includes an initial generally vertical planar surface portion 222 which extends upwardly to a curved surface portion 224. Curved surface portion 224 extends upwardly and radially outwardly to an upwardly and radially outwardly planar surface portion 226. Bottom, generally cylindrical portion 200 also comprises a generally circular cylindrical portion 228 extending from a location above planar surface portion 226 to an underside surface 230 of generally planar portion 204.

Generally planar portion 204 preferably is formed with a plurality of, typically four, radially-extending protrusions 240 as well as a pointer 242. Each of protrusions 240 is preferably formed on a top surface thereof with a pair of bayonet engagement protrusions 244 and 246 for user-changeable, selectable azimuth engagement of second rotatable water deflector portion 150 therewith. Bayonet engagement protrusions 244 are each preferably a "bump" protrusion and each preferably include first and second opposite directed and mutually azimuthally separated inclined planar surfaces 252 and 254, separated by a flat surface 256. Bayonet engagement protrusions 246 are preferably "stop" protrusions, which limit the counterclockwise travel of second water rotatable water deflector portion 150 relative to first rotatable water path deflector portion 140 at each of the user selectable azimuthal relative orientations thereof.

Figure 6A:
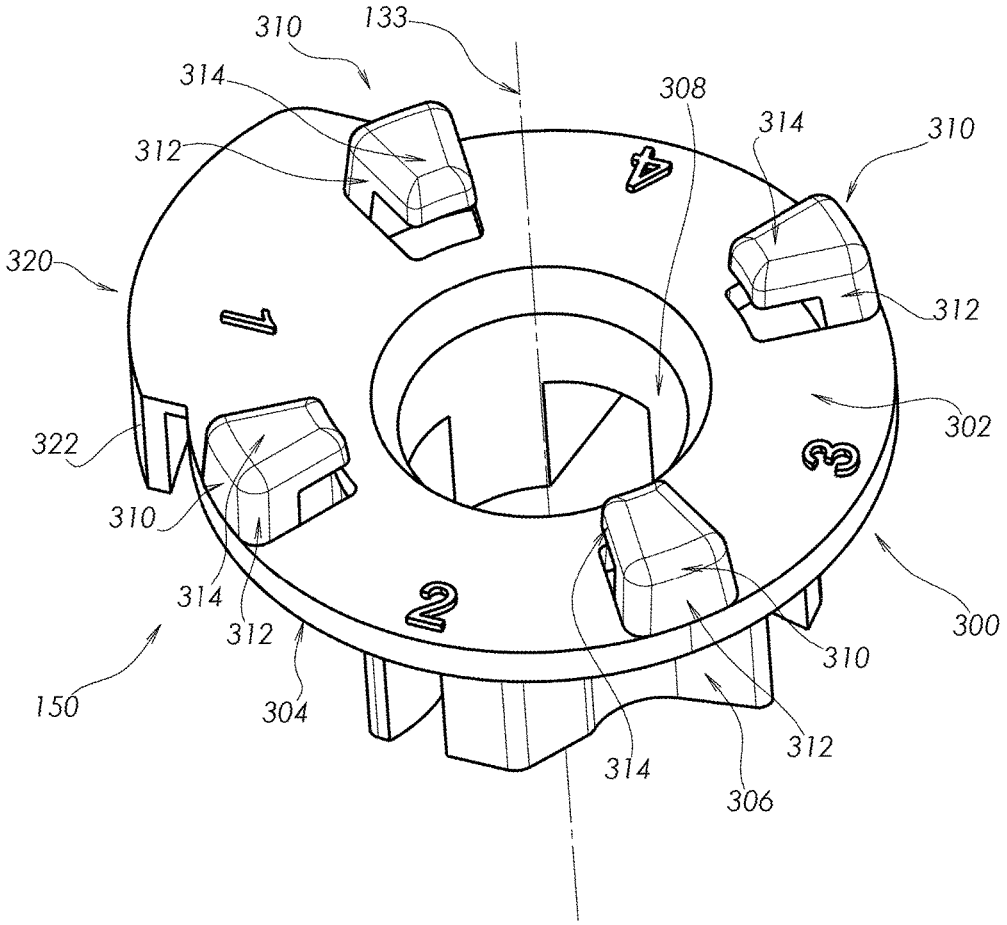
FIGS. 6A, 6B, 6C, 6D, 6E, 6F, 6G, 6H, 6I, 6J, 6K and 6L are, respectively, simplified pictorial, top plan view, bottom plan view, a sectional illustration taken along lines D-D in FIG. 6B, a sectional illustration taken along lines E-E in FIG. 6B, a sectional illustration taken along lines F-F in FIG. 6C, a sectional illustration taken along lines G-G in FIG. 6C, a sectional illustration taken along lines H-H in FIG. 6C, a sectional illustration taken along lines I-I in FIG. 6C and first, second and third side plan view illustrations of a second rotatable water deflector portion of the rotatable deflector assembly of FIGS. 4A-4C, FIGS. 6J, 6K and 6L being taken along respective arrows J, K and L in FIG. 6B.
Figure 6B:
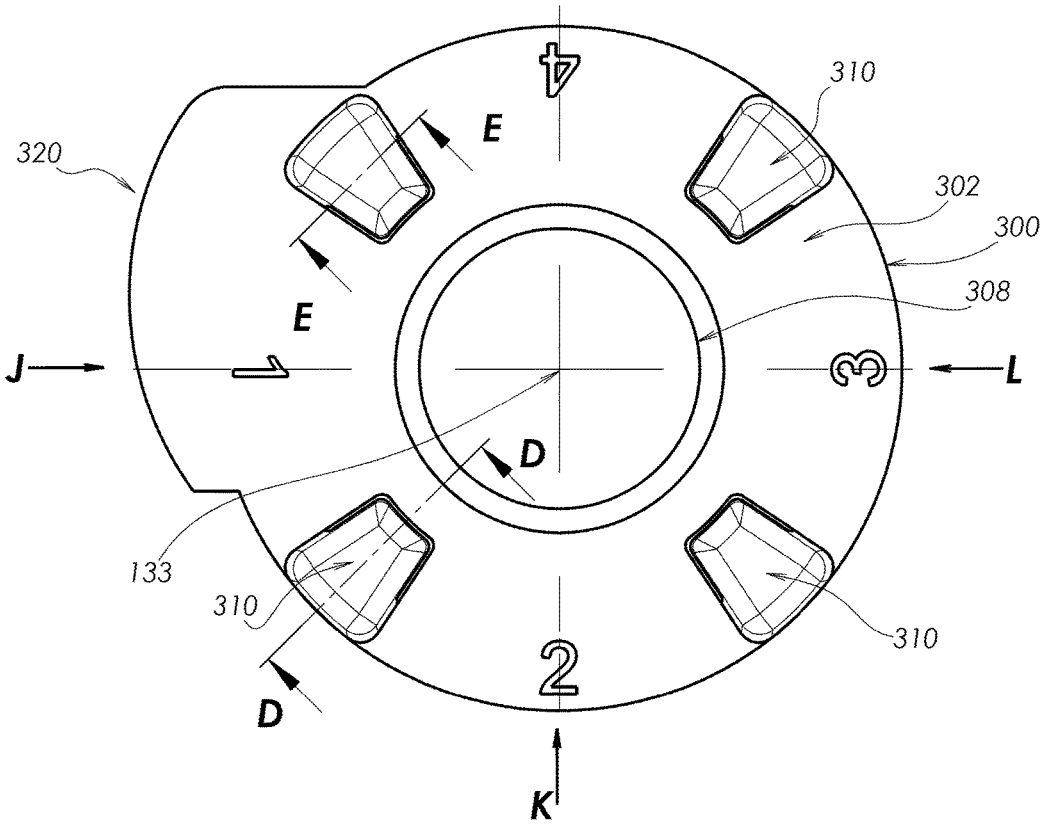
Figure 6C:
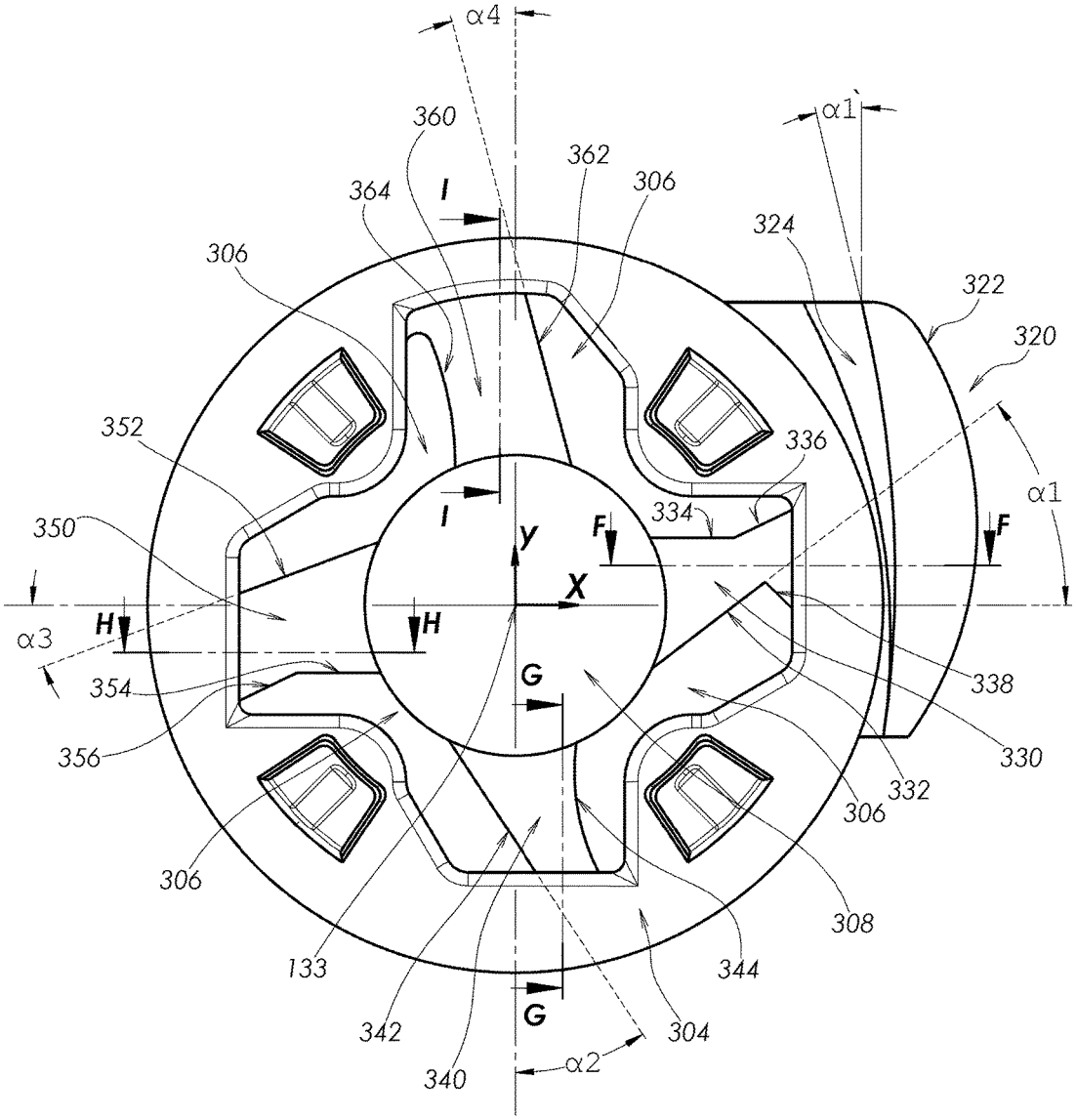
Figure 6D:
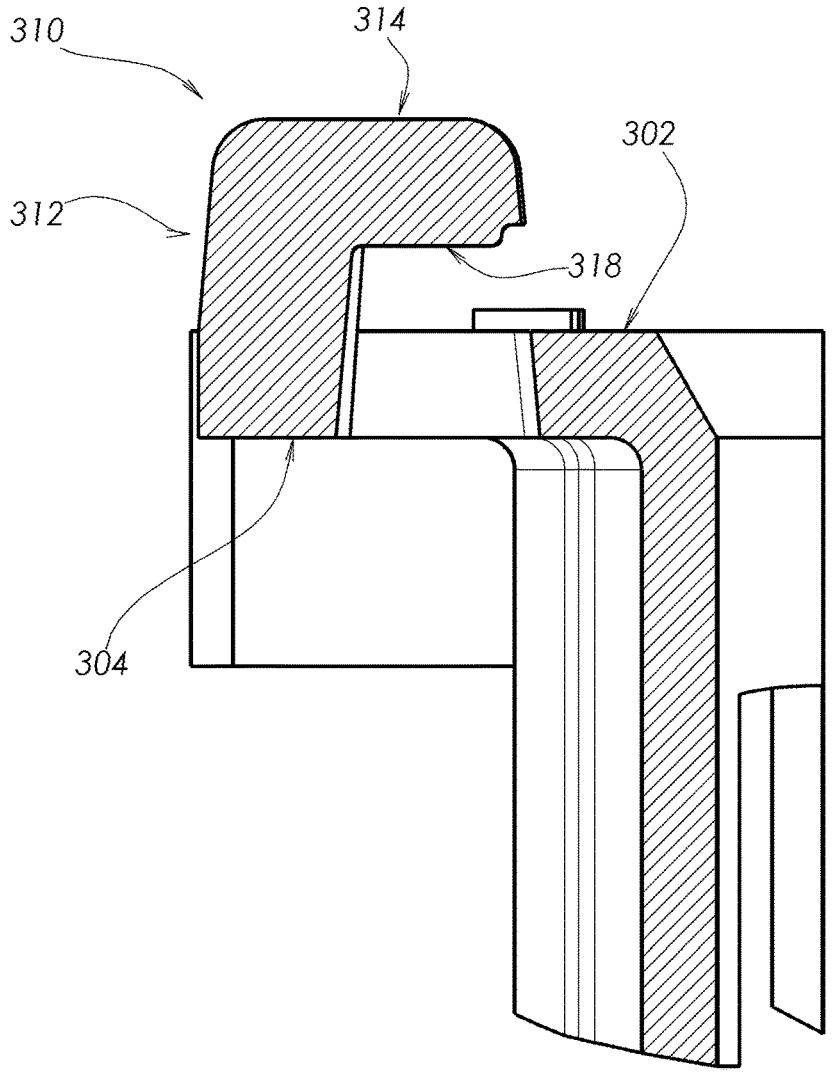
Figure 6E:
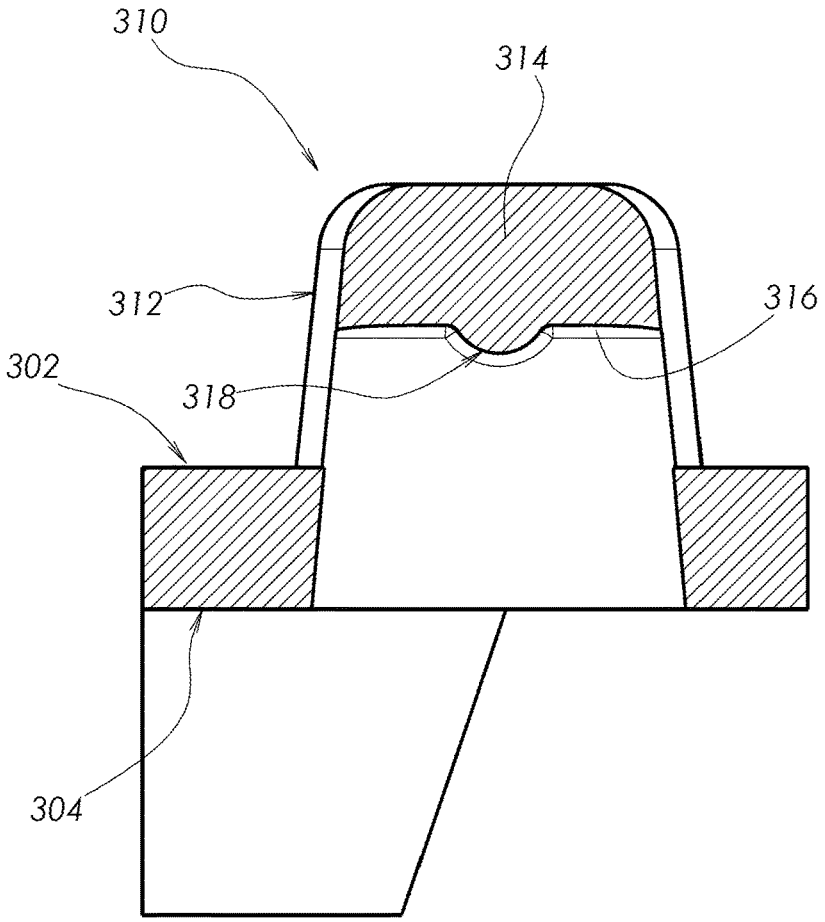

Reference is now made to FIGS. 6A, 6B, 6C, 6D, 6E, 6F, 6G, 6H, 6I, 6J, 6K and 6L, which are, respectively, simplified pictorial, top plan view, bottom plan view, a sectional illustration taken along lines D-D in FIG. 6B, a sectional illustration taken along lines E-E in FIG. 6B, a sectional illustration taken along lines F-F in FIG. 6C, a sectional illustration taken along lines G-G in FIG. 6C, a sectional illustration taken along lines H-H in FIG. 6C, a sectional illustration taken along lines I-I in FIG. 6C and first, second and third side plan view illustrations of second rotatable water deflector portion 150 of the rotatable deflector assembly of FIGS. 4A-4C, FIGS. 6J, 6K and 6L being taken along respective arrows J, K and L in FIG. 6B.

As seen in FIGS. 6A-6L, second rotatable water deflector portion 150 includes a generally planar portion 300, defining a generally flat top surface 302 and a generally flat bottom surface 304, as well as a plurality of depending portions 306, extending downwardly from generally flat bottom surface 304. Generally planar portion is preferably formed with a central aperture 308, centered about axis 133.

Extending upwardly from generally flat top surface 302 are, preferably, a plurality of retaining protrusions 310, which are typically four in number and are equally azimuthally distributed about axis 133. Retaining protrusions 310, each preferably include an upstanding portion 312 and a radially inwardly extending portion 314 and are designed to rotatably retain first rotatable water path deflector portion 140 in engagement therewith in one of four equally azimuthally distributed operative orientations. It is noted that, as seen particularly clearly in FIG. 6E, an underside surface 316 of radially inwardly extending portion 314 defines a protrusion 318 for rotatably displaceable engagement with the first rotatable water path deflector portion 140.

Generally planar portion 300 preferably includes a radially outwardly extending portion 320 having a downwardly depending portion 322, which defines a curved inner surface 324 which defines a secondary azimuthal water deflection and reaction surface. Surface 324 is slightly curved and is arranged to be tangent to an imaginary circle about axis 133 only along a small portion of the extent of surface 324.

As seen particularly in FIG. 6C, depending portions 306 together define four user-selectable pressurized water flow pathways therebetween.

FIG. 6C defines an X axis and a Y axis, perpendicular to each other, in an X-Y plane, which is parallel to generally planar portion 300 and perpendicular to a Z axis, which is coaxial with axis 133, and also defines an X-Z plane and a Y-Z plane.

A first user-selectable pressurized water flow pathway 330 is defined by a reaction surface 332 and additional pathway surfaces 334, 336 and 338. Reaction surface 332 preferably defines an angle $\alpha 1$, in the X-Y plane, with respect to the X axis. Pressurized water flowing along first user-selectable pressurized water flow pathway 330 subsequently engages curved inner surface 324 which defines a downstream azimuthal water deflection and reaction surface and defines an angle $\alpha 1'$, in the X-Y plane, with respect to a line parallel to the Y axis.

A second user-selectable pressurized water flow pathway 340 is defined by a reaction surface 342 and additional curved pathway surface 344. Reaction surface 342 preferably defines an angle $\alpha 2$, in the X-Y plane, with respect to the Y axis. Preferably, angle $\alpha 2$ is not equal to angle $\alpha 1$.

A third user-selectable pressurized water flow pathway 350 is defined by a reaction surface 352 and additional pathway surfaces 354 and 356. Reaction surface 352 preferably defines an angle $\alpha 3$, in the X-Y plane, with respect to the X axis. Preferably, angle $\alpha 3$ is not equal to angle $\alpha 2$ and is not equal to angle $\alpha 1$.

A fourth user-selectable pressurized water flow pathway 360 is defined by a reaction surface 362 and additional curved pathway surface 364. Reaction surface 362 preferably defines an angle $\alpha 4$, in the X-Y plane, with respect to the Y axis. Preferably, angle $\alpha 4$ is not equal to angle $\alpha 3$, is not equal to angle $\alpha 2$ and is not equal to angle $\alpha 1$.

As seen particularly in FIGS. 6F, 6G, 6H and 6I, each of the four user-selectable pressurized water flow pathways 330, 340, 350 and 360 also defines an elevation limiting surface.

Figure 6F:
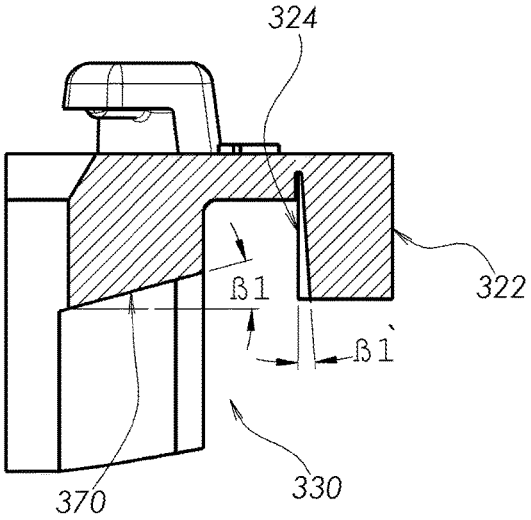

As seen in FIG. 6C and in FIG. 6F, water flow pathway 330 is also defined by a planar elevation limiting surface 370, which defines, with respect to a plane parallel to the X-Y plane, an angle $\beta 1$, in a plane parallel to the X-Z plane, and by downstream azimuthal water deflection and reaction surface 324, which defines, with respect to a plane parallel to the Y-Z plane, an angle $\beta 1'$, in a plane parallel to the X-Z plane.

Figure 6G:
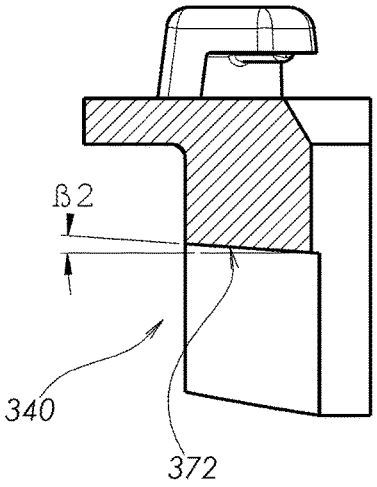

As seen in FIG. 6C and in FIG. 6G, water flow pathway 340 is also defined by a planar elevation limiting surface 372, which defines an angle $\beta 2$, with respect to a plane parallel to the X-Y plane, in a plane parallel to the Y-Z plane.

Figure 6H:
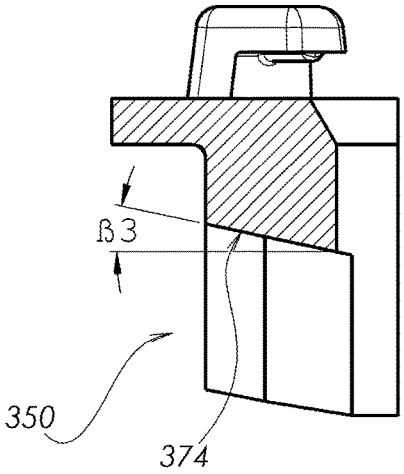

As seen in FIG. 6C and in FIG. 6H, water flow pathway 350 is also defined by a planar elevation limiting surface 374, which defines an angle $\beta 3$, with respect to a plane parallel to the X-Y plane, in a plane parallel to the X-Z plane.

Figure 6I:
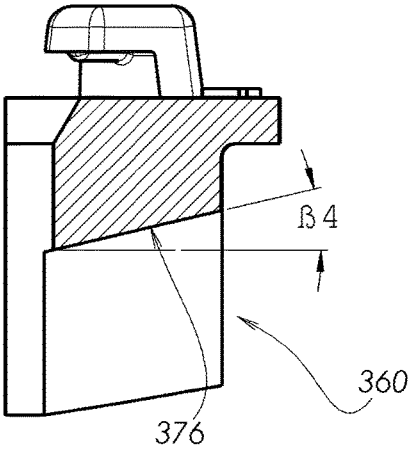
Figure 6J:
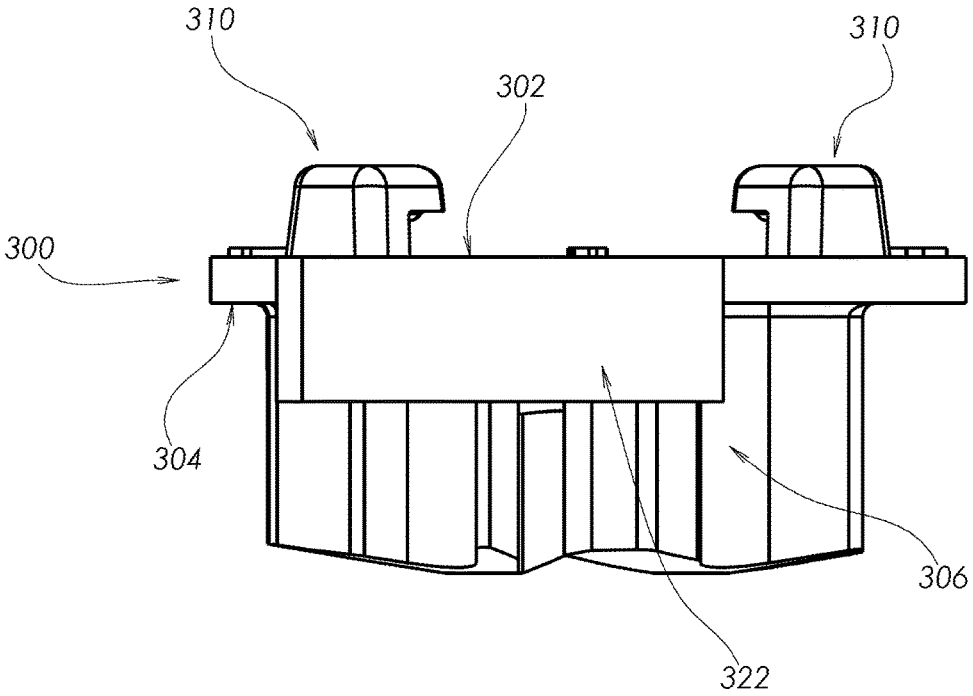
Figure 6K:
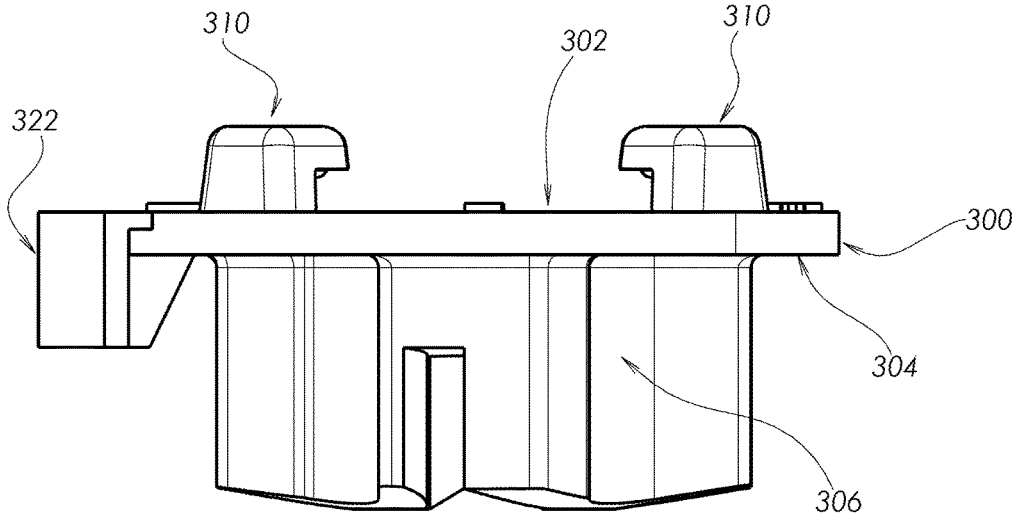
Figure 6L:
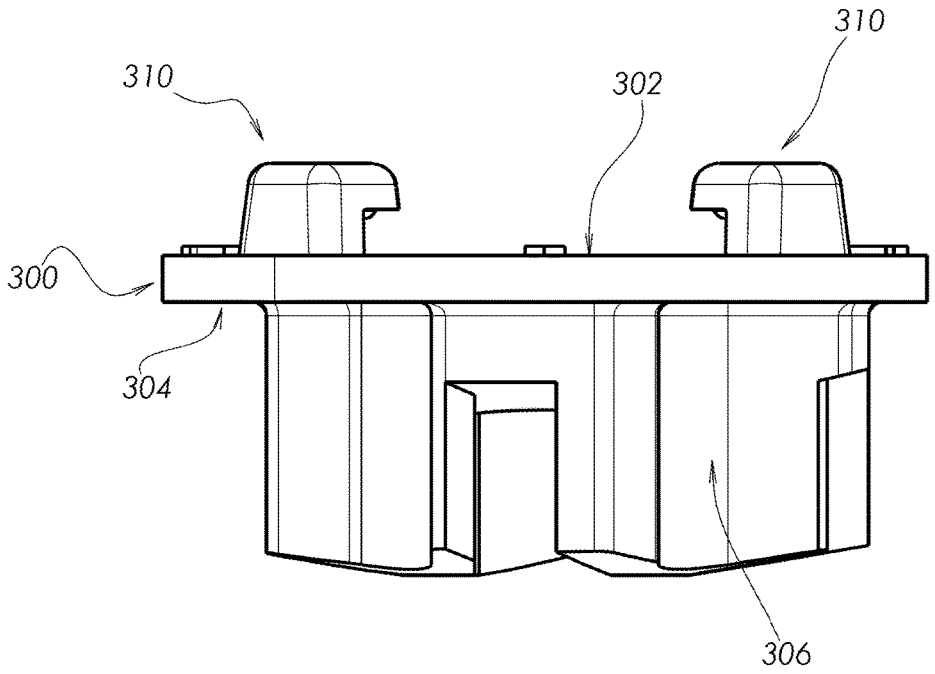

As seen in FIG. 6C and in FIG. 6I, water flow pathway 360 is also defined by a planar elevation limiting surface 376, which defines an angle $\beta 4$ with respect to a plane parallel to the X-Y plane in a plane parallel to the Y-Z plane.

Figure 7A:
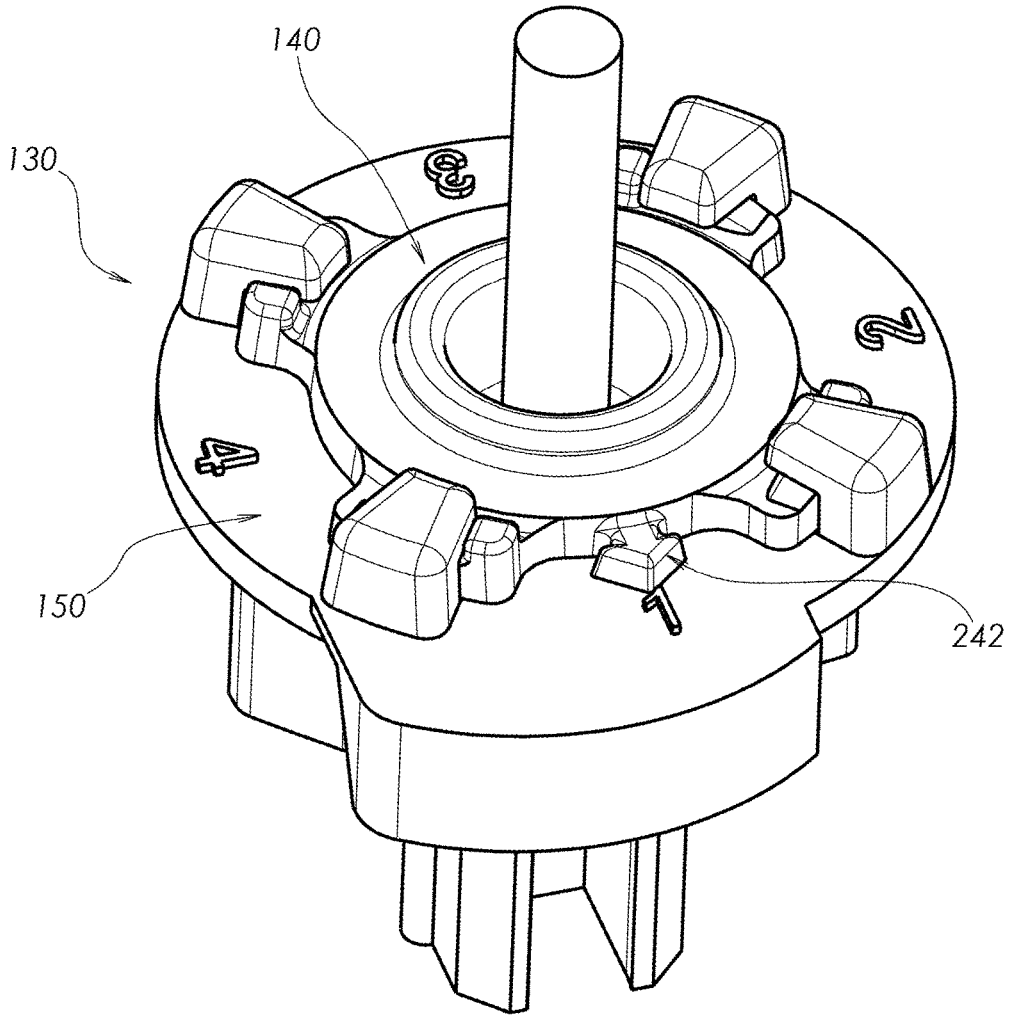
FIGS. 7A, 7B, 7C and 7D are respective simplified pictorial, top planar view, bottom planar view and sectional illustrations of the rotatable water deflector assembly of FIGS. 4A-6L in a first operative orientation, FIG. 7D being taken along lines D-D in FIG. 7C.
Figure 7B:
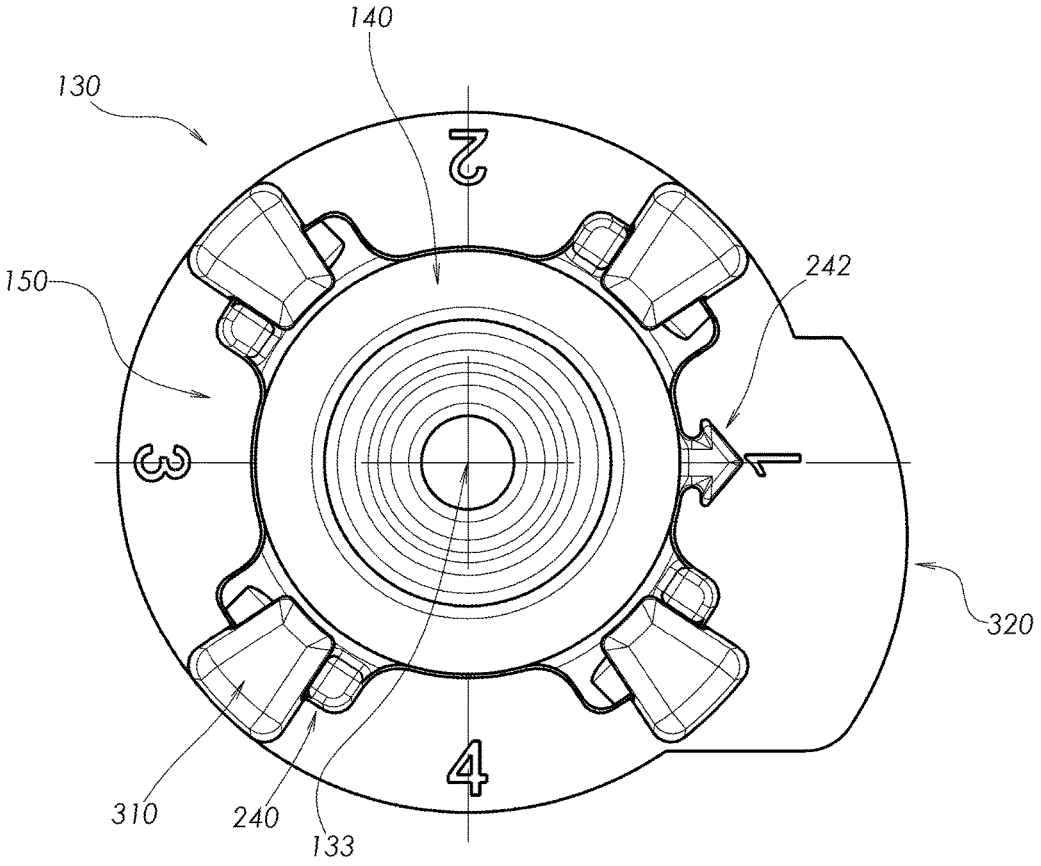
Figure 7C:
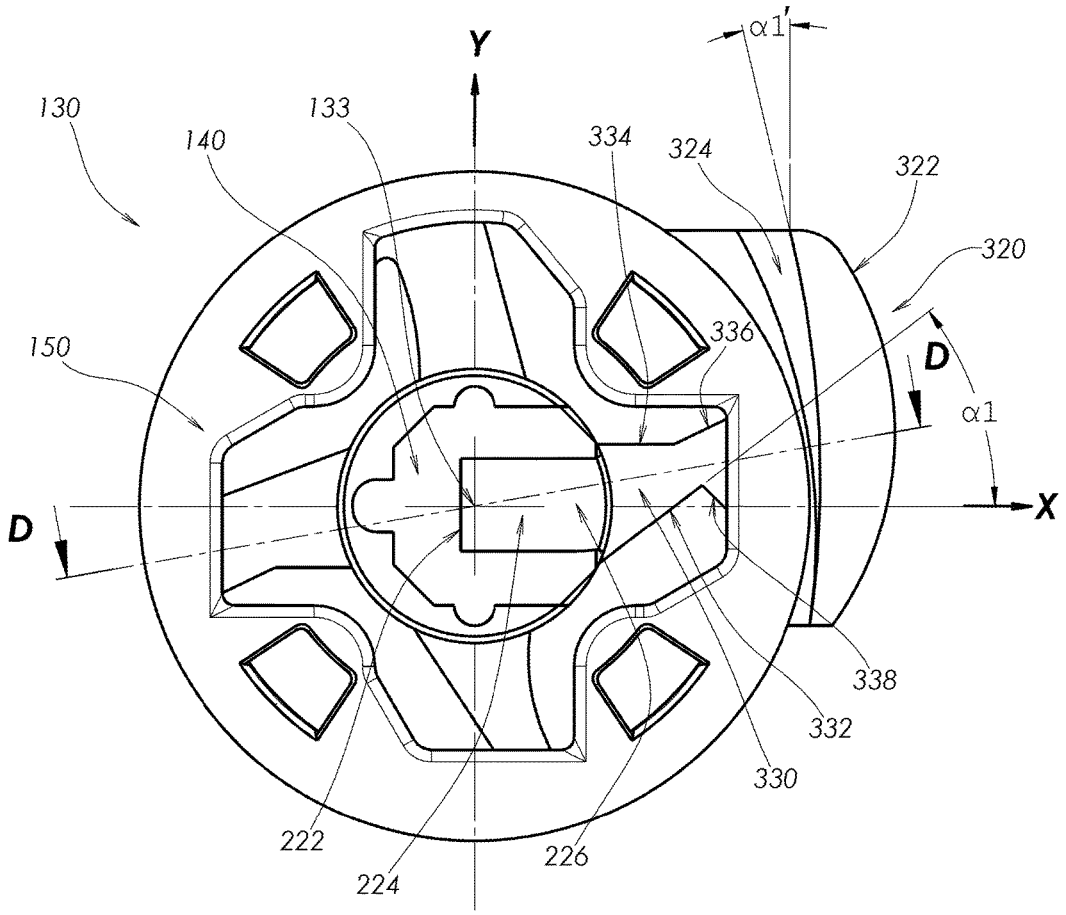
Figure 7D:
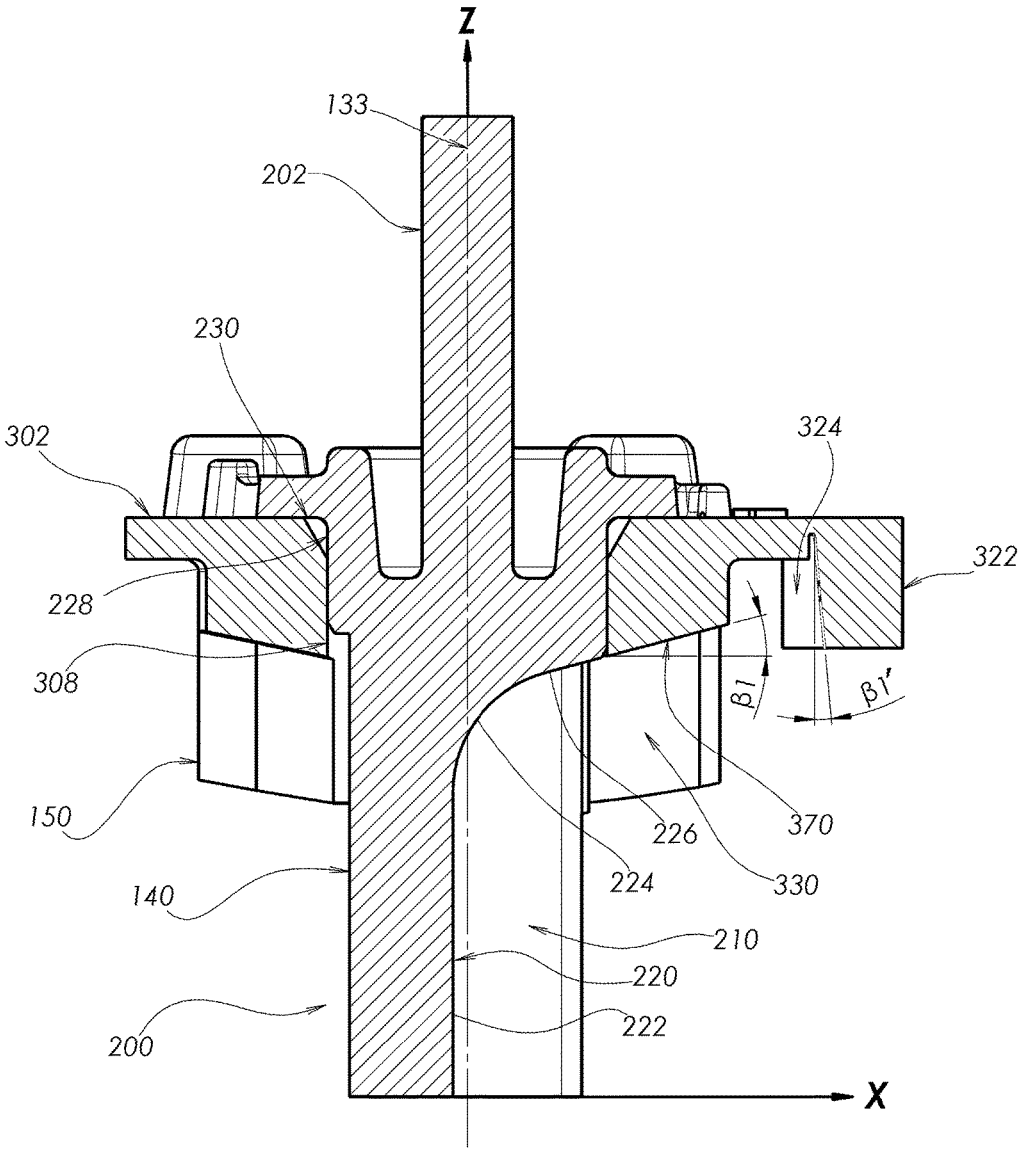

Reference is now made to FIGS. 7A, 7B, 7C and 7D, which are respective simplified pictorial, top planar view, bottom planar view and sectional illustrations of the rotatable water deflector assembly of FIGS. 4A-6L in a first operative orientation, FIG. 7D being taken along lines D-D in FIG. 7C. For the sake of clarity and conciseness, FIGS. 7A-7D are described hereinbelow with respect to a mutually orthogonal Cartesian coordinate system, as defined above with reference to FIG. 6C, fixed with respect to the second rotatable water path deflector portion 150, wherein the Z axis is coaxial with axis 133 and the X and Y axes extend mutually perpendicularly and perpendicularly to the Z axis.

It is appreciated that the X and Y axes shown in FIG. 7C correspond to the X and Y axes shown in FIG. 6C.

In the first operative orientation shown in FIGS. 7A-7D, pointer 242, as seen particularly in FIGS. 7A & 7B, is directed to an azimuthal location on second rotatable water path deflector portion 150 indicated by the numeral "1". As seen particularly in FIGS. 7C and 7D, the first water path deflector surface 220, which preferably includes initial generally vertical planar surface portion 222, which extends upwardly to curved surface portion 224 and in turn extends upwardly and radially outwardly to upwardly and radially outwardly planar surface portion 226, is azimuthally aligned about axis 133 (Z axis) with:

reaction surface 332, which defines an angle $\alpha$1 in the X-Y plane, as shown in FIG. 7C, with respect to the X axis;

with planar elevation limiting surface 370, which defines angle $\beta$1 in a plane parallel to the X-Z plane, as shown in FIG. 7D, with respect to a plane parallel the X-Y plane, and with curved downstream azimuthal water deflection and reaction surface 324, which defines a water stream exit angle $\alpha$1' in the X-Y plane, with respect to a line parallel to the Y axis, as shown in FIG. 7C, and a water stream exit angle $\beta$1' in a plane parallel to the X-Z plane, with respect to a plane parallel to the Y-Z plane, as shown in FIG. 7D.

Figure 8A:
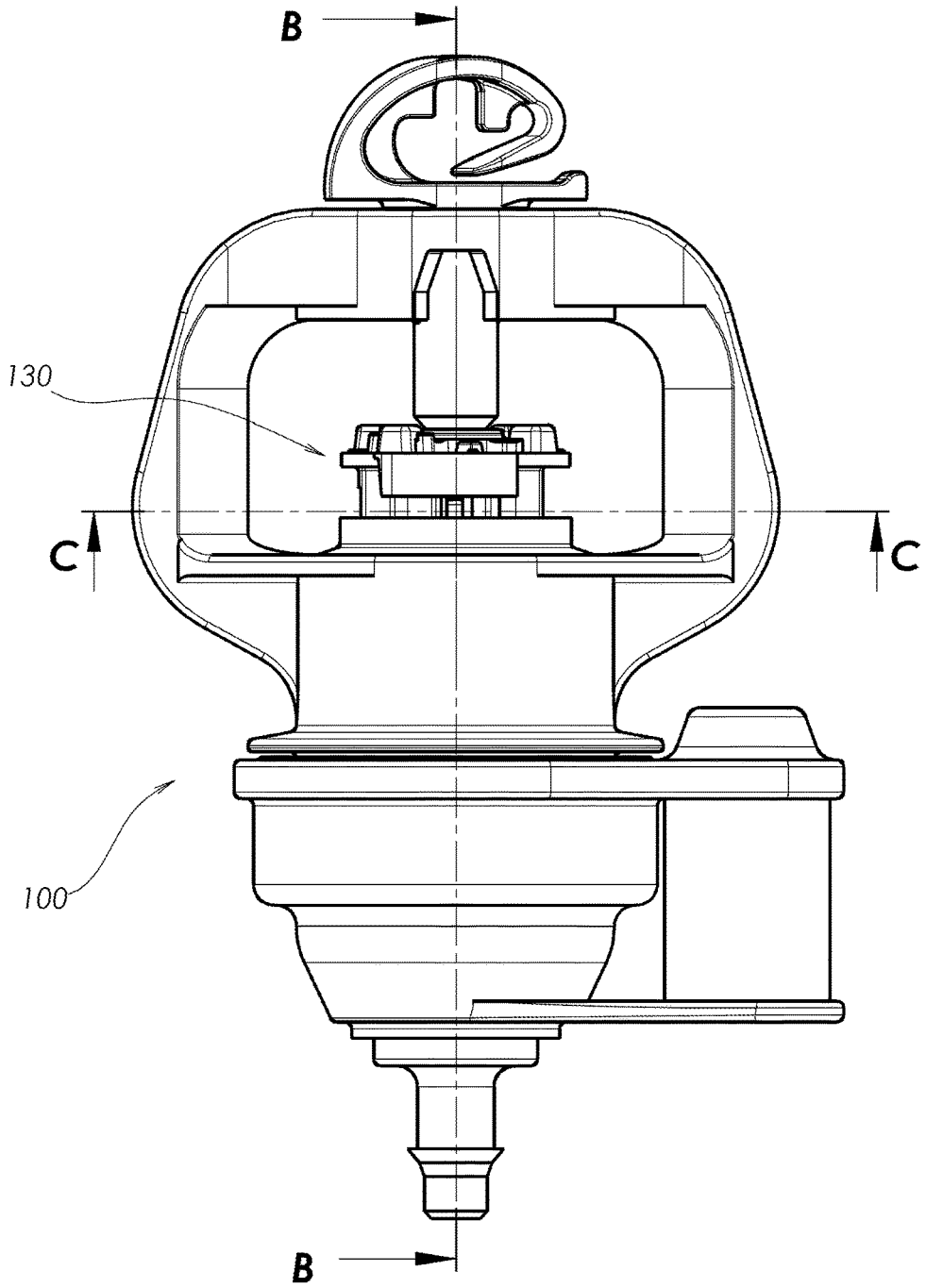
FIGS. 8A, 8B and 8C are respective simplified side view, first sectional view and second sectional view illustrations of the sprinkler of FIGS. 1A-6L when the rotatable water deflector assembly of FIGS. 4A-6L is in the first operative orientation seen in FIGS. 7A-7D, FIGS. 8B and 8C being taken along respective lines B-B and C-C in FIG. 8A.
Figure 8B:
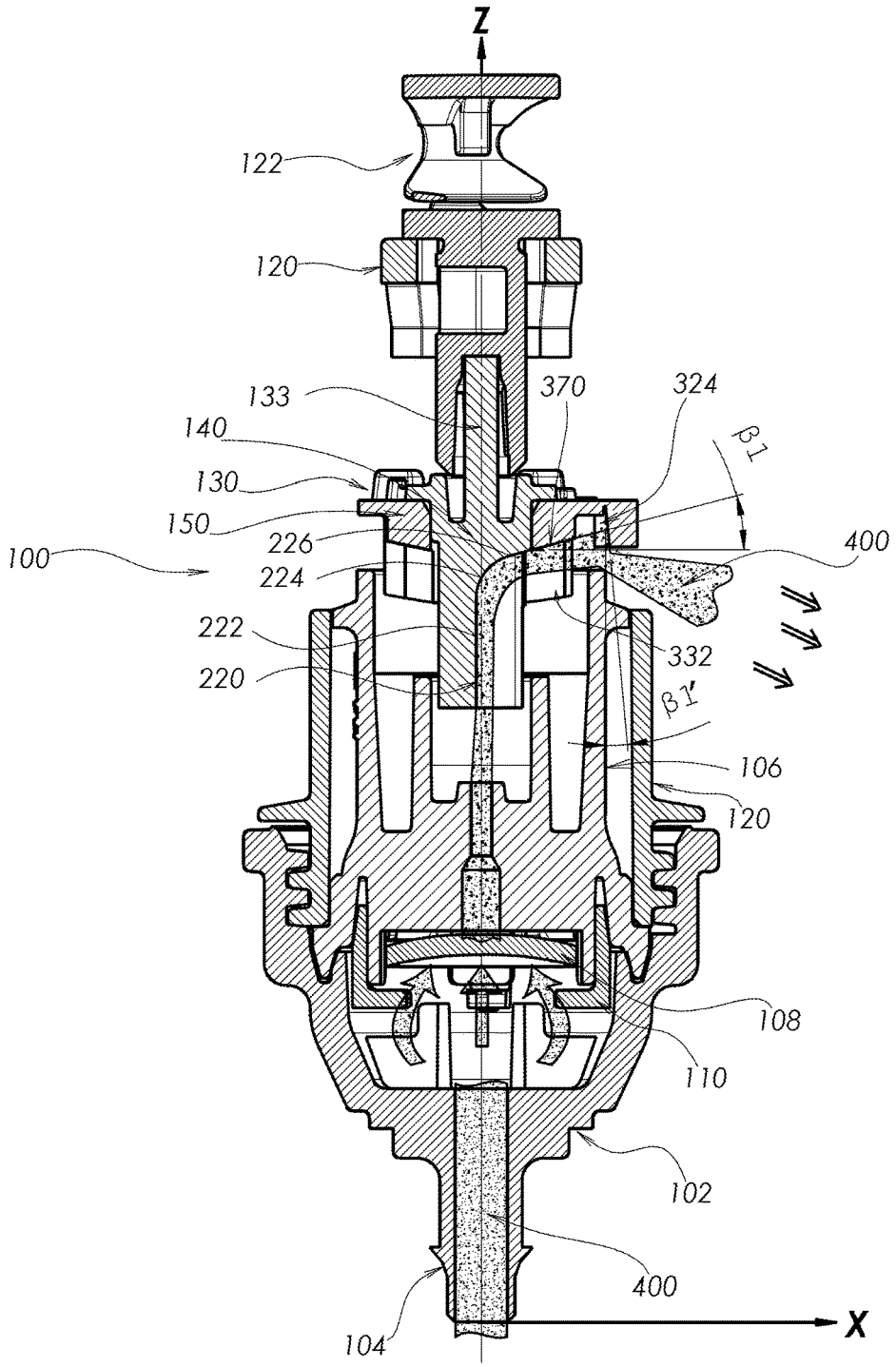
Figure 8C:
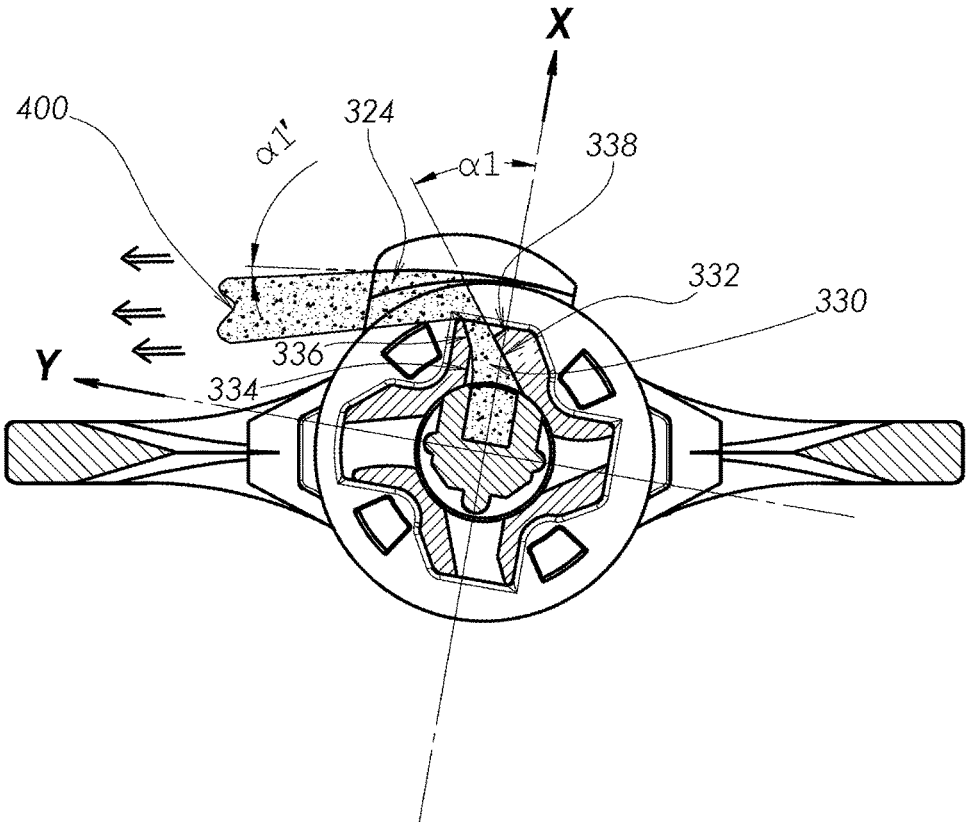

Reference is now made to FIGS. 8A, 8B and 8C, which are respective simplified side view, first sectional view and second sectional view illustrations of the sprinkler of FIGS. 1A-6L when the rotatable water deflector assembly of FIGS. 4A-6L is in the first operative orientation as seen in FIGS. 7A-7D, FIGS. 8B and 8C being taken along respective lines B-B and C-C in FIG. 8A.

As seen in FIGS. 8A-8C, a pressurized water stream 400 flows generally vertically though water inlet connector 104 (FIG. 1B) and nozzle defining portion 106 (FIG. 1B), optionally including flow control membrane 108 (FIG. 1B). The pressurized water stream 400 then engages the first water path deflector surface 220 of the first rotatable water path deflector portion 140. The pressurized water stream 400 flows along initial generally vertical planar surface portion 222 thereof, which extends upwardly to curved surface portion 224 and in turn flows upwardly and radially outwardly to upwardly and radially outwardly planar surface portion 226. The pressurized water stream 400 then engages reaction surface 332 of the second water path deflector 150, which surface 332 defines an angle $\alpha$1 in the X-Y plane, as shown in FIG. 8C, with respect to the X axis and planar elevation limiting surface 370 of the second water path deflector 150, which defines angle $\beta$1 in a plane parallel to the X-Z plane, as shown in FIG. 8B, with respect to a plane parallel to the X-Y plane. Part of the pressurized water stream 400 subsequently engages curved downstream azimuthal water deflection and reaction surface 324 of the second water path deflector 150, which defines a water stream exit angle $\alpha$1' in the X-Y plane, as shown in FIG. 8C, and a water stream exit angle $\beta$1' in a plane parallel to the X-Z plane, as shown in FIG. 8B.

Figure 9A:
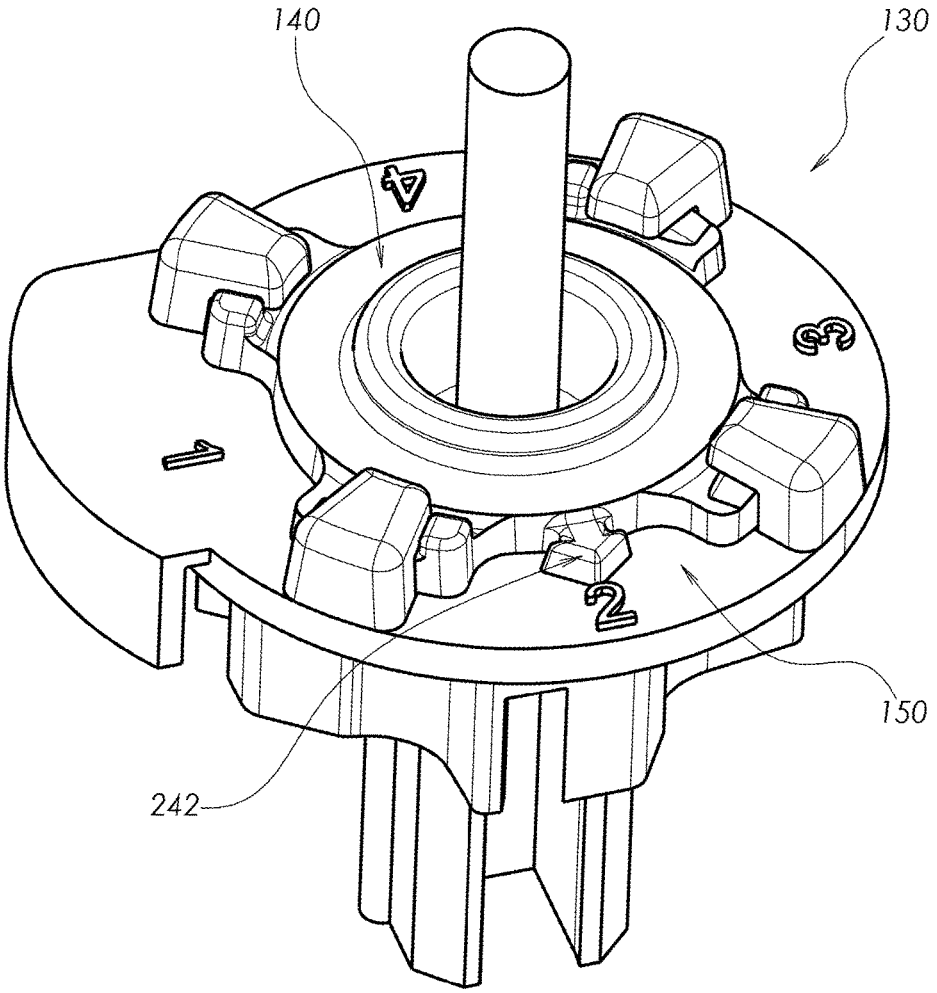
FIGS. 9A, 9B, 9C and 9D are respective simplified pictorial, top planar view, bottom planar view and sectional illustrations of the rotatable water deflector assembly of FIGS. 4A-6L in a second operative orientation, FIG. 9D being taken along lines D-D in FIG. 9C.
Figure 9B:
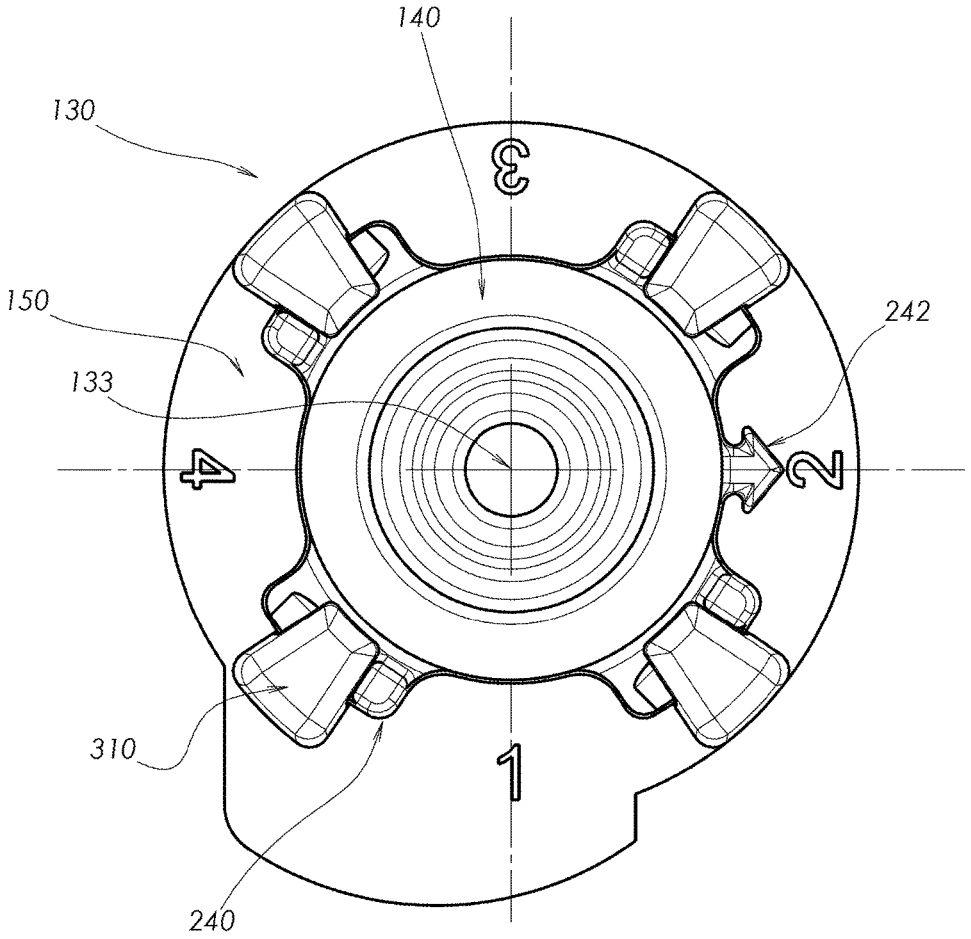
Figure 9C:
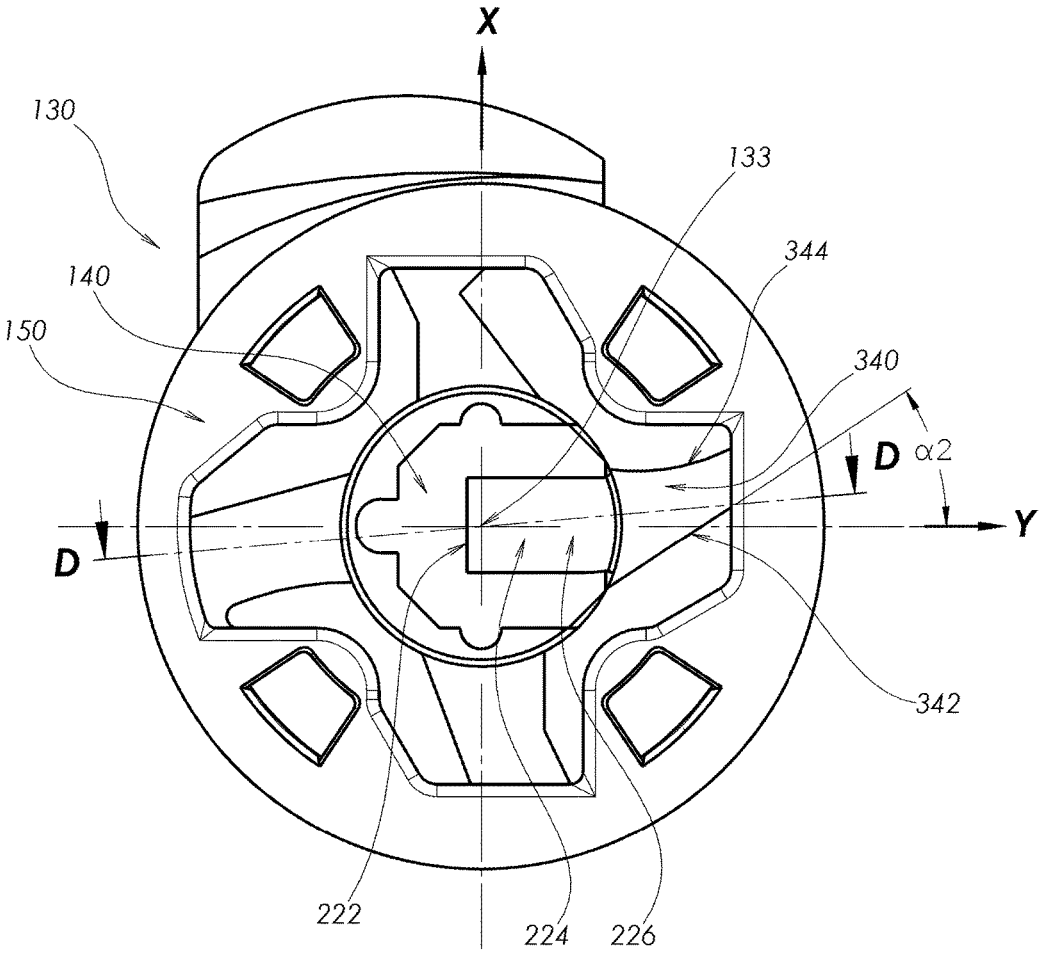
Figure 9D:
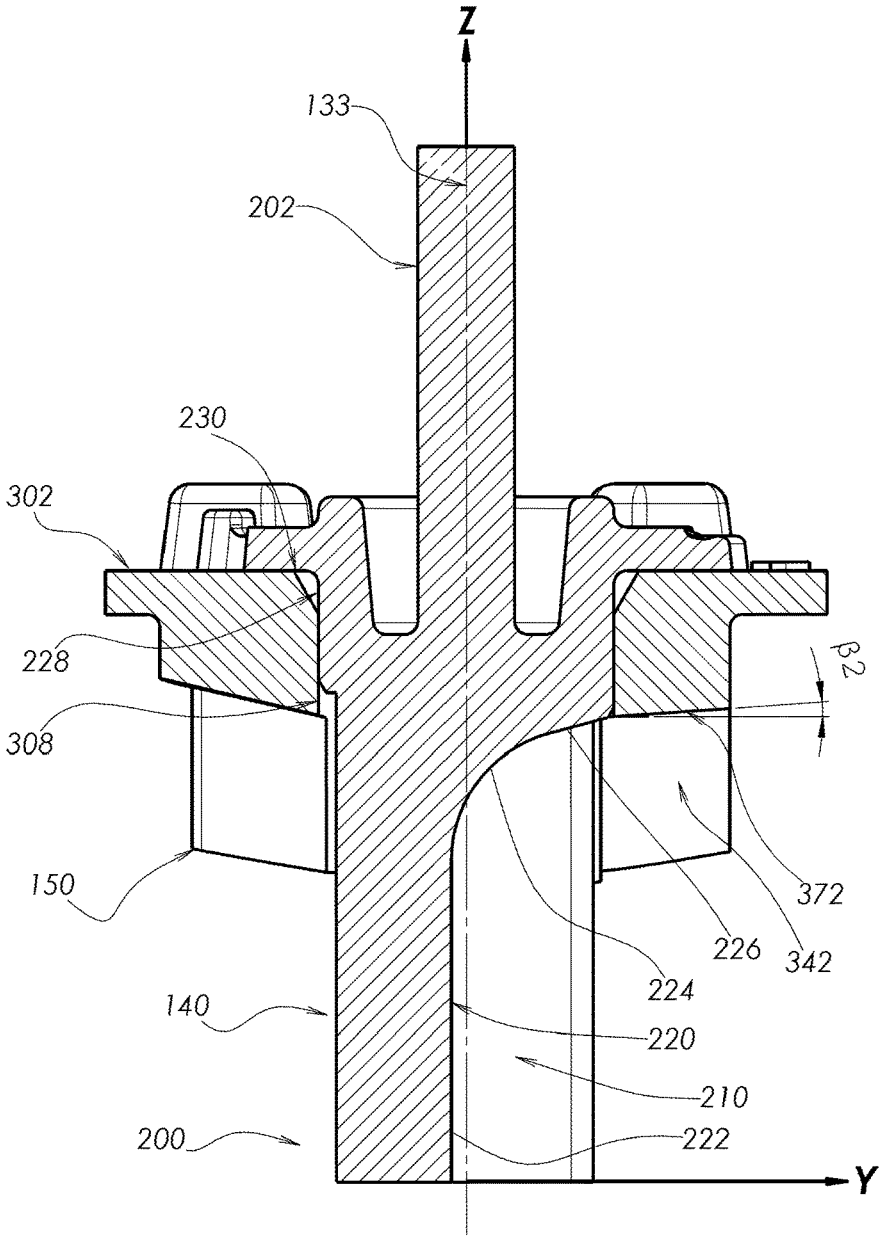

Reference is now made to FIGS. 9A, 9B, 9C and 9D, which are respective simplified pictorial, top planar view, bottom planar view and sectional illustrations of the rotatable water deflector assembly of FIGS. 4A-6L in a second operative orientation, FIG. 9D being taken along lines D-D in FIG. 9C. For the sake of clarity and conciseness, FIGS. 9A-9D are described hereinbelow with respect to a mutually orthogonal Cartesian coordinate system fixed with respect to the second rotatable water path deflector portion 150, wherein the Z axis is coaxial with axis 133 and the X and Y axes extend mutually perpendicularly and perpendicularly to the Z axis.

It is appreciated that the X and Y axes shown in FIG. 9C correspond to the X and Y axes shown in FIGS. 6C and 7C and that second rotatable water path deflector portion 150 has been rotated 90° counter-clockwise from the orientation shown in FIG. 6C, from the perspective of FIG. 9C.

In the second operative orientation shown in FIGS. 9A-9D, pointer 242, as seen particularly in FIGS. 9A & 9B, is directed to an azimuthal location on second rotatable water path deflector portion 150 indicated by the numeral "2". As seen particularly in FIGS. 9C and 9D, the first water path deflector surface 220, which preferably includes initial generally vertical planar surface portion 222, which extends upwardly to curved surface portion 224 and in turn extends upwardly and radially outwardly to upwardly and radially outwardly planar surface portion 226, is azimuthally aligned about axis 133 (Z axis) with:

reaction surface 342, which defines an angle $\alpha$2 in the X-Y plane, as shown in FIG. 9C, with respect to the Y axis; and with planar elevation limiting surface 372, which defines angle $\beta$2 in a plane parallel to the Y-Z plane, as shown in FIG. 9D, with respect to a plane parallel to the X-Y plane.

Figure 10A:
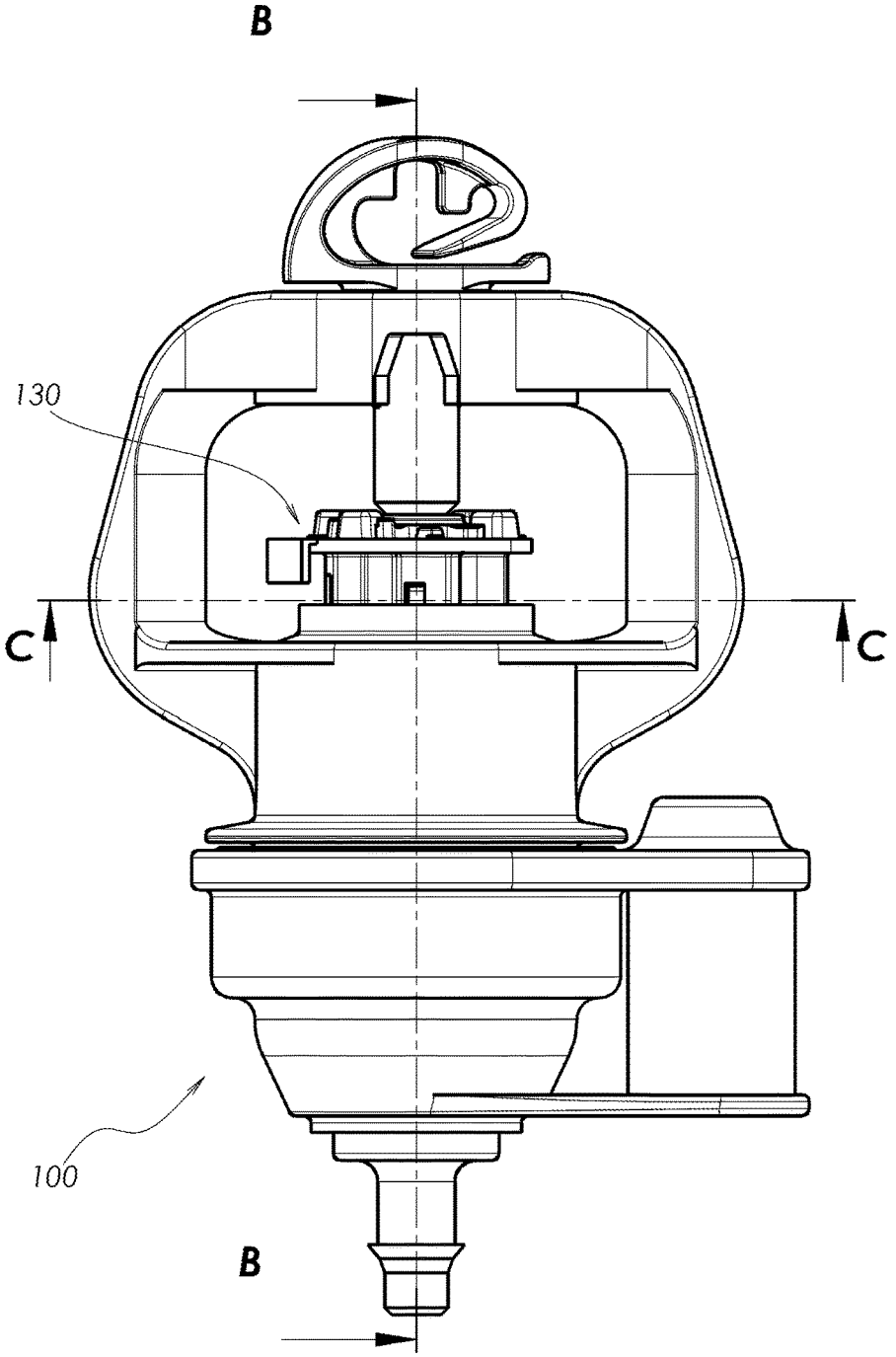
FIGS. 10A, 10B and 10C are respective simplified side view, first sectional view and second sectional view illustrations of the sprinkler of FIGS. 1A-6L when the rotatable water deflector assembly of FIGS. 4A-6L is in the second operative orientation seen in FIGS. 9A-9D, FIGS. 10B and 10C being taken along respective lines B-B and C-C in FIG. 10A.
Figure 10B:
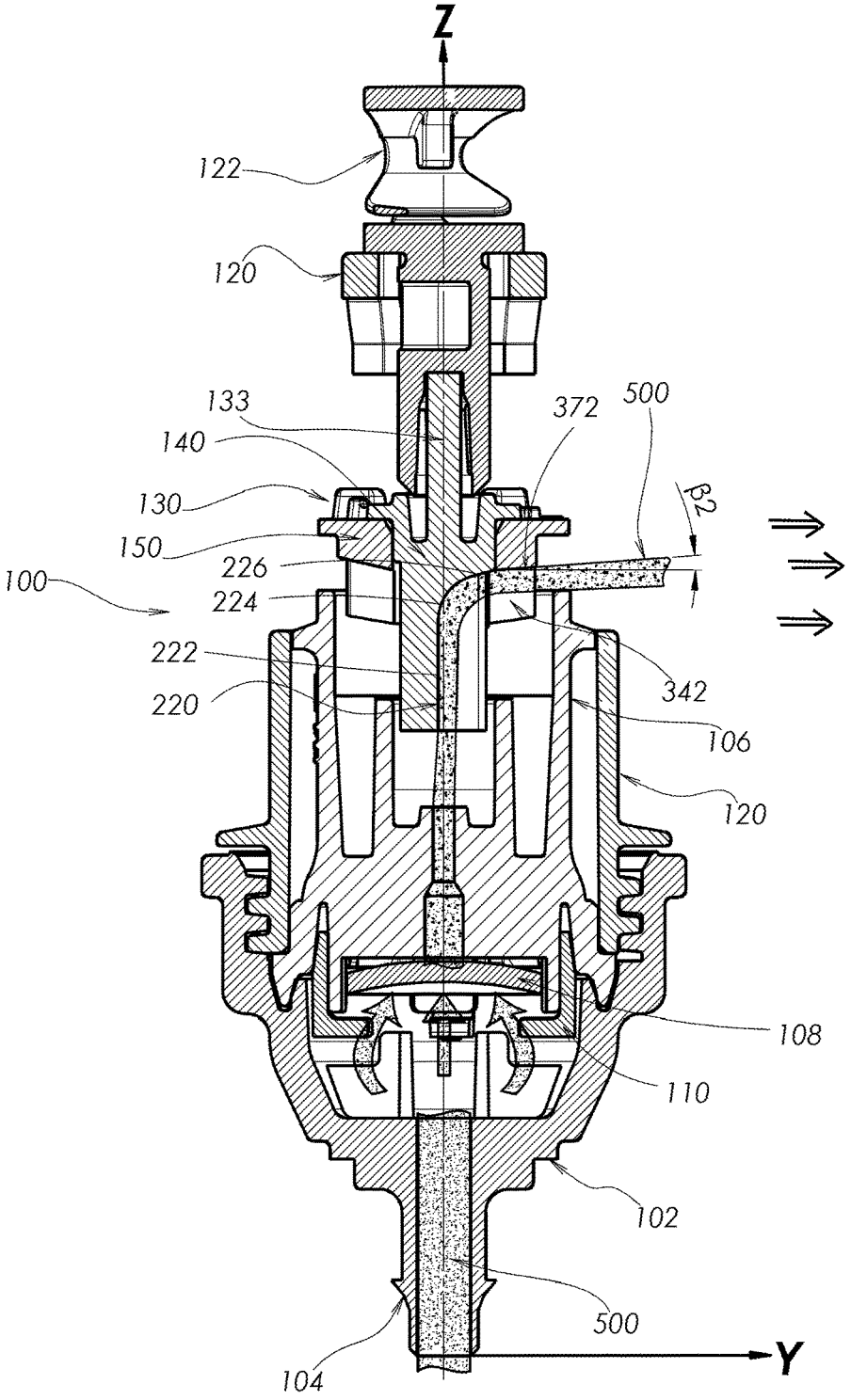
Figure 10C:
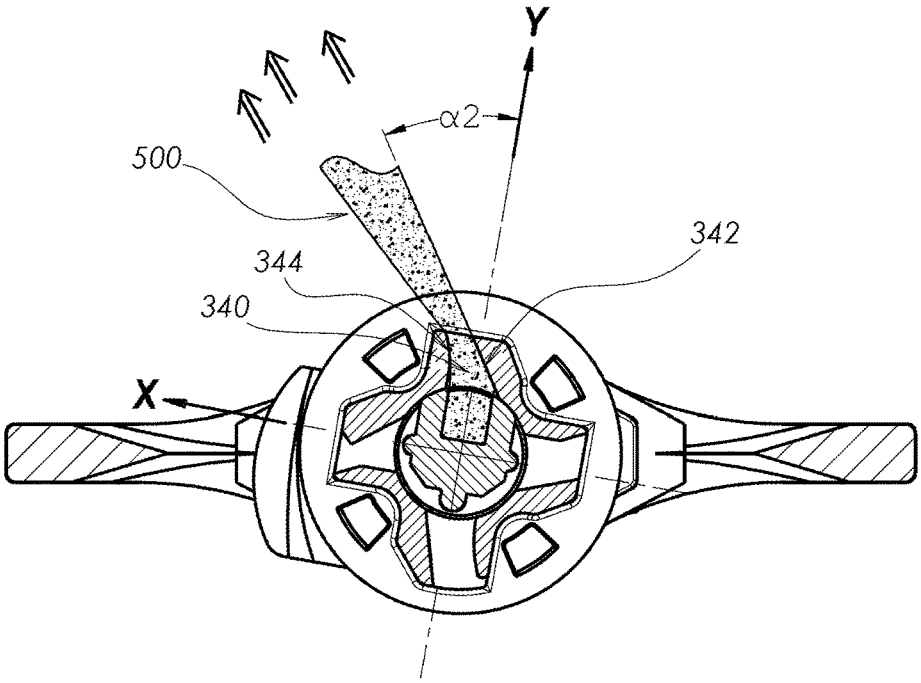

Reference is now made to FIGS. 10A, 10B and 10C, which are respective simplified side view, first sectional view and second sectional view illustrations of the sprinkler of FIGS. 1A-6L when the rotatable water deflector assembly of FIGS. 4A-6L is in the second operative orientation as seen in FIGS. 9A-9D, FIGS. 10B and 10C being taken along respective lines B-B and C-C in FIG. 10A.

As seen in FIGS. 10A-10C, a pressurized water stream 500 flows generally vertically though water inlet connector 104 (FIG. 1B) and nozzle defining portion 106 (FIG. 1B), optionally including flow control membrane 108 (FIG. 1B). The pressurized water stream 500 then engages the first water path deflector surface 220 of the first rotatable water path deflector portion 140. The pressurized water stream 500 flows along initial generally vertical planar surface portion 222 thereof, which extends upwardly to curved surface portion 224 and in turn flows upwardly and radially outwardly to upwardly and radially outwardly planar surface portion 226. The pressurized water stream 500 then engages reaction surface 342 of the second water path deflector 150, which surface 342 defines angle $\alpha$2 in the X-Y plane, as shown in FIG. 10C, with respect to the Y axis and planar elevation limiting surface 372 of the second water path deflector 150, which defines angle $\beta$2 in a plane parallel to the Y-Z plane, as shown in FIG. 10B, with respect to a plane parallel to the X-Y plane.

Figure 11A:
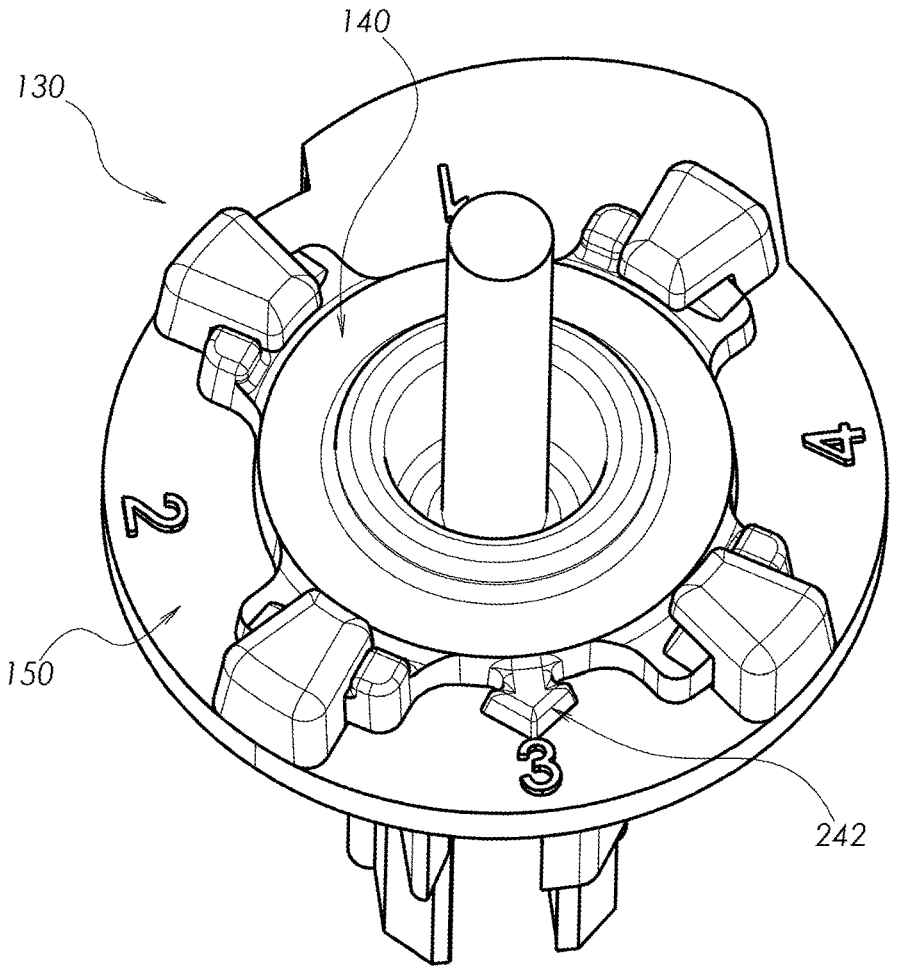
FIGS. 11A, 11B, 11C and 11D are respective simplified pictorial, top planar view, bottom planar view and sectional illustrations of the rotatable water deflector assembly of FIGS. 4A-6L in a third operative orientation, FIG. 11D being taken along lines D-D in FIG. 11C.
Figure 11B:
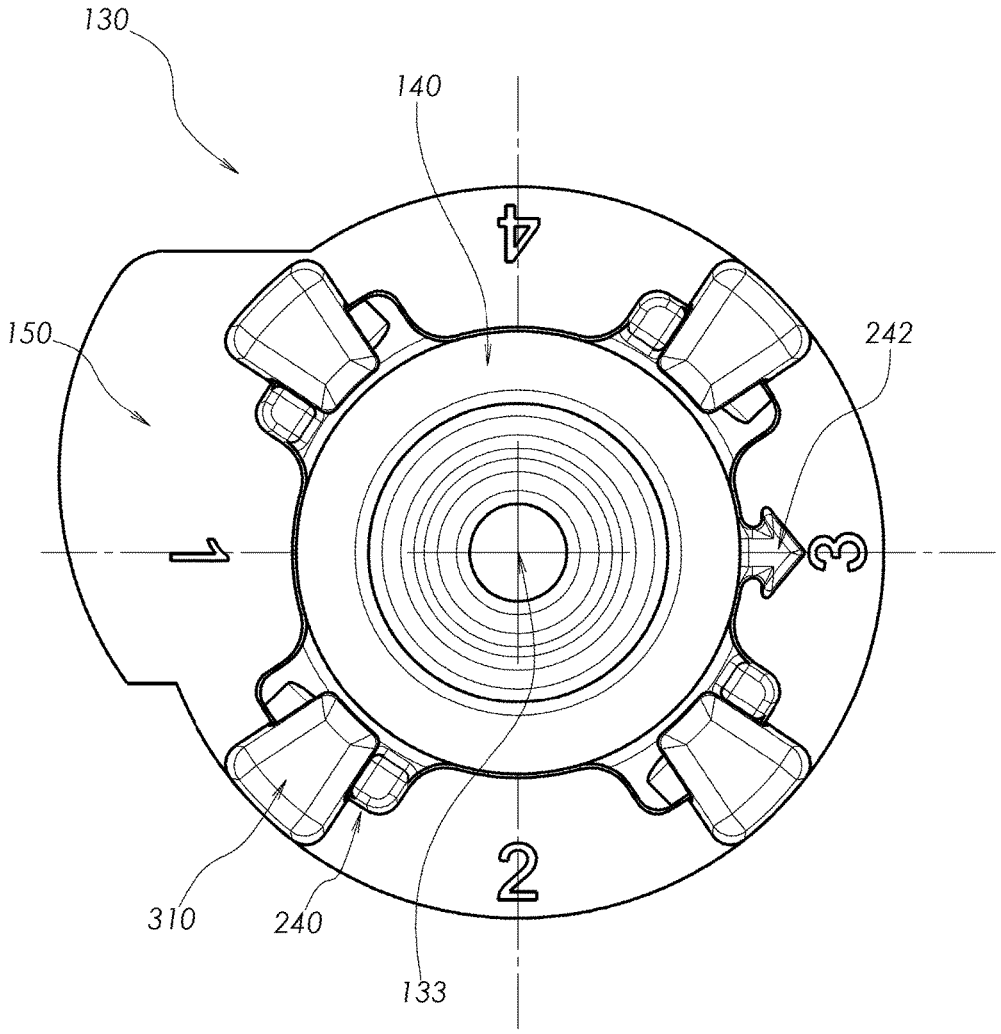
Figure 11C:
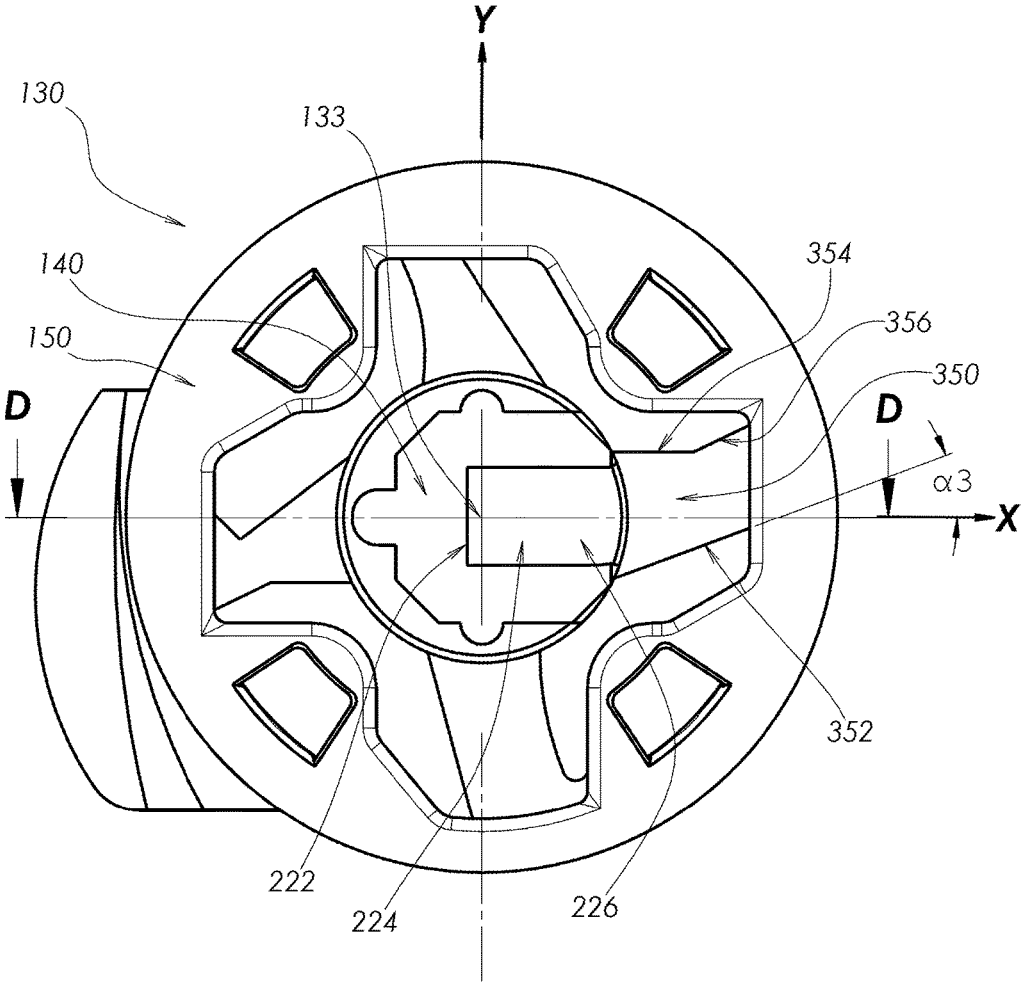
Figure 11D:
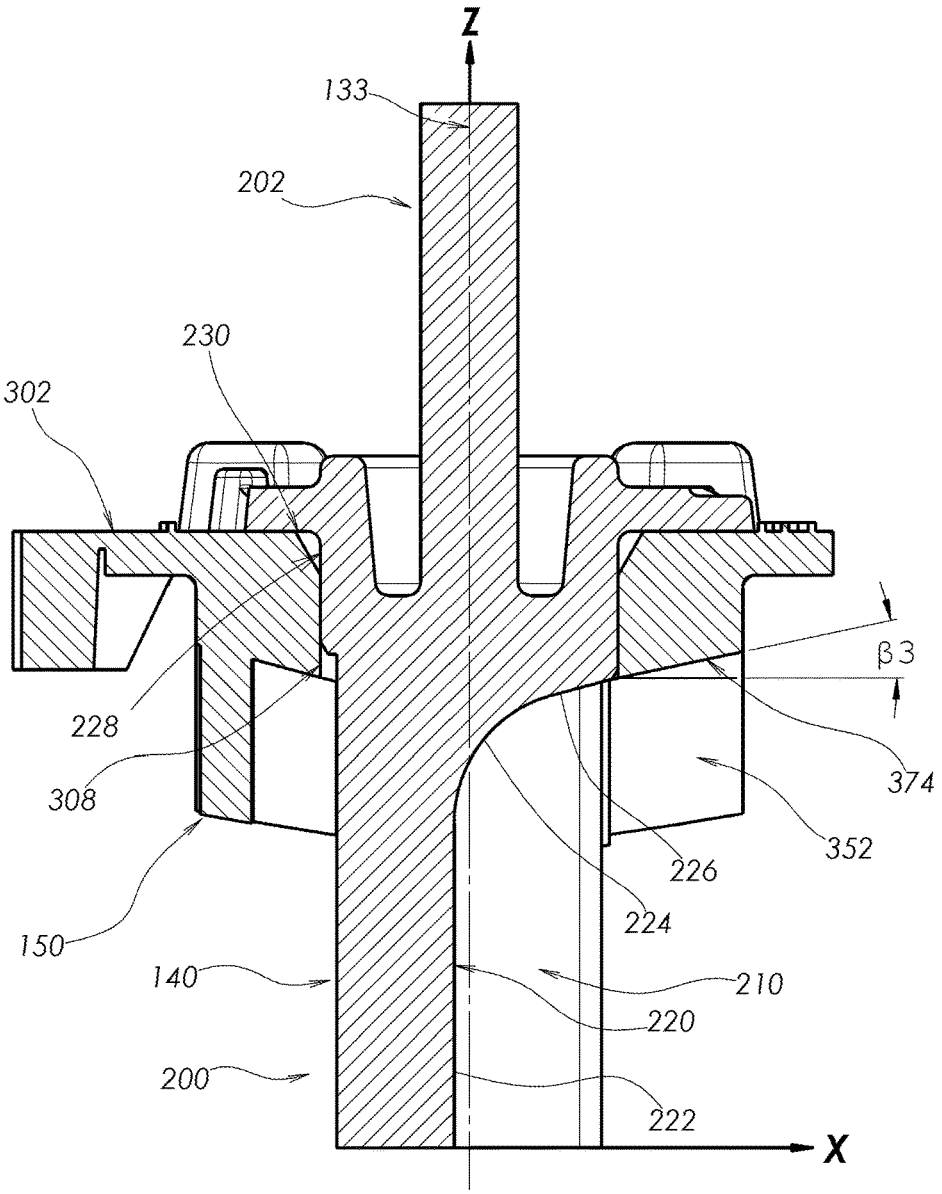

Reference is now made to FIGS. 11A, 11B, 11C and 11D, which are respective simplified pictorial, top planar view, bottom planar view and sectional illustrations of the rotatable water deflector assembly of FIGS. 4A-6L in a third operative orientation, FIG. 11D being taken along lines D-D in FIG. 11C. For the sake of clarity and conciseness, FIGS. 11A-11D are described hereinbelow with respect to a mutually orthogonal Cartesian coordinate system fixed with respect to the second rotatable water path deflector portion 150, wherein the Z axis is coaxial with axis 133 and the X and Y axes extend mutually perpendicularly and perpendicularly to the Z axis.

It is appreciated that the X and Y axes shown in FIG. 11C correspond to the X and Y axes shown in FIGS. 6C, 7C and 9C and that second rotatable water path deflector portion 150 has been rotated 180° from the orientation shown in FIG. 6C, from the perspective of FIG. 11C.

In the third operative orientation shown in FIGS. 11A-11D, pointer 242, as seen particularly in FIGS. 11A & 11B, is directed to an azimuthal location on second rotatable water path deflector portion 150 indicated by the numeral "3". As seen particularly in FIGS. 11C and 11D, the first water path deflector surface 220, which preferably includes initial generally vertical planar surface portion 222, which extends upwardly to curved surface portion 224 and in turn extends upwardly and radially outwardly to upwardly and radially outwardly planar surface portion 226, is azimuthally aligned about axis 133 (Z axis) with:

reaction surface 352, which defines an angle $\alpha 3$ in the X-Y plane, as shown in FIG. 11C, with respect to the X axis; and with planar elevation limiting surface 374, which defines angle $\beta 3$ in a plane parallel to the X-Z plane, as shown in FIG. 11D, with respect to a plane parallel to the X-Y plane.

Figure 12A:
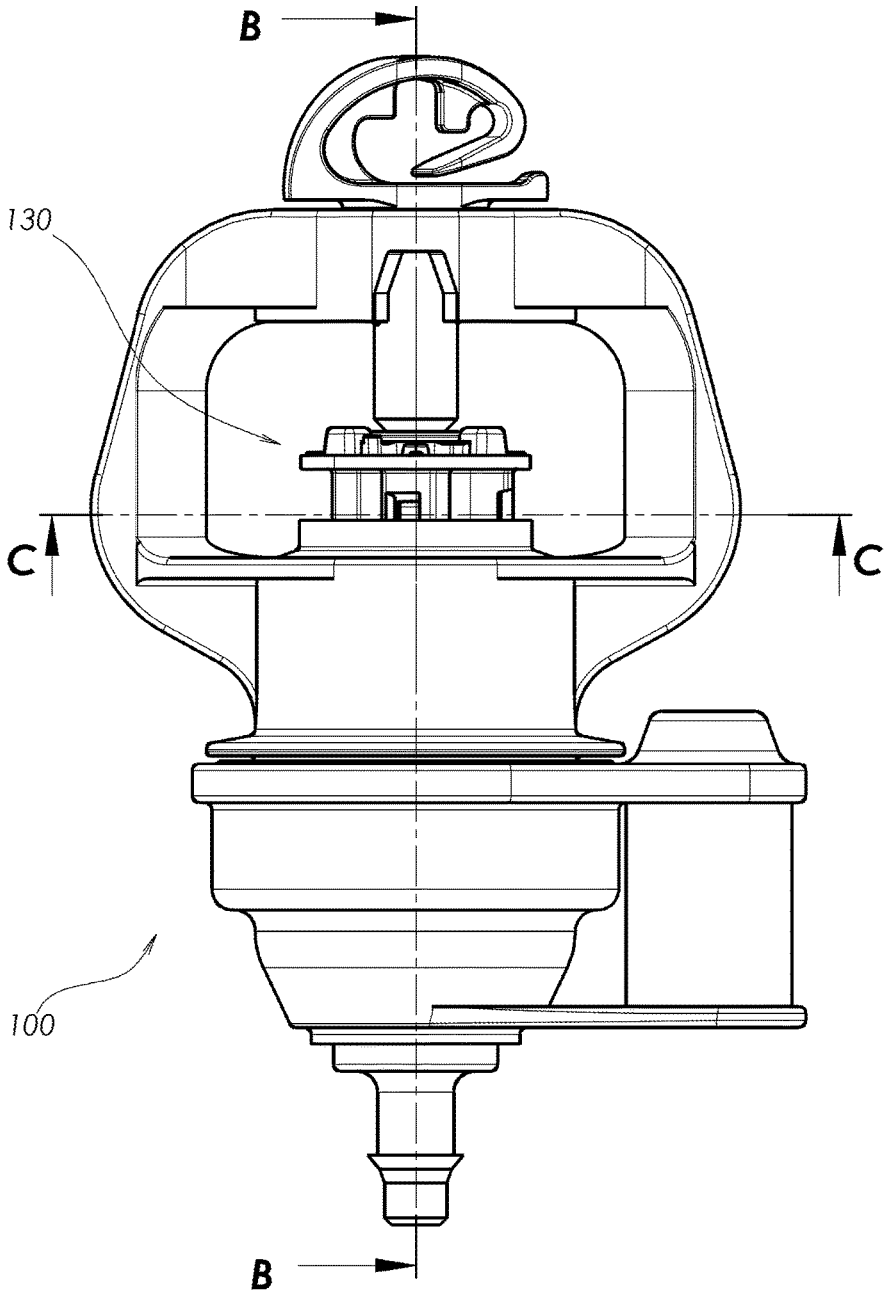
FIGS. 12A, 12B and 12C are respective simplified side view, first sectional view and second sectional view illustrations of the sprinkler of FIGS. 1A-6L when the rotatable water deflector assembly of FIGS. 4A-6L is in the third operative orientation seen in FIGS. 11A-11D, FIGS. 12B and 12C being taken along respective lines B-B and C-C in FIG. 12A.
Figure 12B:
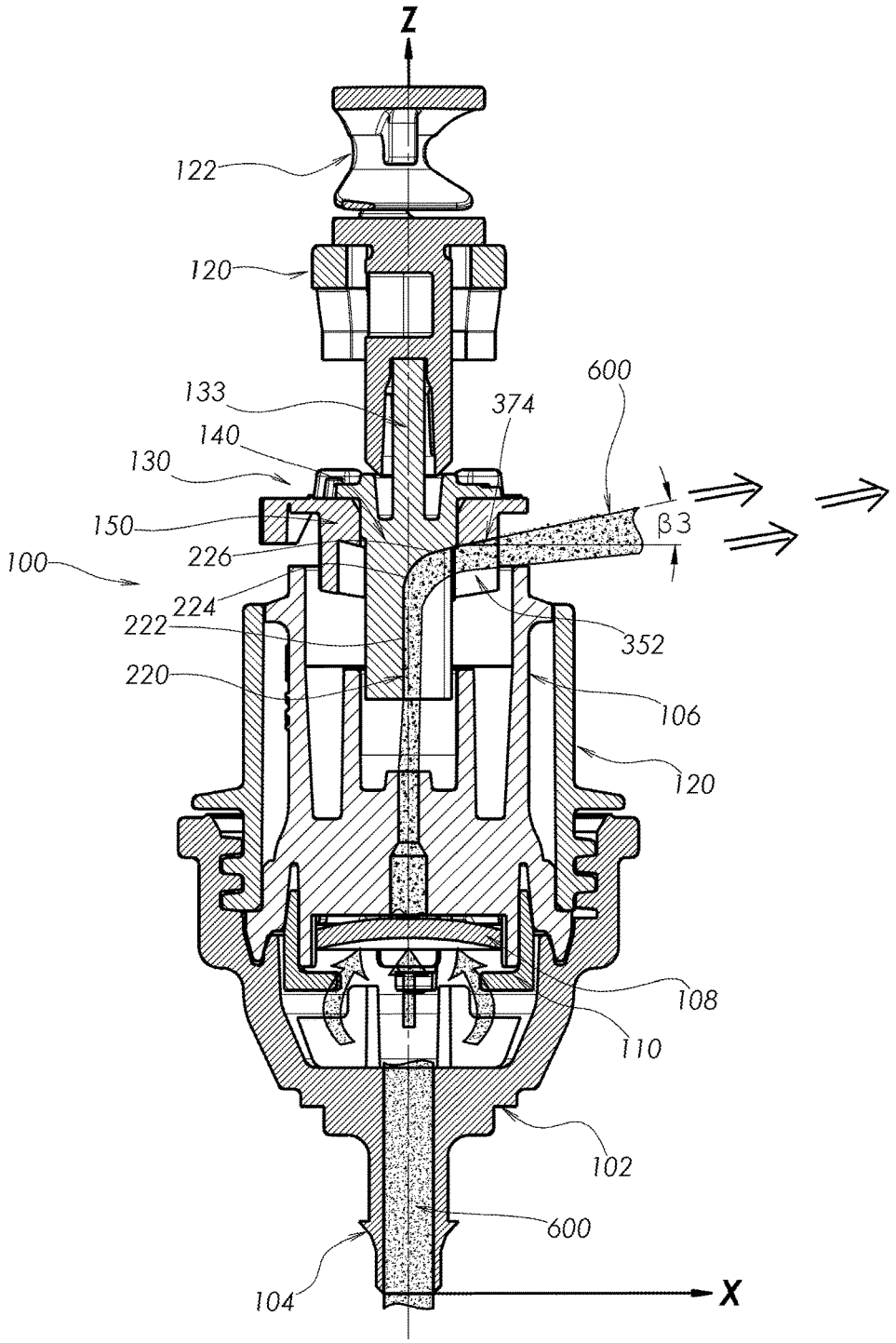
Figure 12C:
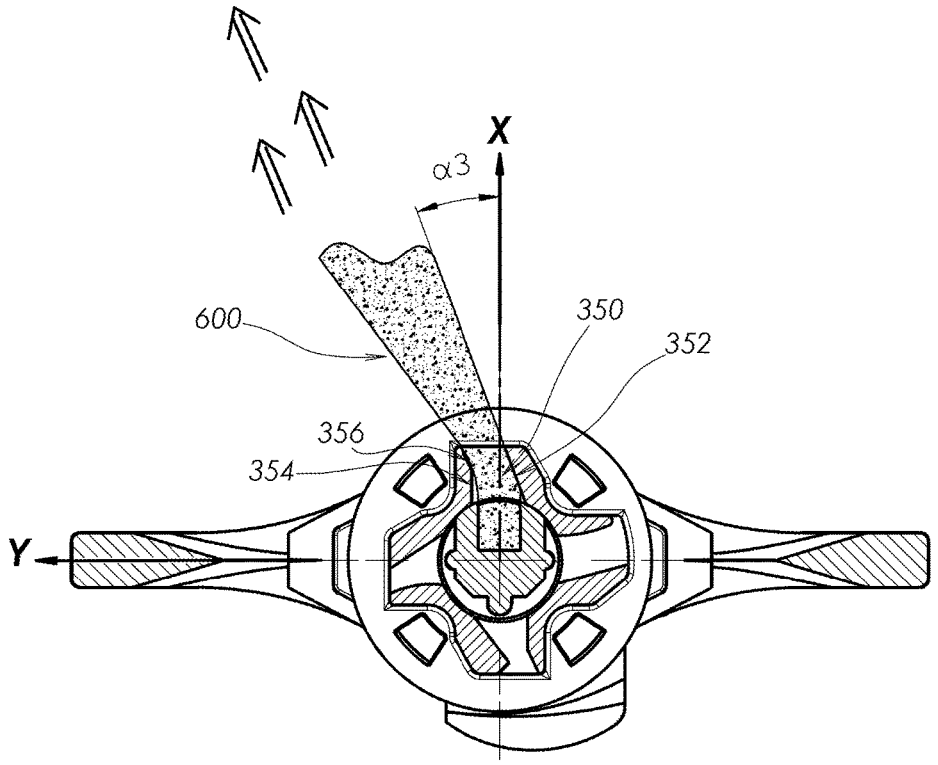

Reference is now made to FIGS. 12A, 12B and 12C, which are respective simplified side view, first sectional view and second sectional view illustrations of the sprinkler of FIGS. 1A-6L when the rotatable water deflector assembly of FIGS. 4A-6L is in the third operative orientation as seen in FIGS. 11A-11D, FIGS. 12B and 12C being taken along respective lines B-B and C-C in FIG. 12A.

As seen in FIGS. 12A-12C, a pressurized water stream 600 flows generally vertically though water inlet connector 104 (FIG. 1B) and nozzle defining portion 106 (FIG. 1B), optionally including flow control membrane 108 (FIG. 1B). The pressurized water stream 600 then engages the first water path deflector surface 220 of the first rotatable water path deflector portion 140. The pressurized water stream 600 flows along initial generally vertical planar surface portion 222 thereof, which extends upwardly to curved surface portion 224 and in turn flows upwardly and radially outwardly to upwardly and radially outwardly planar surface portion 226. The pressurized water stream 600 then engages reaction surface 352 of the second water path deflector 150, which surface 352 defines angle $\alpha 3$ in the X-Y plane, as shown in FIG. 12C, with respect to the X axis and planar elevation limiting surface 374 of the second water path deflector 150, which defines angle $\beta 3$ in a plane parallel to the X-Z plane, as shown in FIG. 12B, with respect to a plane parallel to the X-Y plane.

Figure 13A:
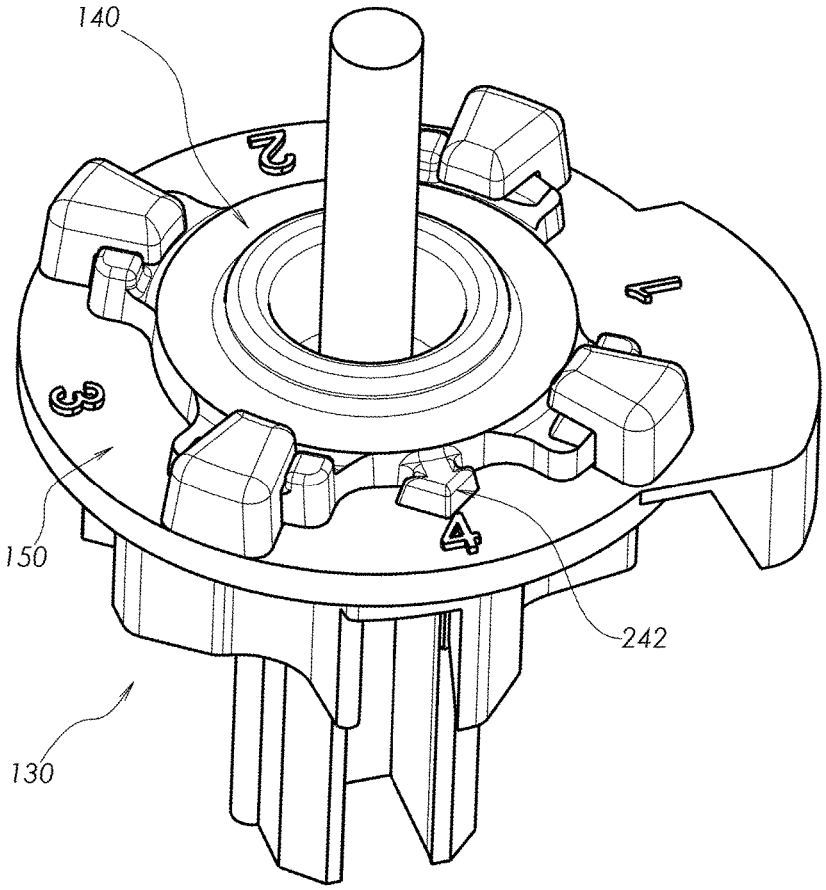
FIGS. 13A, 13B, 13C and 13D are respective simplified pictorial, top planar view, bottom planar view and sectional illustrations of the rotatable water deflector assembly of FIGS. 4A-6L in a fourth operative orientation, FIG. 13D being taken along lines D-D in FIG. 13C.
Figure 13B:
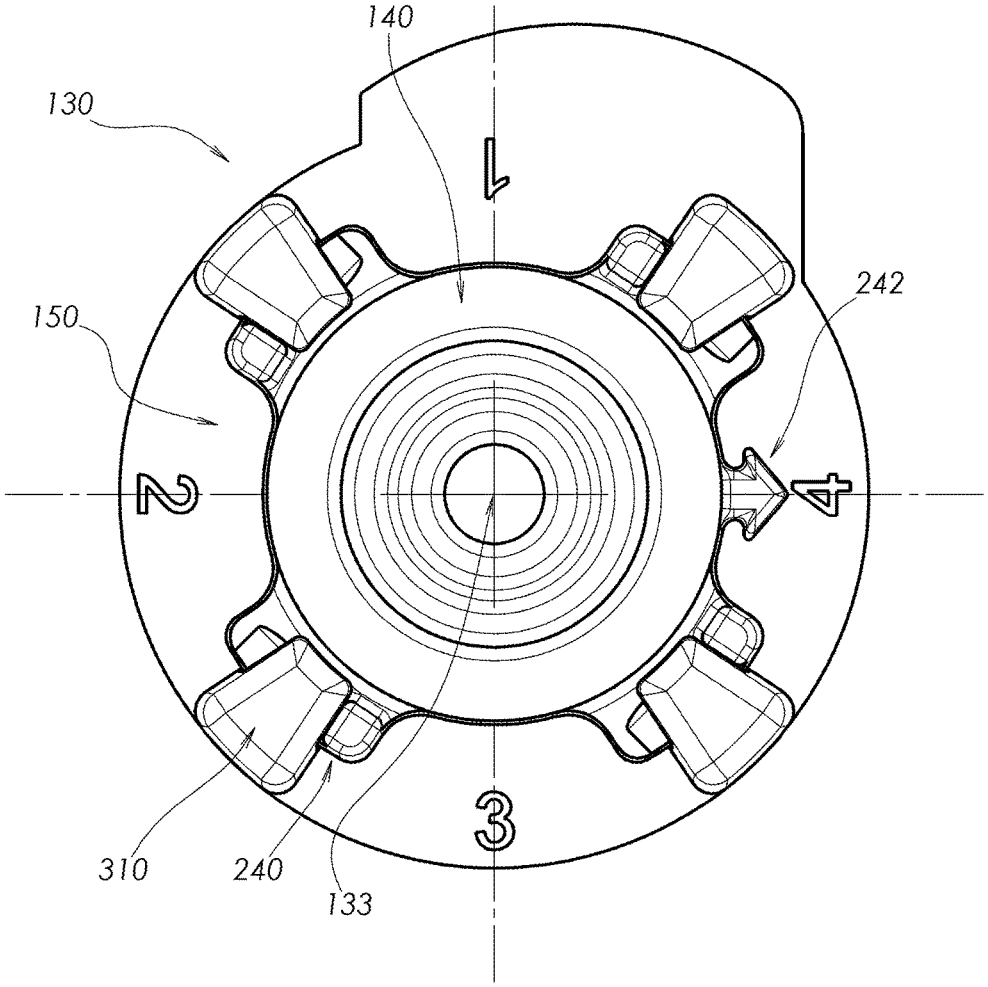
Figure 13C:
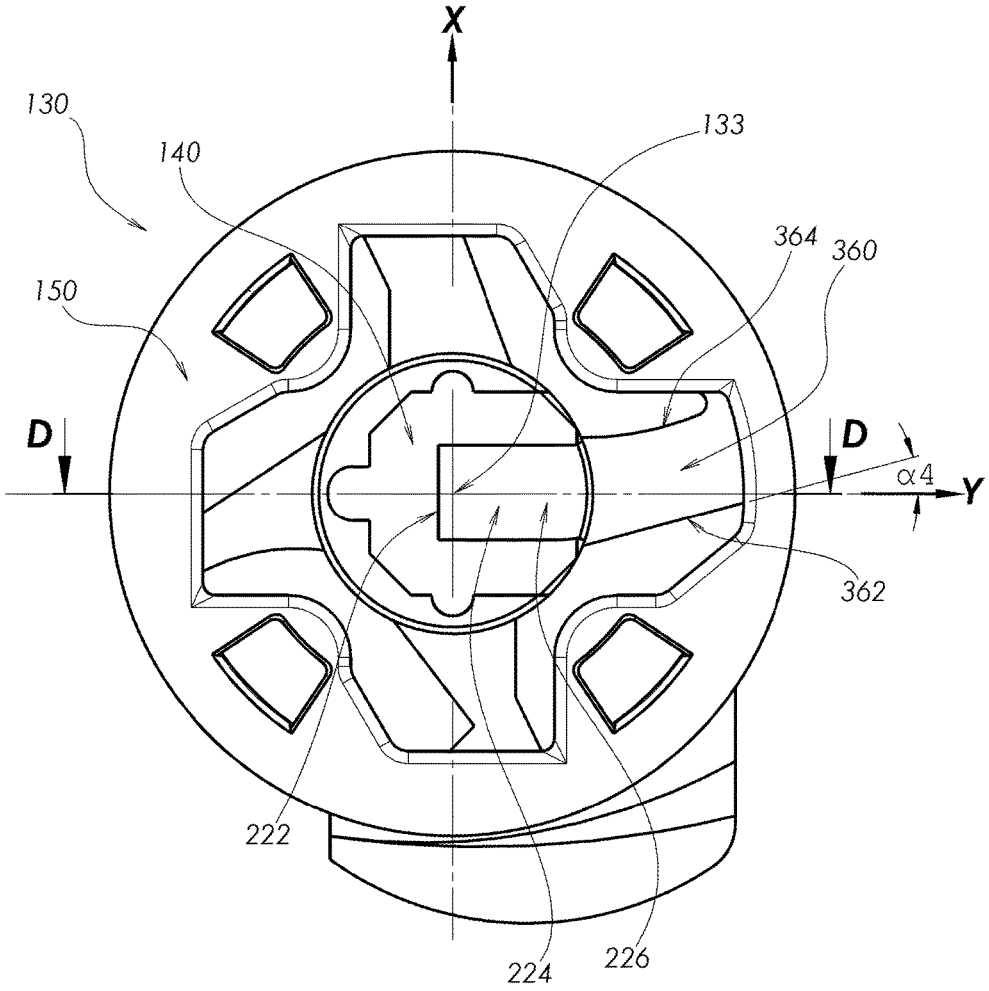
Figure 13D:
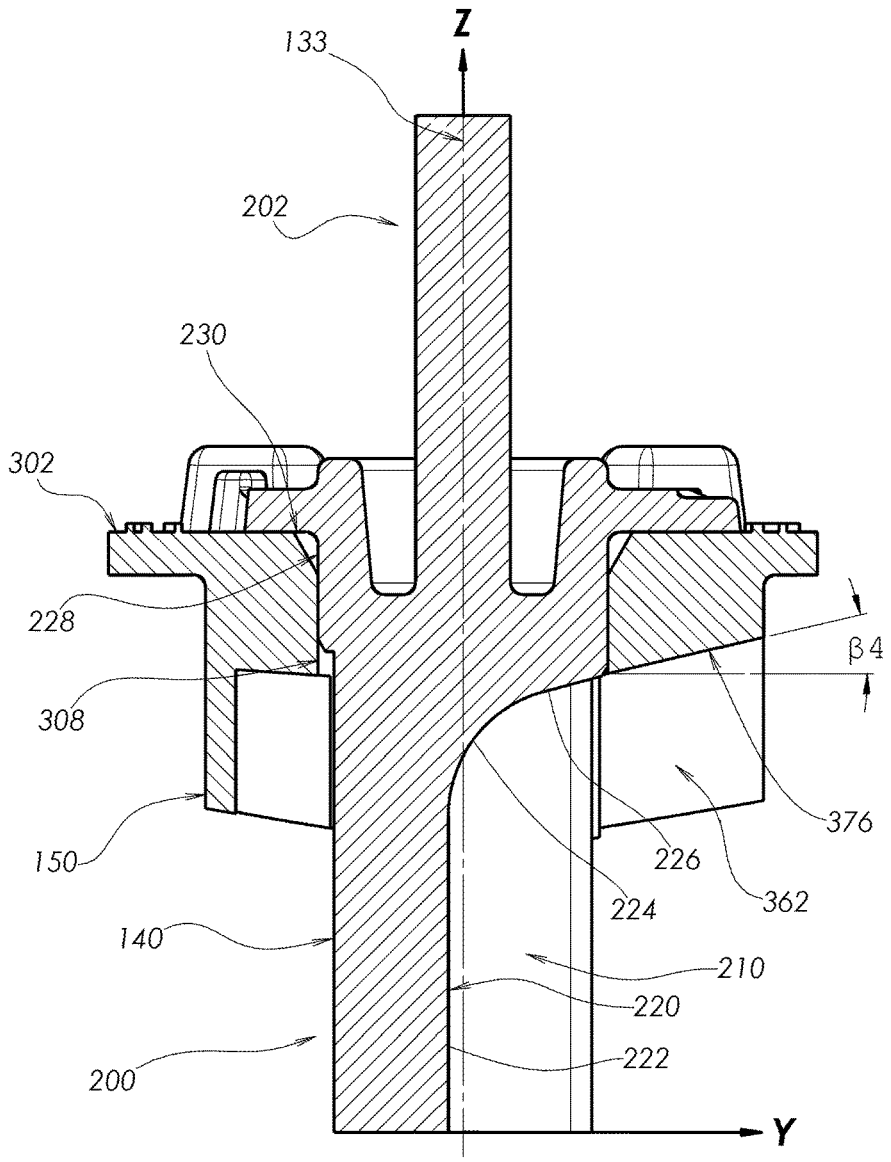

Reference is now made to FIGS. 13A, 13B, 13C and 13D, which are respective simplified pictorial, top planar view, bottom planar view and sectional illustrations of the rotatable water deflector assembly of FIGS. 4A-6L in a fourth operative orientation, FIG. 13D being taken along lines D-D in FIG. 13C. For the sake of clarity and conciseness, FIGS. 13A-13D are described hereinbelow with respect to a mutually orthogonal Cartesian coordinate system fixed with respect to the second rotatable water path deflector portion 150, wherein the Z axis is coaxial with axis 133 and the X and Y axes extend mutually perpendicularly and perpendicularly to the Z axis.

It is appreciated that the X and Y axes shown in FIG. 13C correspond to the X and Y axes shown in FIGS. 6C, 7C, 9C and 11C and that second rotatable water path deflector portion 150 has been rotated 90° clockwise from the orientation shown in FIG. 6C, from the perspective of FIG. 13C.

In the fourth operative orientation shown in FIGS. 13A-13D, pointer 242, as seen particularly in FIGS. 13A & 13B, is directed to an azimuthal location on second rotatable water path deflector portion 150 indicated by the numeral "4". As seen particularly in FIGS. 13C and 13D, the first water path deflector surface 220, which preferably includes initial generally vertical planar surface portion 222, which extends upwardly to curved surface portion 224 and in turn extends upwardly and radially outwardly to upwardly and radially outwardly planar surface portion 226, is azimuthally aligned about axis 133 (Z axis) with:

reaction surface 362, which defines an angle $\alpha 4$ in the X-Y plane, as shown in FIG. 13C, with respect to the Y axis; and with planar elevation limiting surface 376, which defines angle $\beta 4$ in a plane parallel to the Y-Z plane, as shown in FIG. 13D, with respect to a plane parallel to the X-Y plane.

Figure 14A:
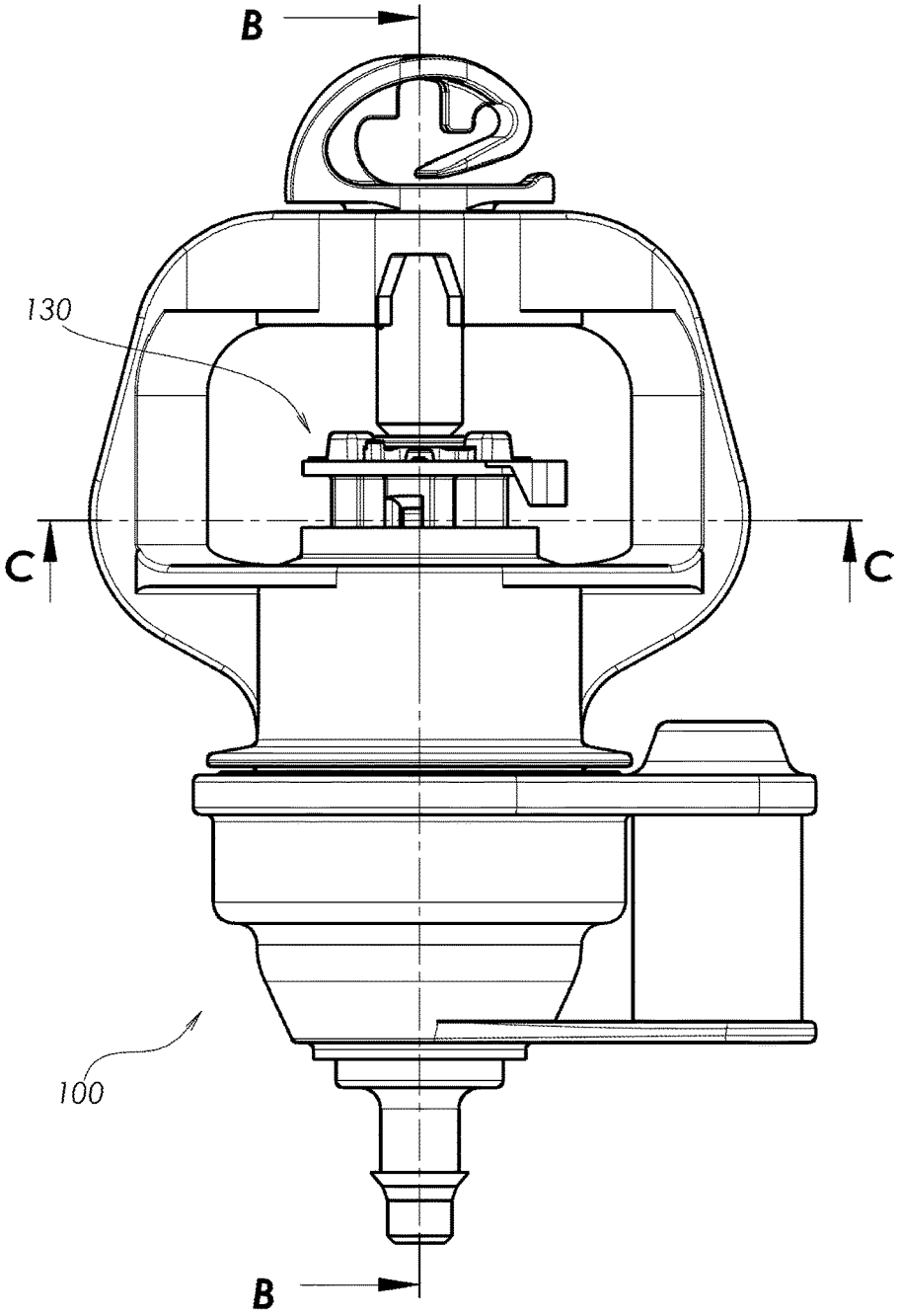
FIGS. 14A, 14B and 14C are respective simplified side view, first sectional view and second sectional view illustrations of the sprinkler of FIGS. 1A-6L when the rotatable water deflector assembly of FIGS. 4A-6L is in the fourth operative orientation seen in FIGS. 13A-13D, FIGS. 14B and 14C being taken along respective lines B-B and C-C in FIG. 14A.
Figure 14B:
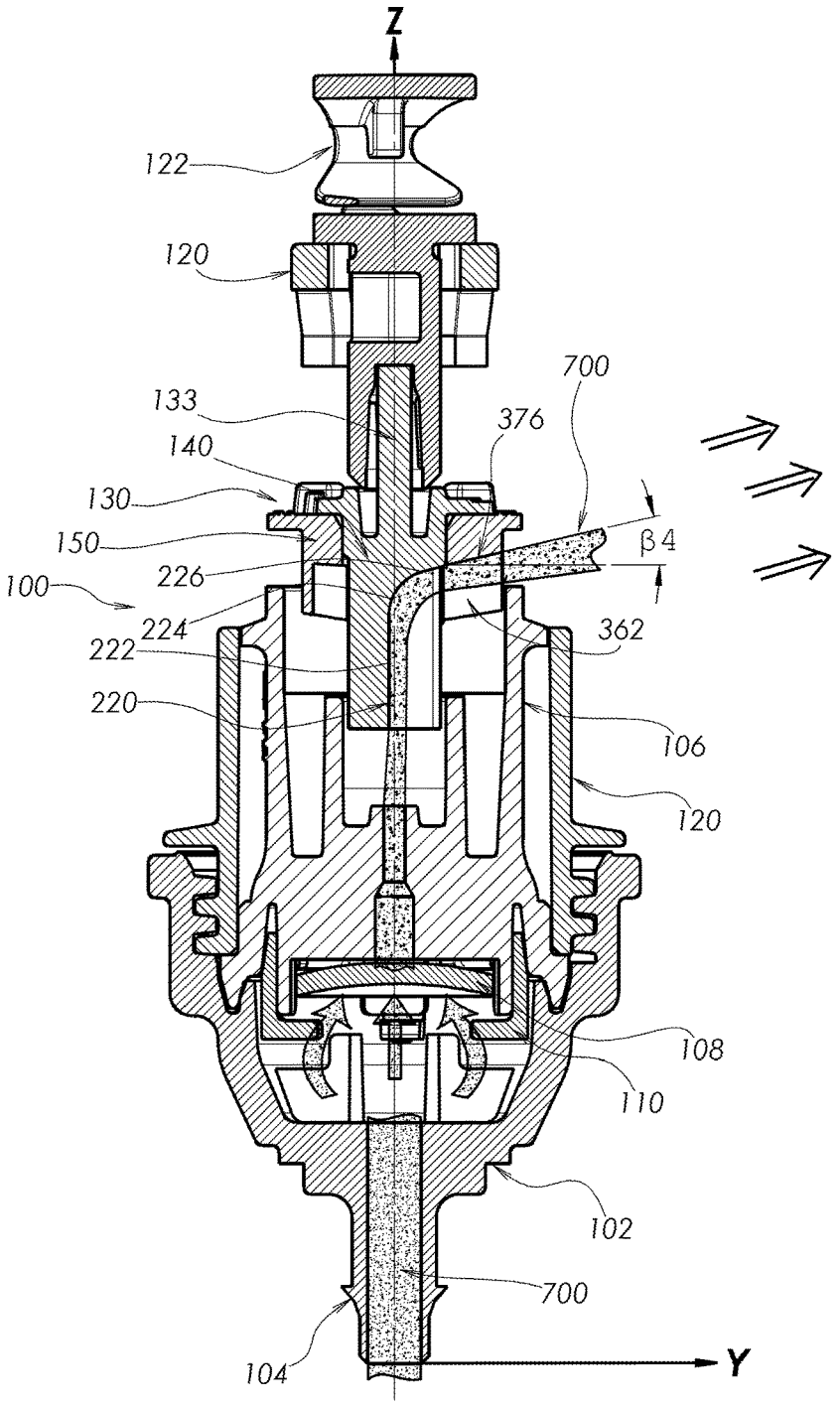
Figure 14C:
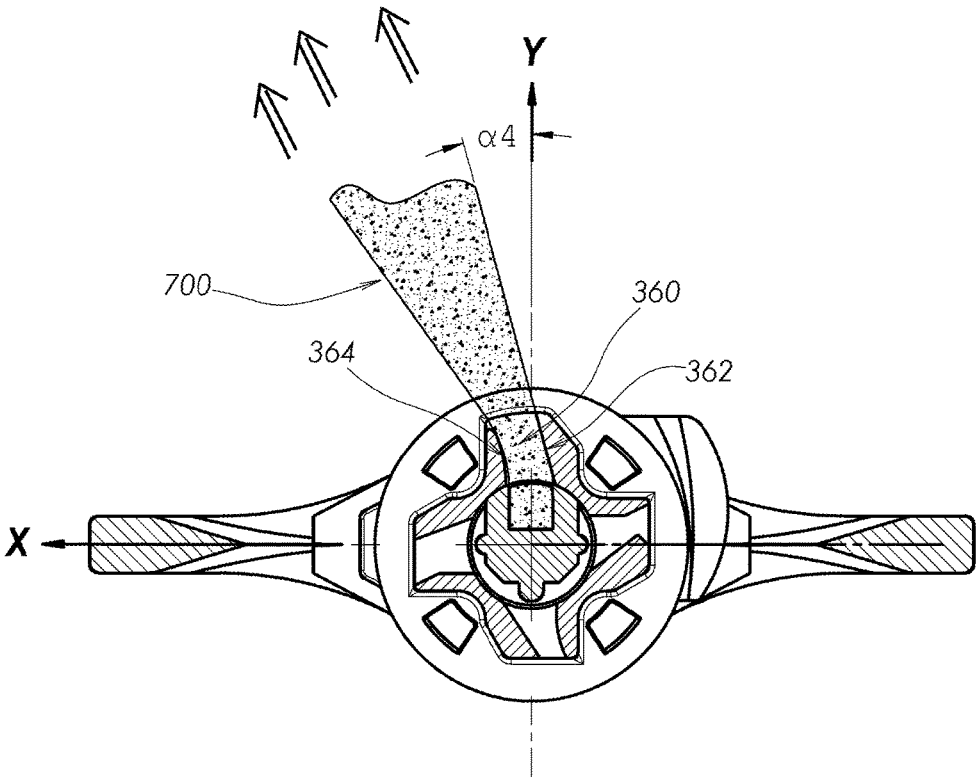

Reference is now made to FIGS. 14A, 14B and 14C, which are respective simplified side view, first sectional view and second sectional view illustrations of the sprinkler of FIGS. 1A-6L when the rotatable water deflector assembly of FIGS. 4A-6L is in the fourth operative orientation as seen in FIGS. 13A-13D, FIGS. 14B and 14C being taken along respective lines B-B and C-C in FIG. 14A.

As seen in FIGS. 14A-14C, a pressurized water stream 700 flows generally vertically though water inlet connector 104 (FIG. 1B) and nozzle defining portion 106 (FIG. 1B), optionally including flow control membrane 108 (FIG. 1B). The pressurized water stream 700 then engages the first water path deflector surface 220 of the first rotatable water path deflector portion 140. The pressurized water stream 700 flows along initial generally vertical planar surface portion 222 thereof, which extends upwardly to curved surface portion 224 and in turn flows upwardly and radially outwardly to upwardly and radially outwardly planar surface portion 226. The pressurized water stream 700 then engages reaction surface 362 of the second water path deflector 150, which surface 362 defines angle $\alpha 4$ in the X-Y plane, as shown in FIG. 14C, with respect to the X axis and planar elevation limiting surface 376 of the second water path deflector 150, which defines angle $\beta 4$ in a plane parallel to the Y-Z plane, as shown in FIG. 14B, with respect to a plane parallel to the X-Y plane.

It is appreciated that angles $\alpha 1$, $\alpha 1'$, $\alpha 2$, $\alpha 3$, $\alpha 4$ and angles $\beta 1$, $\beta 1'$, $\beta 2$, $\beta 3$, $\beta 4$ may be any suitable angles and are selected based on a specific water distribution pattern/profile/throw range desired. The combination of angles selected for each of the four operative orientations preferably defines a set of water distribution patterns/profiles/throw ranges selected for a specific irrigation application.

It will be appreciated by persons skilled in the art that the present invention is not limited to what has been particularly shown and described hereinabove. Rather the present invention includes combinations and sub-combinations of features described and shown above as well as modifications and variations thereof which are not in the prior art.

The invention claimed is:

1. A rotatable sprinkler including:

a water outlet nozzle providing a pressurized axial stream of water along a nozzle axis; and a rotatable water deflector assembly, downstream of said water outlet nozzle and receiving said pressurized axial stream of water therefrom, said rotatable water deflector assembly being rotated during sprinkler operation by said pressurized axial stream of water about a rotatable water path deflector assembly axis, said rotatable water deflector assembly including:

a first rotatable water path deflector portion; and a second rotatable water path deflector portion, which is user rotatable relative to said first rotatable water path deflector portion about a second rotatable water path deflector axis, thereby enabling user selection of at least one water distribution parameter, said first rotatable water path deflector portion including a first rotatable water path deflector generally planar portion, said first rotatable water path deflector generally planar portion being formed with a plurality of radially-extending protrusions.

2. A rotatable sprinkler according to claim 1 and wherein said rotatable water path deflector assembly axis and said second rotatable water path deflector axis are coaxial.

3. A rotatable sprinkler according to claim 1 and wherein said nozzle axis, said rotatable water path deflector assembly axis and said second rotatable water path deflector axis are all coaxial.

4. A rotatable sprinkler according to claim 1 and also comprising a base portion, which includes a water inlet connector, and a nozzle defining portion which defines said water outlet nozzle.

5. A rotatable sprinkler according to claim 4 and also comprising a membrane arranged upstream of said nozzle defining portion.

6. A rotatable sprinkler according to claim 4 and also comprising a body portion, which retains said nozzle defining portion, and a top portion, mounted onto said body portion.

7. A rotatable sprinkler according to claim 1 and wherein:

said first rotatable water path deflector portion also includes:

a bottom, generally cylindrical portion; and an upper axle-defining portion; and said first rotatable water path deflector generally planar portion is arranged between said generally cylindrical portion and said axle-defining portion.

8. A rotatable sprinkler according to claim 7 and wherein said bottom, generally cylindrical portion defines:

a first water pathway having mutually spaced planar side surfaces and a first water path deflector surface, which includes an initial generally vertical planar surface portion, which extends vertically to a curved surface portion, said curved surface portion extending vertically and radially outwardly to an upwardly and radially outwardly planar surface portion and a generally circular cylindrical portion extending from a location vertically spaced from said planar surface portion to a surface of said first rotatable water path deflector generally planar portion.

9. A rotatable sprinkler according to claim 1 and wherein said first rotatable water path deflector generally planar portion is also formed with a a pointer.

10. A rotatable sprinkler according to claim 1 and wherein said radially-extending protrusions are each formed on a top surface thereof with a pair of engagement protrusions for user-changeable, selectable azimuth engagement of said second rotatable water path deflector portions.

11. A rotatable sprinkler according to claim 10 and wherein said engagement protrusions limit the counterclockwise travel of said second rotatable water path deflector portions relative to said first rotatable water path deflector portion at each of a plurality of user selectable azimuthal relative orientations thereof.

12. A rotatable sprinkler according to claim 1 and wherein said second rotatable water path deflector portion includes a second rotatable water path deflector generally planar portion, defining a generally flat top surface and a generally flat bottom surface, and a plurality of depending portions, extending downwardly from said generally flat bottom surface, said second rotatable water path deflector generally planar portion being formed with a central aperture, centered about said second rotatable water path deflector axis.

13. A rotatable sprinkler according to claim 12 and wherein said second rotatable water path deflector portion also comprises a plurality of retaining protrusions, extending upwardly from said generally flat top surface and being operative for rotatably displaceable engagement with said first rotatable water path deflector portion.

14. A rotatable sprinkler according to claim 12 and wherein said second rotatable water path deflector generally planar portion includes a radially outwardly extending portion having a downwardly depending portion, which defines a curved inner surface, which defines a secondary azimuthal water deflection and reaction surface.

15. A rotatable sprinkler according to claim 14 and wherein said secondary azimuthal water deflection and reaction surface is slightly curved and is arranged to be tangent to an imaginary circle about said second rotatable water path deflector axis only along a small portion of the extent of said secondary azimuthal water deflection and reaction surface.

16. A rotatable sprinkler according to claim 1 and wherein said second rotatable water path deflector portion defines a plurality of user-selectable pressurized water flow pathways.

17. A rotatable sprinkler according to claim 16 and wherein:

said second rotatable water path deflector portion includes a second rotatable water path deflector generally planar portion; and said plurality of user-selectable pressurized water flow pathways include at least two of:

a first user-selectable pressurized water flow pathway defined by a first reaction surface and at least one additional pathway surface, wherein said first reaction surface defines an angle $\alpha 1$ in an X-Y plane, parallel to said second rotatable water path deflector generally planar portion, with respect to an X axis thereof, such that pressurized water engages a curved inner surface, which defines a downstream azimuthal water deflection and reaction surface and defines an angle $\alpha 1'$ in said X-Y plane with respect to a line parallel to a Y axis of said X-Y plane;

a second user-selectable pressurized water flow pathway defined by a second reaction surface and at least one additional pathway surface, wherein said second reaction surface defines an angle $\alpha 2$ in said X-Y plane, different from said angle $\alpha 1$, with respect to said Y axis;

a third user-selectable pressurized water flow pathway defined by a third reaction surface and at least one additional pathway surface, wherein said third reaction surface defines an angle α3 in said X-Y plane, different from said angle α1 and said angle α2, with respect to said X axis; and a fourth user-selectable pressurized water flow pathway defined by a fourth reaction surface and at least one additional pathway surface, wherein said fourth reaction surface defines an angle α4, different from said angle α1, said angle α2 and said angle α3, with respect to said Y axis.

18. A rotatable sprinkler according to claim 17 and wherein at least one of said first, second, third and fourth user-selectable pressurized water flow pathways also defines an elevation limiting surface.

19. A rotatable sprinkler according to claim 18 and wherein at least one of said first, second, third and fourth user-selectable pressurized water flow pathways also defines an elevation limiting surface in which:

said first user-selectable pressurized water flow pathway is also defined by a first planar elevation limiting surface, which defines an angle β1, in an X-Z plane, perpendicular to said X-Y plane, with respect to a plane parallel to a Y-Z plane, perpendicular to said X-Y plane and to said X-Z plane, and a downstream azimuthal water deflection and reaction surface, which defines an angle β1' with respect to a plane parallel to said Y-Z plane in a plane parallel to said X-Z plane;

said second user-selectable pressurized water flow pathway is also defined by a second planar elevation limiting surface, which defines an angle β2, different from said angle β1, with respect to a plane parallel to said X-Y plane in a plane parallel to said Y-Z plane;

said third user-selectable pressurized water flow pathway is also defined by a third planar elevation limiting surface, which defines an angle β3, different from said angle β2 and said angle β1, with respect to a plane parallel to said X-Y plane in a plane parallel to said X-Z plane; and said fourth user-selectable pressurized water flow pathway is also defined by a fourth planar elevation limiting surface, which defines an angle β4, different from said angle β3, said angle β2 and said angle β1, with respect to a plane parallel to the X-Y plane in a plane parallel to the Y-Z plane.

20. A rotatable sprinkler according to claim 1 and wherein:

said second rotatable water path deflector portion includes a second rotatable water path deflector generally planar portion defining an X-Y plane parallel thereto and an X-Z plane and a Y-Z plane perpendicular thereto; and said sprinkler has at least two of first, second, third and fourth operative orientations in which:

in said first operative orientation a pointer is directed to a first azimuthal location on said second rotatable water path deflector portion, indicated by a first indicium, and a pressurized water stream extends upwardly and radially outwardly into engagement with:

a first reaction surface, which defines an angle α1 in said X-Y plane, with respect to an X axis thereof;

a first planar elevation limiting surface, which defines an angle β1 in a plane parallel to said X-Z plane, with respect to a plane parallel to said X-Y plane, and a curved downstream azimuthal water deflection and reaction surface, which defines a water stream exit angle α1', different from said angle α1, in said X-Y plane, with respect to a line parallel to a Y axis, and a water stream exit angle β1' in a plane parallel to said X-Z plane, with respect to a plane parallel to said Y-Z plane;

in said second operative orientation a pointer is directed to a second azimuthal location on said second rotatable water path deflector portion, indicated by a second indicium, and a pressurized water stream extends upwardly and radially outwardly into engagement with:

a second reaction surface, which defines an angle α2, different from said angle α1, in said X-Y plane, with respect to said Y axis; and a second planar elevation limiting surface, which defines an angle β2, different from said angle β1, in a plane parallel to said Y-Z plane, with respect to a plane parallel to said X-Y plane;

in said third operative orientation a pointer is directed to a third azimuthal location on said second rotatable water path deflector portion, indicated by a third indicium, and a pressurized water stream extends upwardly and radially outwardly into engagement with:

a third reaction surface, which defines an angle α3, different from said angle α1 and said angle α2, in said X-Y plane, with respect to said X axis; and a third planar elevation limiting surface, which defines an angle β3, different from said angle β1 and said angle β2, in a plane parallel to said X-Z plane, with respect to a plane parallel to said X-Y plane; and in said fourth operative orientation a pointer is directed to an azimuthal location on said second rotatable water path deflector portion indicated by a fourth indicium and a pressurized water stream extends upwardly and radially outwardly into engagement with:

a fourth reaction surface, which defines an angle α4, different from said angle α1, said angle α2 and said angle α3, in said X-Y plane, with respect to said Y axis; and a fourth planar elevation limiting surface, which defines an angle β4, different from said angle β1, said angle β2 and said angle β3, in a plane parallel to said Y-Z plane, with respect to a plane parallel to said X-Y plane.

* * * * *